US012004659B2

(12) United States Patent
Towle

(10) Patent No.: US 12,004,659 B2
(45) Date of Patent: Jun. 11, 2024

(54) MEDITATION SEAT SYSTEM

(71) Applicant: Ungloo LLC, Boulder, CO (US)

(72) Inventor: Perry E. Towle, Boulder, CO (US)

(73) Assignee: UNGLOO LLC, Boulder, CO (US)

( * ) Notice: Subject to any disclaimer, the term of this patent is extended or adjusted under 35 U.S.C. 154(b) by 0 days.

(21) Appl. No.: 18/072,229

(22) Filed: Nov. 30, 2022

(65) Prior Publication Data

US 2023/0142783 A1 May 11, 2023

Related U.S. Application Data

(63) Continuation of application No. 17/187,186, filed on Feb. 26, 2021, now Pat. No. 11,517,111.

(60) Provisional application No. 62/988,177, filed on Mar. 11, 2020.

(51) Int. Cl.

| | |
|---|---|
| ***A47C 4/52*** | (2006.01) |
| ***A47C 7/02*** | (2006.01) |
| ***A47C 7/42*** | (2006.01) |
| ***A47C 7/50*** | (2006.01) |
| ***A47C 7/52*** | (2006.01) |
| ***A47C 13/00*** | (2006.01) |
| ***A47C 16/04*** | (2006.01) |
| ***A47C 17/04*** | (2006.01) |

(52) U.S. Cl.

CPC ..... *A47C 7/42* (2013.01); *A47C 4/52* (2013.01); *A47C 7/021* (2013.01); *A47C 7/503* (2013.01); *A47C 7/52* (2013.01); *A47C 13/005* (2013.01); *A47C 16/04* (2013.01); *A47C 17/04* (2013.01)

(58) Field of Classification Search

CPC ..... A47C 16/04; A47C 9/005; A47C 16/00; A63B 21/4037; A63B 21/4039

See application file for complete search history.

(56) References Cited

U.S. PATENT DOCUMENTS

| | | | | |
|---|---|---|---|---|
| 2,701,009 | A | 2/1955 | Richard | |
| 4,536,902 | A | 8/1985 | McGill | |
| 4,777,678 | A | 10/1988 | Moore | |
| 4,974,870 | A | 12/1990 | Jarke et al. | |
| 4,987,625 | A | 1/1991 | Edelson | |
| 5,310,208 | A | 5/1994 | Jarke et al. | |
| 5,622,404 | A | 4/1997 | Menne | |
| 5,855,415 | A * | 1/1999 | Lilley, Jr. | A47C 7/021 5/655.9 |
| 6,081,943 | A | 7/2000 | Garcete | |
| 6,298,508 | B1 * | 10/2001 | McCloskey | A47C 9/005 5/632 |
| 6,343,837 | B1 | 2/2002 | Gage | |

(Continued)

FOREIGN PATENT DOCUMENTS

| | | | | |
|---|---|---|---|---|
| DE | 3903388 | A1 * | 8/1990 | |
| DE | 29915406 | U1 * | 2/2000 | A47C 11/00 |
| KR | 20220075156 | A * | 6/2022 | |

*Primary Examiner* — Timothy J Brindley

(74) *Attorney, Agent, or Firm* — NEO IP

(57) ABSTRACT

The present invention relates to seat systems, and more specifically to seat systems suitable for supporting users sitting in a cross-legged or kneeling position during activities such as meditation. Sitting closer to the ground, cross-legged, and/or kneeling enables the brain to easily enter a parasympathetic mode, providing users of the seat system a greater sense of calmness. The Multi-Angle Knee blocks (MAKs) offer a greater level of hip support for users.

18 Claims, 69 Drawing Sheets

(56) References Cited

U.S. PATENT DOCUMENTS 6,578,217 B1 6/2003 Roberson
6,623,270 B1 * 9/2003 Meldeau ..... A63B 21/4039 432/140
6,823,545 B1 11/2004 Davis
7,305,728 B2 * 12/2007 Schlieps ..... A47C 9/027 5/655.9
7,604,290 B1 10/2009 Giordano
7,628,455 B2 12/2009 Brodeur
7,966,679 B2 * 6/2011 Sakata ..... A63B 21/00047 482/142
8,322,343 B2 * 12/2012 Cardin ..... A61G 7/0755 128/845
8,777,306 B2 7/2014 Rahm
9,084,704 B2 * 7/2015 Oberst ..... A61G 7/075
9,089,230 B2 7/2015 Cho
9,204,720 B2 12/2015 Gagnon
9,277,813 B2 3/2016 Nelson et al.
10,213,025 B1 2/2019 Al-Bannai
2003/0101514 A1 * 6/2003 Roberson ..... A47C 16/04 5/632
2004/0192523 A1 * 9/2004 Wu ..... A63B 21/4037 482/148
2006/0261643 A1 11/2006 Lingwall
2007/0044233 A1 3/2007 Al-Sabah
2008/0022448 A1 1/2008 Todd et al.
2008/0087228 A1 4/2008 Bishop
2009/0192028 A1 * 7/2009 Shank ..... A63B 21/00047 482/148
2010/0123340 A1 5/2010 Lin
2011/0162560 A1 7/2011 Tang
2011/0221244 A1 9/2011 Bishop
2012/0111679 A1 5/2012 Van Den Biggelaar et al.
2014/0113781 A1 * 4/2014 McCarter ..... A63B 23/0205 482/140
2014/0256525 A1 * 9/2014 Mueller ..... A61H 1/0292 482/142
2015/0084382 A1 3/2015 Miller
2015/0084383 A1 3/2015 Zhu
2015/0296996 A1 * 10/2015 Weber ..... A47C 3/16 297/411.27
2016/0120332 A1 5/2016 Chou
2017/0291055 A1 * 10/2017 Madion ..... A63B 23/00
2017/0318970 A1 11/2017 Roizner
2017/0347800 A1 12/2017 Tang
2019/0082848 A1 3/2019 McClintock
2019/0104842 A1 4/2019 Forman
2020/0022496 A1 * 1/2020 Turner ..... A47C 15/004
2020/0282284 A1 * 9/2020 Searcy ..... A45B 27/00
2021/0282559 A1 9/2021 Towle

* cited by examiner

FIG. 7C
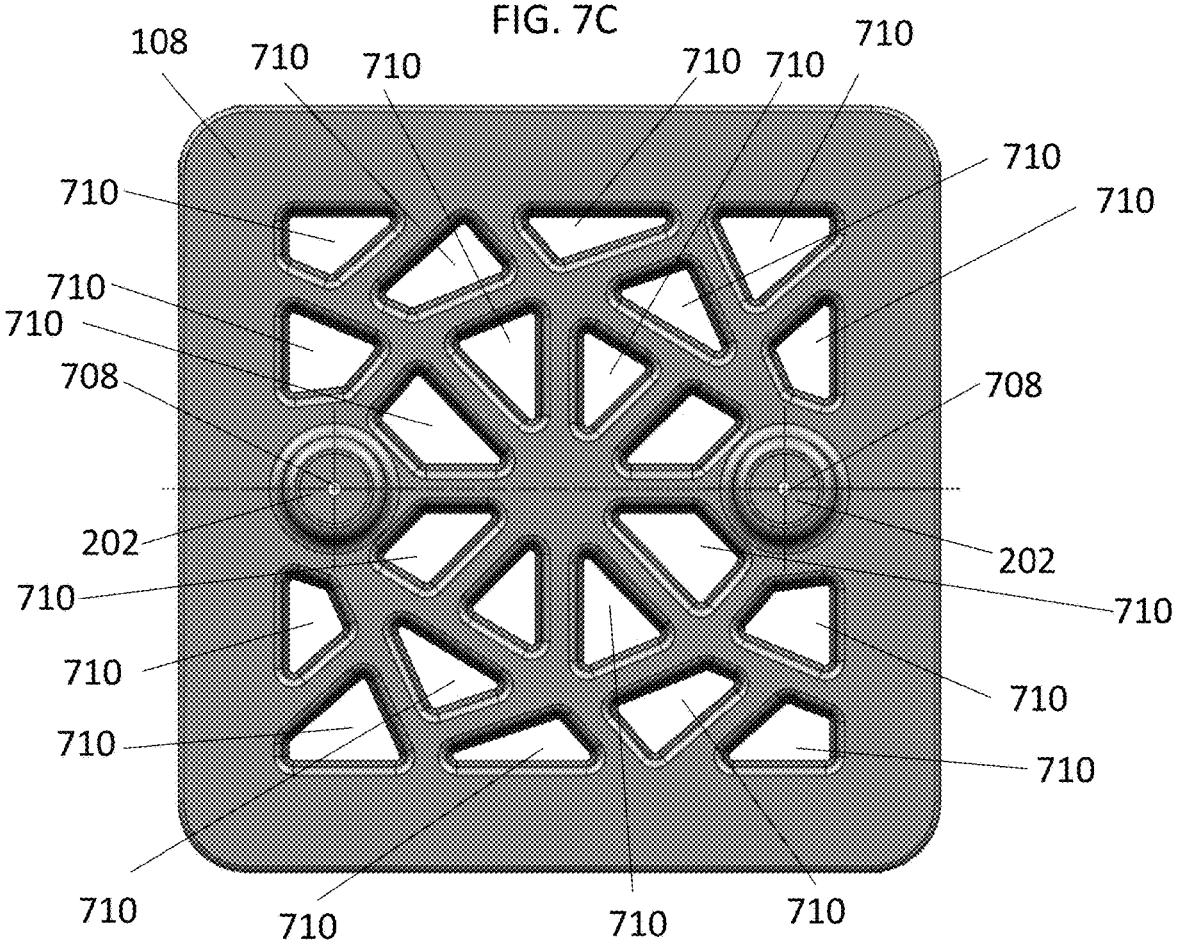
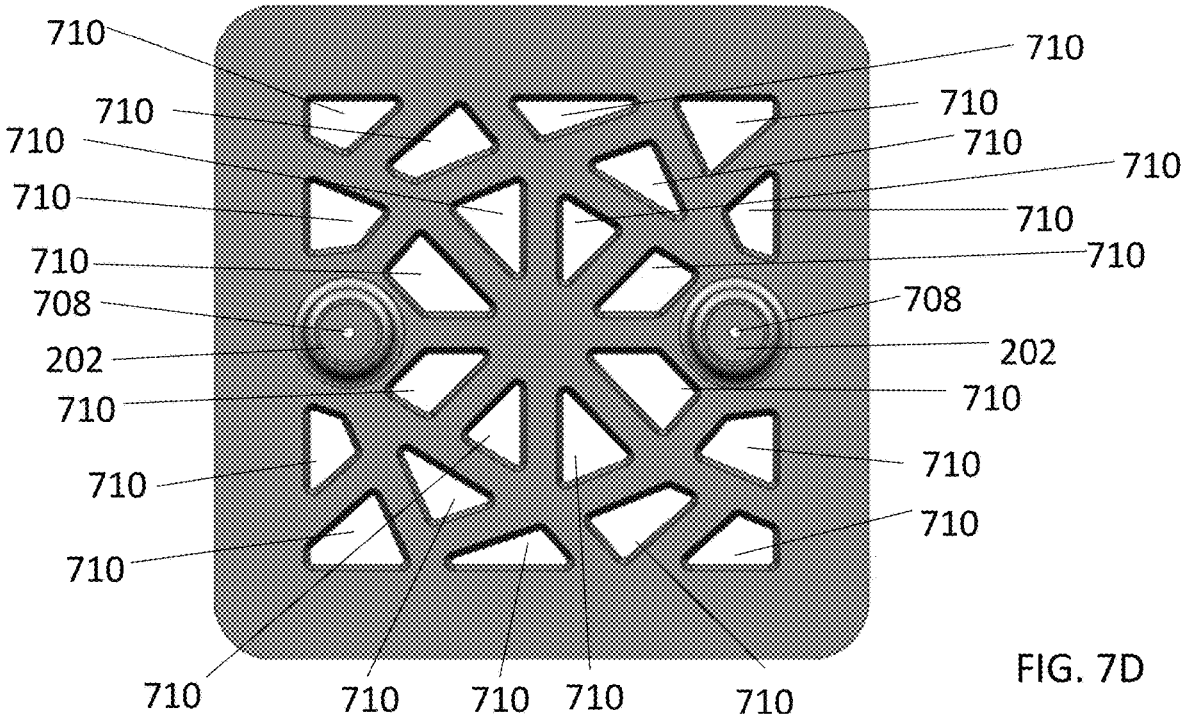
FIG. 7D

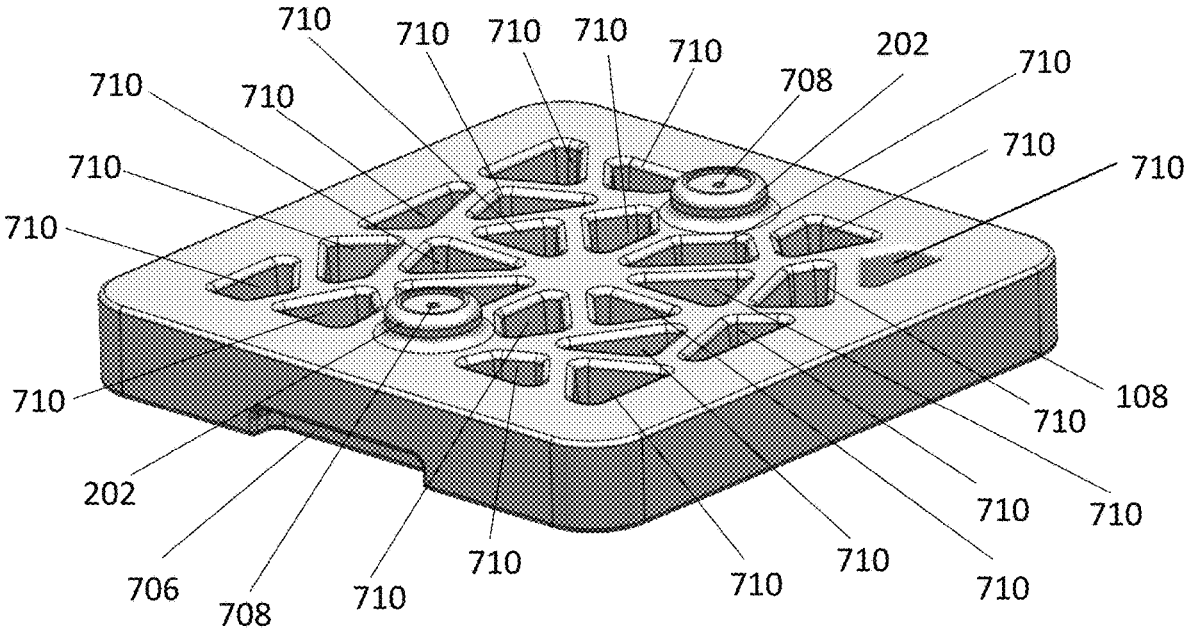
710
710
710
710
710
202
710
708
710
710
710
710

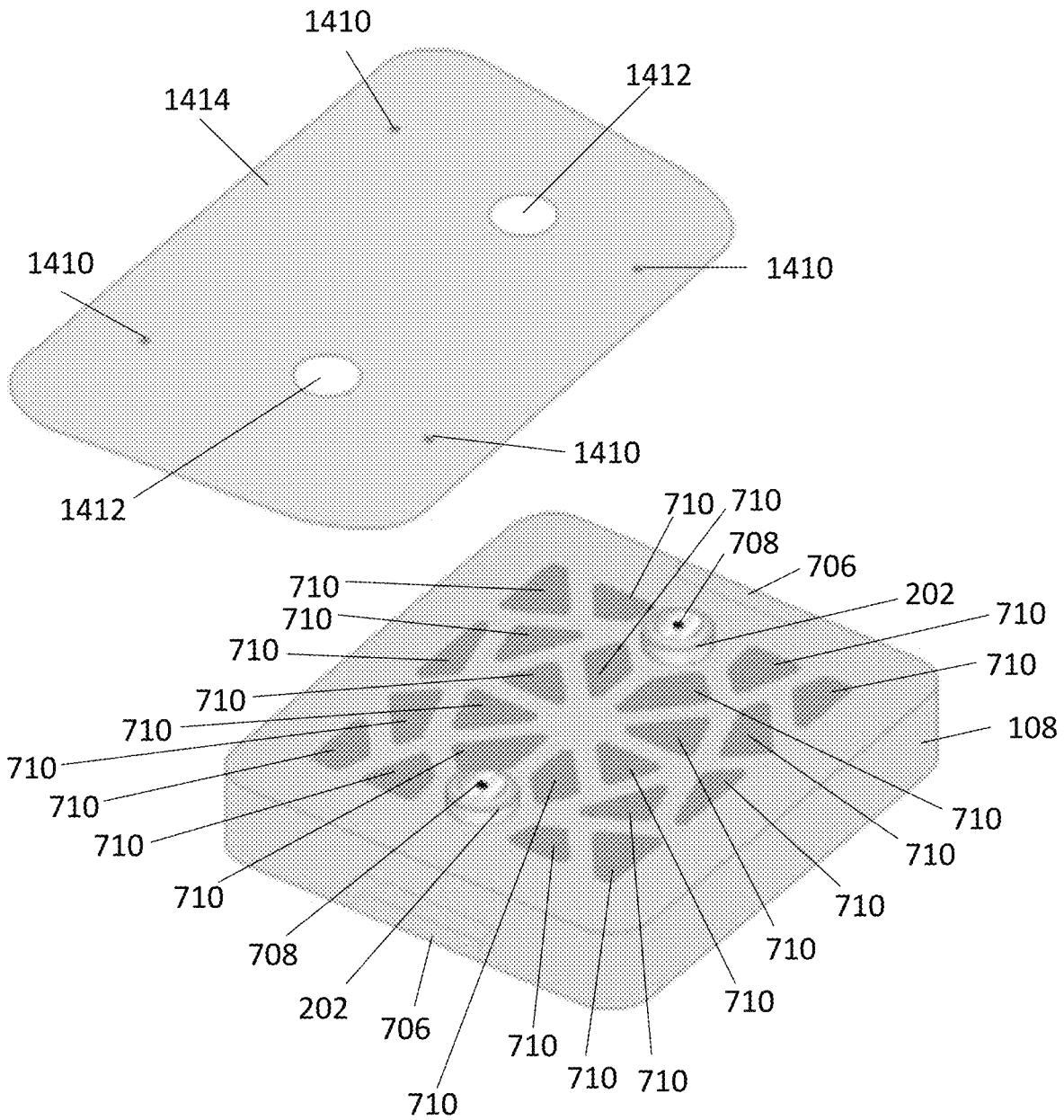
1410
1412
1414
1410
1410
1410
1412
710
710
708
706
202
710
710
710

MEDITATION SEAT SYSTEM

CROSS REFERENCES TO RELATED APPLICATIONS

This application claims the benefit of one or more co-pending prior-filed US patent applications: this application is a continuation of U.S. patent application Ser. No. 17/187,186, filed Feb. 26, 2021, which claims priority from U.S. Provisional Patent Application No. 62/988,177 filed Mar. 11, 2020, each of which is incorporated herein by reference in its entirety.

BACKGROUND OF THE INVENTION

1. Field of the Invention

The present invention relates to seat systems, and more specifically to seat systems suitable for supporting users sitting in a cross-legged or kneeling position during activities such as meditation.

2. Description of the Prior Art

It is generally known in the prior art to provide seat systems which support users in a variety of positions.

Prior art patent documents include the following:

U.S. Pat. No. 7,628,455 for Adjustable cross-legged support seat by inventor Brodeur, filed Oct. 27, 2006 and issued Dec. 8, 2009, is directed to a seating device for allowing a user to sit in either a cross-legged yoga position or in a conventional manner, the seating device including leg supports which can be adjusted into a variety of positions to supporting a user's legs when sitting cross-legged in a variety of places to accommodate the user's comfort level. The seat may also have an attached back support. In another embodiment the apparatus includes a seat having a surface area wide enough to allow a user to sit on the seat in a cross-legged position and having a contoured front to allow a user's legs to hang comfortably over the front of seat while the user sits in a conventional manner.

US Patent Publication No. 2019/0082848 for Chair that adapts to multiple sitting positions by inventor McClintock, filed Sep. 17, 2017 and published Mar. 21, 2019, is directed to a seating device for allowing a user to sit in either a cross-legged yoga position or in a conventional manner, the seating device including leg supports which can be adjusted into a variety of positions to supporting a user's legs when sitting cross-legged in a variety of places to accommodate the user's comfort level. The seat may also have an attached back support. In another embodiment the apparatus includes a seat having a surface area wide enough to allow a user to sit on the seat in a cross-legged position and having a contoured front to allow a user's legs to hang comfortably over the front of seat while the user sits in a conventional manner.

US Patent Publication No. 2017/0318970 for Meditation Seat by inventor Roizner, filed Jun. 9, 2016 and published Nov. 9, 2017, is directed to a specially designed seat assembly allowing a user to sit in lotus style meditation position while meditating. The seat assembly positions and elevates the user in order to provide comfort while holding the user in the correct position. The seat assembly can provide dual level support through an upper platform and lower platform. The seat assembly is specially shaped in order to conform to the contours of the user. The knees are elevated by the upper platform, and the feet and ankles are drawn inward and supported from the ground by the lower platform. The user is held in a traditional lotus style seating position. The seat assembly allows for the user to remain in a relaxed state, free from discomfort. The seat assembly is supported by a metal skeleton, which prevents the seat assembly from becoming deformed upon repeated use. The seat assembly has a cushion formed around the metal skeleton, which is stable, yet comfortable for the user.

U.S. Pat. No. 6,823,545 for Back support system by inventor Davis, filed May 16, 2003 and issued Nov. 30, 2004, is directed to a specially designed seat assembly allowing a user to sit in lotus style meditation position while meditating. The seat assembly positions and elevates the user in order to provide comfort while holding the user in the correct position. The seat assembly can provide dual level support through an upper platform and lower platform. The seat assembly is specially shaped in order to conform to the contours of the user. The knees are elevated by the upper platform, and the feet and ankles are drawn inward and supported from the ground by the lower platform. The user is held in a traditional lotus style seating position. The seat assembly allows for the user to remain in a relaxed state, free from discomfort. The seat assembly is supported by a metal skeleton, which prevents the seat assembly from becoming deformed upon repeated use. The seat assembly has a cushion formed around the metal skeleton, which is stable, yet comfortable for the user.

U.S. Pat. No. 4,777,678 for Method and apparatus for providing back support by inventor Moore, filed Jun. 18, 1986 and issued Oct. 18, 1988, is directed to a method and apparatus for providing orthopedic support. A preferred system includes a pair of wedge-shaped pillows, a cervical pillow and a rectangular elevation pillow. The pillows can be made of polyurethane foam and covered with nylon. One of the wedge-shaped pillows has a cross-section of a right isosceles triangle. The other wedge-shaped pillow also has a cross-section substantially similar to a right isosceles triangle but has a concave portion suitable for receiving a convex neck support area of the cervical pillow. The pillows preferably include Velcro™ strips which allow the pillows to be interconnected and connected to a mat so that an individual's legs and head can be appropriately supported to induce a pain-reducing curve in the individual's lower back. Rings are attached to the sides of pillows. Velcro™ covered straps 46 adjustably interconnect the rings to allow for various adjustable arrangements of the pillows. When the pillows are not in use to provide orthopedic support, they can be combined to form a geometric solid, e.g. a cube. Thus, they can be readily stored and transported in a compact solid shape, and can also be used as a small chair, stool or ottoman.

U.S. Pat. No. 9,089,230 for Pillow having a plurality of polygonal units by inventor Cho, filed May 15, 2012 and issued Jul. 28, 2015, is directed to a pillow having a plurality of polygonal units, includes: a triangular pentahedron unit having a shape of a triangular prism; a one-side inclined square hexahedral unit having a shape of a square pillar; a rectangular hexahedron unit having a shape of a rectangular pillar; a both-side inclined rectangular hexahedron unit having a shape of a rectangular pillar; a rhombic hexahedron unit having a shape of a rhombic pillar; an isosceles-triangular pentahedron unit having a shape of an isosceles triangular prism; and a rectangular panel-shaped hexahedron unit having a shape of a rectangular pillar, whereby the units are sewn together in such a way so as to selectively come into surface contact with each other or be stacked, thus forming one pillow, with the respective units being filled with stuffing. When the three members are folded to nest together, a unitary object is formed for easy shipment or storage.

U.S. Pat. No. 4,987,625 for Adjustable personal support apparatus by inventor Edelson filed Oct. 27, 1989 and issued Jan. 29, 1991, is directed to an adjustable, ergonomically sound apparatus for the human body to assume many positions such as kneeling, sitting or lying. The main components of the invention are comprised adjustable cushions with adjustable supports for the knees, ankles, feet, toes, buttocks, back legs and head. This invention is portable and allows the user to assume the positions of kneeling, sitting and laying for long periods of time on a mobile basis with out the pain, discomfort and lasting damage associated with going long periods of time in these positions without proper supports.

U.S. Pat. No. 6,578,217 for Cushion and method for accommodating multiple body positions by inventor Roberson filed Nov. 30, 2001 and issued Jun. 17, 2003, is directed to A plurality of resilient cushions are flexibly attached in a collapsible unitary structure which may be easily adjusted to provide head and body support for persons working or resting in prone, supine and other bodily attitudes. A primary, wedge-shaped upper-body cushion is joined at its thick end by hinged means to a smaller parallelelpipedic head pillow which may pivot so as to lie either on top, or in front of, the inclined upper surface of the primary cushion. When in the later position it is supported on a parallelepipedic protrusion of the primary cushion. The upper front corners of the primary cushion are chamfered to provide arm support, and its truncated rear end is joined by hinged means to a parallelepipedic lower-body cushion, and also provided with a handle for ready transport and storage of the entire device.

U.S. Pat. No. 8,777,306 for Combination foldable chair and rolling transport by inventor Rahm filed Nov. 9, 2011 and issued Jul. 15, 2014, is directed to A foldable chair, operable between a seating configuration and a rolling transport configuration, the foldable chair comprising a plurality of legs with a roller secured to the distal end of each leg and the proximal end of each leg secured to a column base. Extending from the column base is a column with a first and second end, the column first end secured to the column base and the second end of the column secured to a first platform or seat cushion. A second platform extends downwardly from the first platform for attaching a carrying case. Also included is a backrest rotatably secured to the first platform such that when the backrest is perpendicular to the first platform two roller elements are fully shrouded. When the backrest is rotated 90 degrees and disposed substantially parallel to the seat cushion the roller elements are exposed for rolling contact with the ground surface.

US Patent Publication No. 2019/0104842 for Modular furniture construction system by inventor Forman filed Oct. 10, 2017 and published Apr. 11, 2019, is directed to a modular furniture construction set comprising multiple pieces that can be assembled in multiple ways to form temporary but stable forms that can be used for a variety of uses such as furniture, play structures, work surfaces, room partitions etc. With suitable dimensions and materials, it is conceivable that the present invention can be used to construct temporary or permanent housing. The assembled pieces are devised such that at least one embodiment of a completed assembly is a square cube.

U.S. Pat. No. 9,277,813 for Modular furniture assembly and display kit with magnetic coupling assembly by inventor Nelson filed Dec. 14, 2010 and issued Mar. 8, 2016, is directed to a modular furniture assembly comprising a base and a transverse member with a convenient magnetic coupling assembly. A miniature display kit can be used in advertising or in a retail setting to display the benefits and optional positions of modular furniture. The display kit can have the same or essentially the same features as the modular furniture assembly.

SUMMARY OF THE INVENTION

The present invention relates to a seat system providing support for users seated in a cross-legged or kneeling position.

It is an object of this invention to provide a compact, transportable seat system which supports a user's knees, hips, and back to increase the level of comfort for the user when seated in a cross-legged or kneeling position. As opposed to the prior art, the system provides for a system which allows a user to be seated cross-legged or kneeling on a platform close to the floor or ground, with highly adjustable knee blocks, or multi-angled knee blocks (MAKs), to support the knees and hips of users who are relatively inflexible.

In one embodiment, the present invention includes a customizable seat system for supporting a user in a cross-legged or kneeling position.

In another embodiment, the present invention includes a customizable knee block for supporting the knees and hips of a user in a cross-legged or kneeling position.

In yet another embodiment, the present invention includes a base with an adjustable height including a plurality of magnetic risers.

These and other aspects of the present invention will become apparent to those skilled in the art after a reading of the following description of the preferred embodiment when considered with the drawings, as they support the claimed invention.

BRIEF DESCRIPTION OF THE DRAWINGS

FIG. 7C illustrates a top orthogonal view of a riser plate with indentations according to another embodiment of the present invention.

FIG. 7D illustrates a top orthogonal view of the riser plate with indentations according to another embodiment of the present invention.

FIG. 7H illustrates a front perspective view of the riser plate with indentations according to another embodiment of the present invention.

FIG. 7I illustrates a view of the riser plate with indentations according to another embodiment of the present invention.

FIG. 14B illustrates a side perspective view of a seat support and riser plate according to one embodiment of the present invention.

DETAILED DESCRIPTION

Figure 1A:
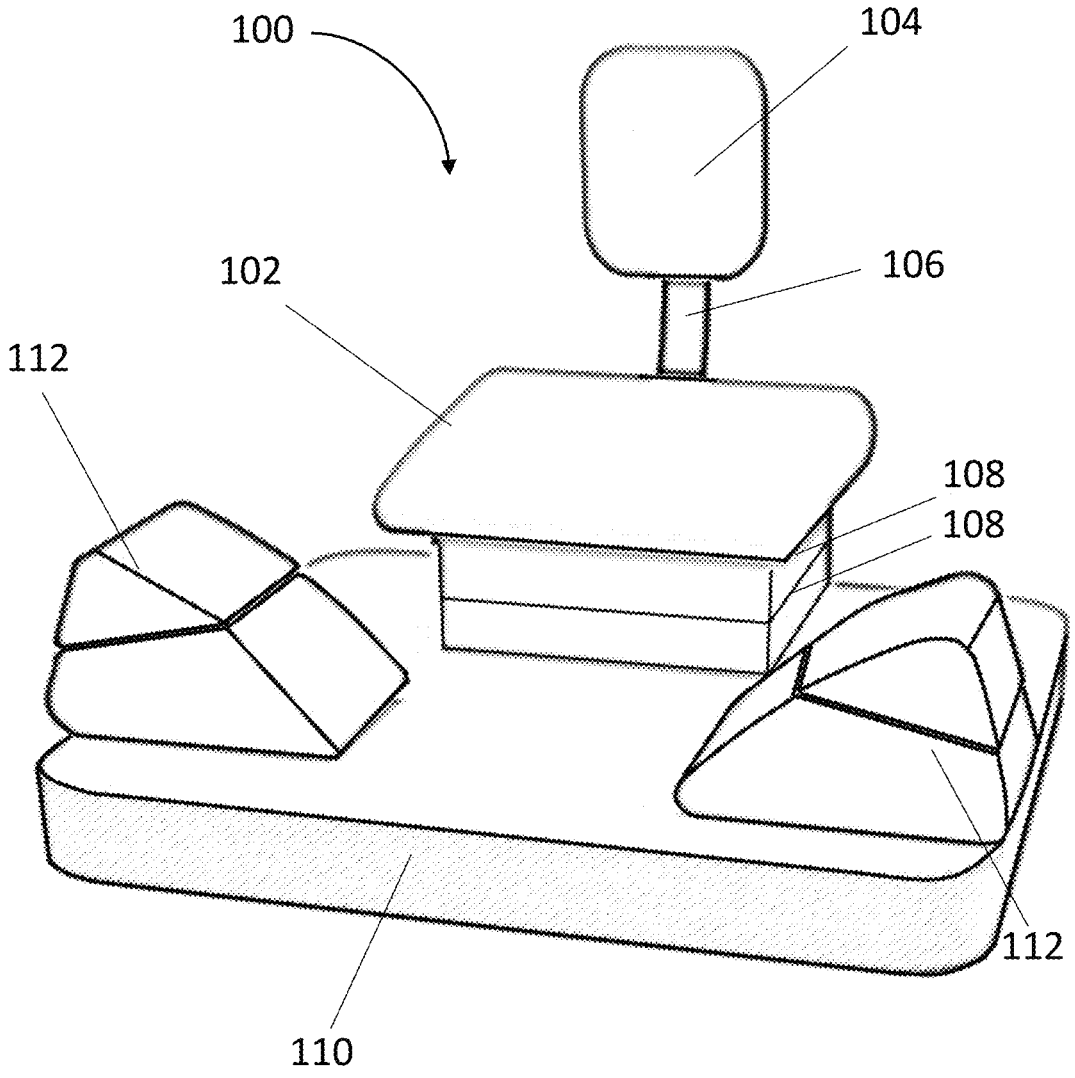
FIG. 1A illustrates a front perspective view of a seat system according to one embodiment of the present invention.

The present invention is generally directed to a portable seat system. The system includes a seat, risers operable to be magnetically coupled to each other, a base, and knee blocks.

In one embodiment, the present invention includes a customizable seat system for supporting a user in a cross-legged or kneeling position.

In another embodiment, the present invention includes a customizable knee block for supporting the knees and hips of a user in a cross-legged or kneeling position.

In yet another embodiment, the present invention includes a base with an adjustable height including a plurality of magnetic risers.

None of the prior art discloses a seat base including a plurality of risers, wherein the height of the base is adjustable by removing or adding one or more risers, and wherein the risers are magnetically coupled to each other. Furthermore, none of the prior art discloses adjustable knee blocks including a base and a wedge attached to the base via a hinge, with the wedge operable to rotate about the hinge such that the knee block is operable to provide a range of heights and angles relative to a flat surface when placed on the flat surface. Finally, none of the prior art discloses a compact, portable seat system with a seat, risers, knee blocks, and a folding base operable to old such that the base receives the seat, risers, and knee blocks.

Meditation is an ancient practice that has been around for thousands of years. While definitions of and postures for meditation vary across different cultures and religion, one common position of meditation involves a meditator sitting in a cross-legged or kneeling position on the ground or on the floor. Meditation can be performed while sitting in a chair or lying down; however, there are several disadvantages to these positions. Sitting in a chair or on other furniture distorts natural posture. Humans' skeletal structure and muscular structure have evolved such that it causes less discomfort for humans to sit on the ground or in a squatting position. Sitting in a chair or on other furniture causes tightening of the hip flexors, weakening of the core, back, and neck muscles, and compression of spinal discs over time. Over time, this can lead to pain throughout the body, including pain in the hips, shoulders, back and neck. Additionally, sitting in a chair or on another piece of furniture causes the brain to shift to work mode, as a sitting position is often associated with work. Conversely, lying down while meditating is disadvantageous because this position is associated with sleep. Therefore, lying down causes the brain to shift to sleep mode, making this position not ideal for meditation.

On the other hand, meditation in a cross-legged position or lotus position provides the benefits of a natural posture as well as activating the parasympathetic nervous system. This provides for reduced anxiety and a calmer, more relaxed state. However, many people find it difficult to maintain a cross-legged position or lotus position for a period of time long enough to meditate because people are not accustomed to sitting in this position and their muscles are not sufficiently developed or not sufficiently flexible to maintain this position. This is particularly true for adult men. Typically, people who are not flexible enough to meditate in a cross-legged or lotus position have been forced to meditate on a piece of furniture, lying down, or have assembled a hodgepodge of pillows, blankets, or cushions to attempt to provide sufficient support to meditate in a cross-legged or lotus position. However, this hodgepodge assembly is difficult to consistently reproduce in the same or a similar configuration, time consuming to reproduce in the same or a similar configuration, and typically not sufficiently supportive of the knees or hips.

Sitting on a cushion may provide some support for users in a cross-legged position. However, when sitting cross legged on a cushion, many Westerners elevate their butts, resulting in the knees shooting up into the air after only a few minutes of sitting in this position. This results in a lack of comfort in the back, hips, knees, and ankles. While some knee blocks have attempted to address these issues, these knee blocks don't fit most tight-hipped people and are not readily customizable. Some knee blocks require removal or addition of fill material to adjust the shape or angle of the knee block. Additionally, many knee blocks are not customizable at all, and therefore do not provide adequate comfort for users in a cross-legged position.

Accordingly, there is a need for a seating system which allows a user to be close to the ground or floor and which provides support for a user in a cross-legged or kneeling position. There is also a need for a seating system including a seat with an adjustable height which provides back support, and a seating system including knee supports which are adjustable to support the height of a variety of users' knees when the users are in a cross-legged, kneeling, or lotus position. Finally, there is a need for a seating system which is compact and portable such that it can be easily assembled, disassembled, and transported.

Referring now to the drawings in general, the illustrations are for the purpose of describing one or more preferred embodiments of the invention and are not intended to limit the invention thereto.

The present invention is directed to a seat system providing support for users seated in a cross-legged, kneeling, or lotus position. The seat system includes a base including a plurality of adjustable risers, a seat with a back operable to rotate 180 degrees, hinged knee blocks, and a foldable base operable to include the other components when in a folded or collapsed state.

FIG. 1A illustrates a front perspective view of a seat system 100 according to one embodiment of the present invention, including a seat 102 connected to a backrest 104 via a spine 106, risers 108, a base 110, and adjustable knee blocks 112. In one embodiment, the seat system is operable for use by a user with just the base 110. In another embodiment, the seat system is operable for use by a user with the base 110 and knee blocks 112. Advantageously, the knee blocks 112 are operable to be positioned on the base in any position to support a user of the seat system 100. The weight of a user's body naturally holds the knee blocks 112 in place such that the knee blocks do not require any additional material or fasteners to stay in place, and the knee blocks are not attached or affixed to any other component when in use. The knee blocks 112, or MAKs, provide increased hip support for users and are operable to configure into a variety of positions. In one embodiment, the base 110 is operable to be used as a stand-alone seat system, where a user can kneel or sit in any other comfortable position without requiring users to set up the knee blocks 112, riser plates 108, seat 102, and back rest 104.

In one embodiment, the seat 102 is operable to rotate 90 degrees, increasing the length of the seat 102 and enabling a user to sit or kneel length-wise on the seat 102. By rotating the seat 102 90 degrees, the base 110 enables users to drop their feet down, offering increased ankle support. Many people find the act of kneeling uncomfortable, including men, women, seniors, and younger people. When the seat 102 is rotated 90 degrees, users are able to flatten their knees, legs, and ankles out, providing greater support for these areas. In one embodiment, the seat 102 measures approximately 16 inches by 11 inches In another embodiment, the seat system is operable for use as a workstation. The riser plates 108 are lightweight, stable, durable, and easy to stack. This functionality enables users to place a work device on top of the riser plates 108, adjusted to the user's desired height. Instead of meditation, the seat system is operable to enable users to work in a cross-legged or kneeling position, using the riser plates 108 and/or seat 102 as a platform for their work device.

Figure 1B:
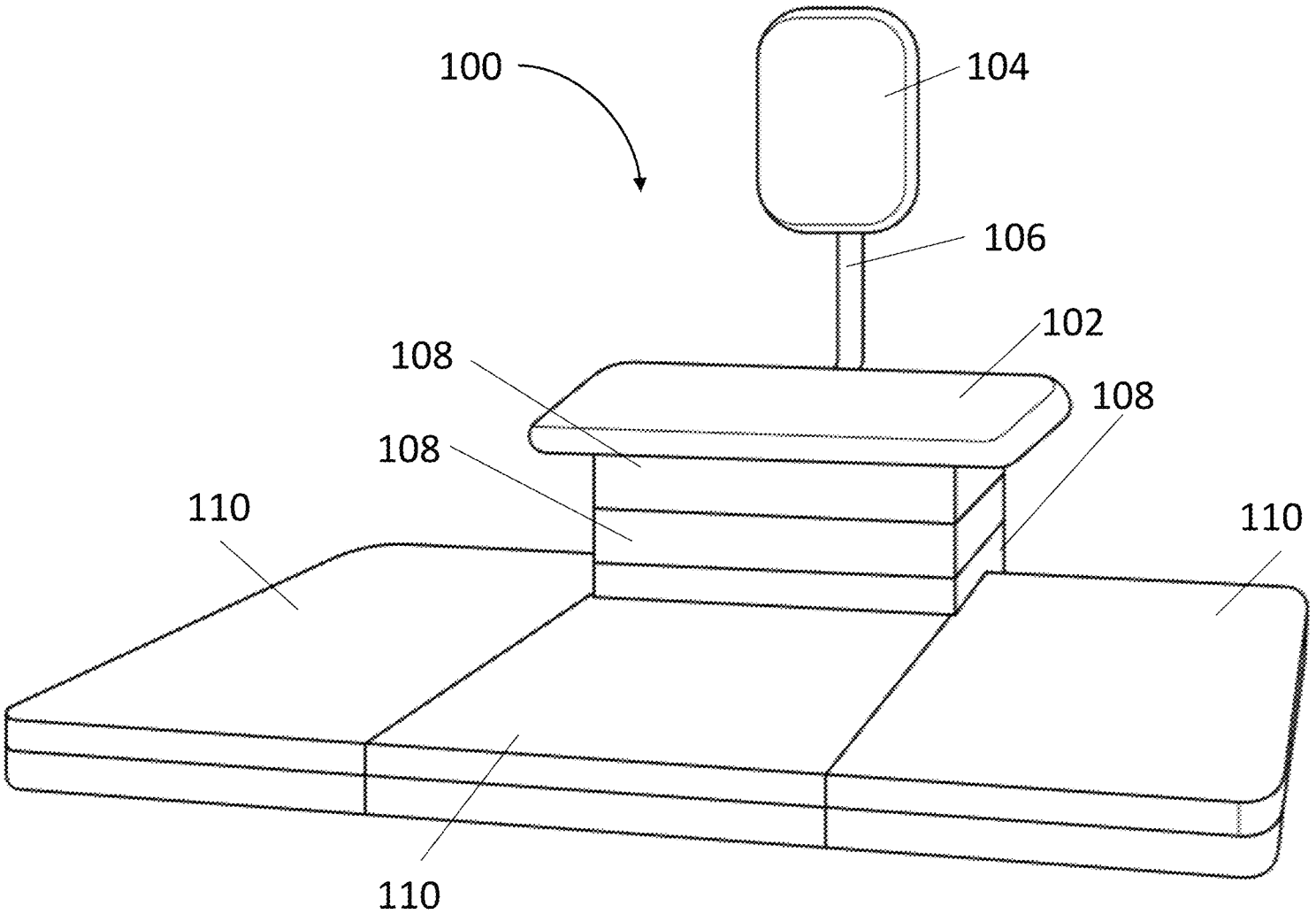
FIG. 1B illustrates a front perspective view of a seat system according to another embodiment of the present invention.

FIG. 1B illustrates a front perspective view of a seat system according to another embodiment of the present invention. The seat system is operable to be used as a stand-alone seat system, enabling a user to kneel and/or sit in any other comfortable position without requiring users to set up the knee blocks 112. Users are then able to use the seat system as a meditation system and/or a workstation. The adjustable height of the riser plates 108 enables users to set a work device on the seat 102 and allow users to sit cross-legged or in a kneeling position while working.

Figure 1C:
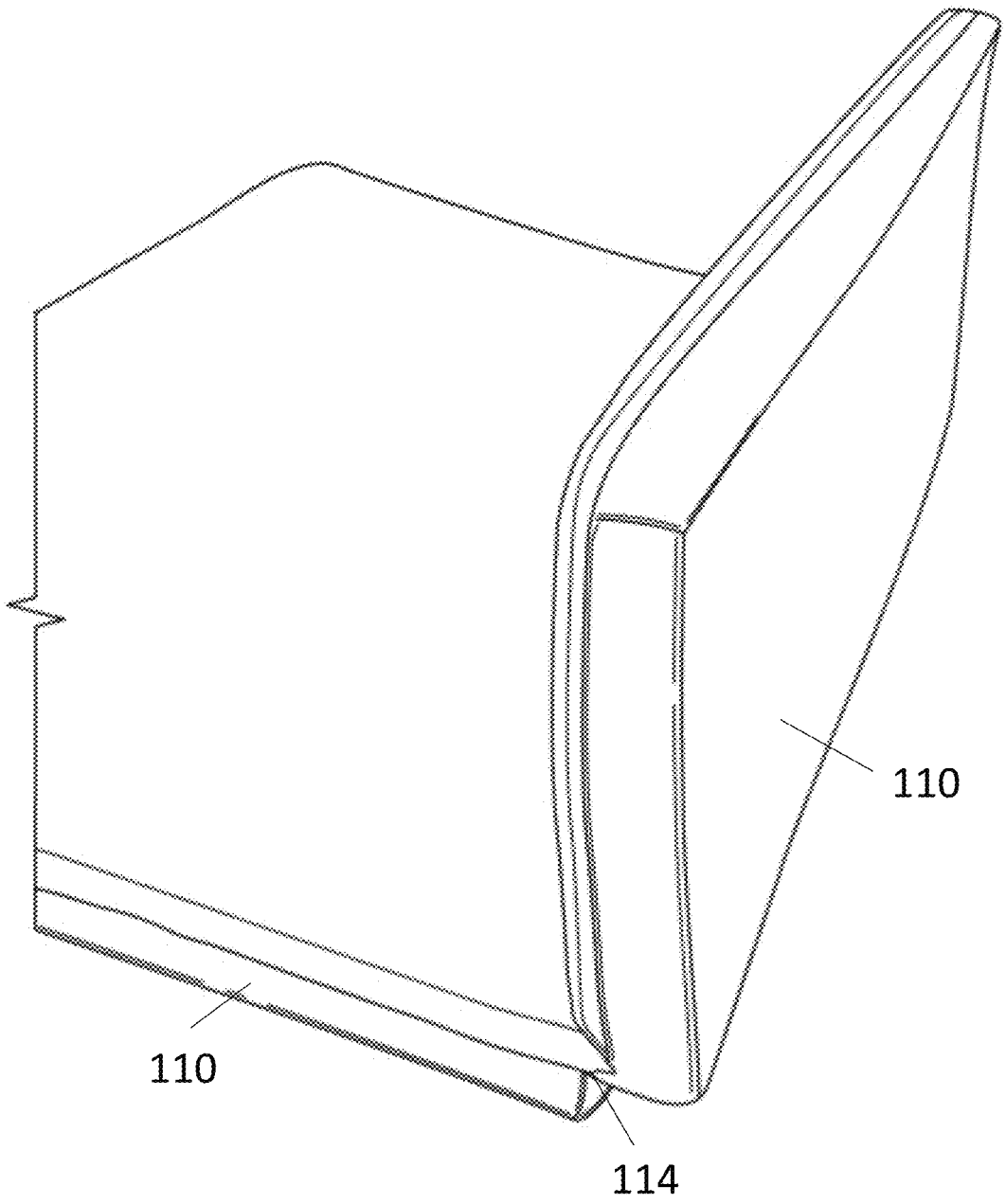
FIG. 1C illustrates a front perspective view of a seat system adjusting to a collapsed state according to one embodiment of the present invention.

FIG. 1C illustrates a front perspective view of a seat system adjusting to a collapsed state according to one embodiment of the present invention. The base 110 of the seat system is operable to fold into a collapsed state via a base hinge 114. The base hinge 114 is sewn into the seat system at the edge of each base 110, enabling the sides of the base 110 to fold upwards by at least a 90-degree angle. The base hinge 114 further connects each base 110 to one another. With each base 110 folded upwards, the seat system is operable to adjust to a collapsed state. In one embodiment, the base hinge 114 is not sewn into the seat system.

Figure 1D:
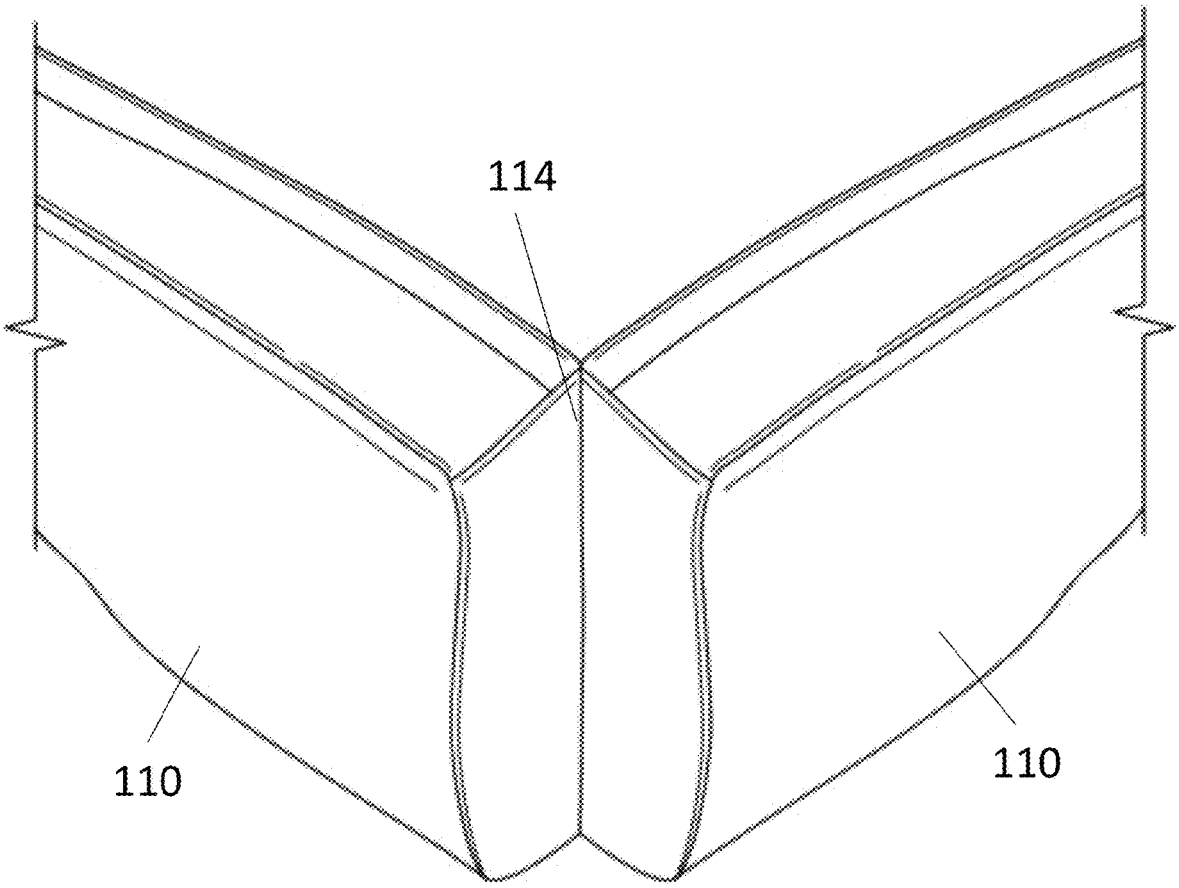
FIG. 1D illustrates a front perspective view of a seat system adjusting to a collapsed state according to another embodiment of the present invention.

FIG. 1D illustrates a front perspective view of a seat system adjusting to a collapsed state according to another embodiment of the present invention. Each base 110 is connected to one another via a base hinge 114. The base hinge 114 enables the base 110 to fold upwards by at least a 90-degree angle. When the bases 110 of the seat system are folded upwards by means of the base hinge 114, the seat system is operable to adjust to a collapsed state.

Figure 2:
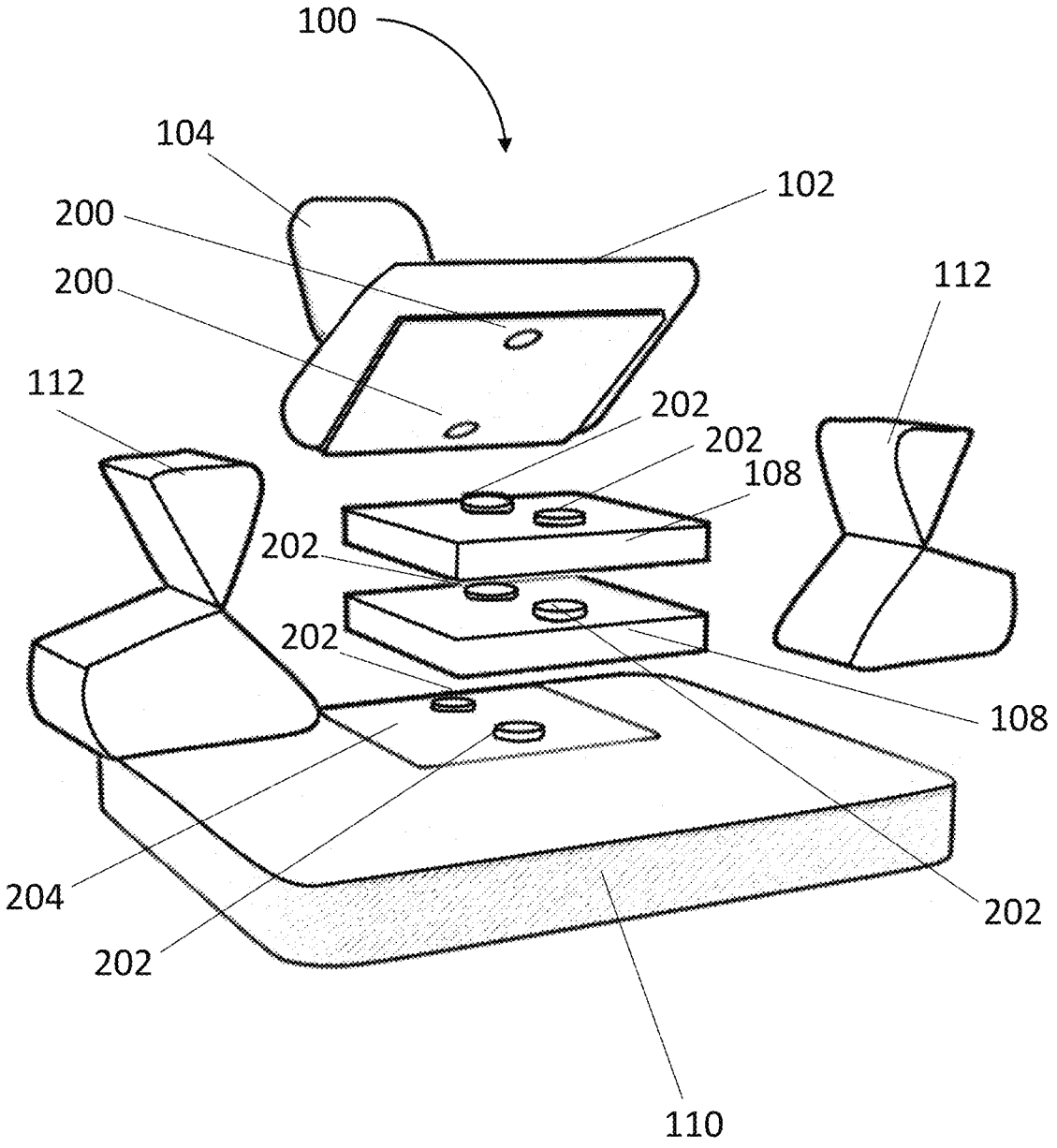
FIG. 2 illustrates a front perspective exploded view of the seat system according to one embodiment of the present invention.

FIG. 2 illustrates a front perspective exploded view of the seat system shown in FIG. 1A. In this front perspective exploded view of the seat system, the bottom of the seat 102 is visible, exposing two magnetic protrusion indentations 200. These magnetic protrusion indentations 200 enable the seat 102 to connect with a riser 108 using magnetic protrusions 202 associated with each riser 108. In addition, the base 110 of the seat system contains a recess 204 enabling the attachment of the risers 108 to the base 110 of the seat system. The recess 204 includes magnetic protrusions 202 which are operable to attach to the bottom of a riser 108 or the bottom of the seat 102 via two magnetic protrusion indentations 200 on the bottom of the seat 102 or the bottom of the risers.

Figure 3A:
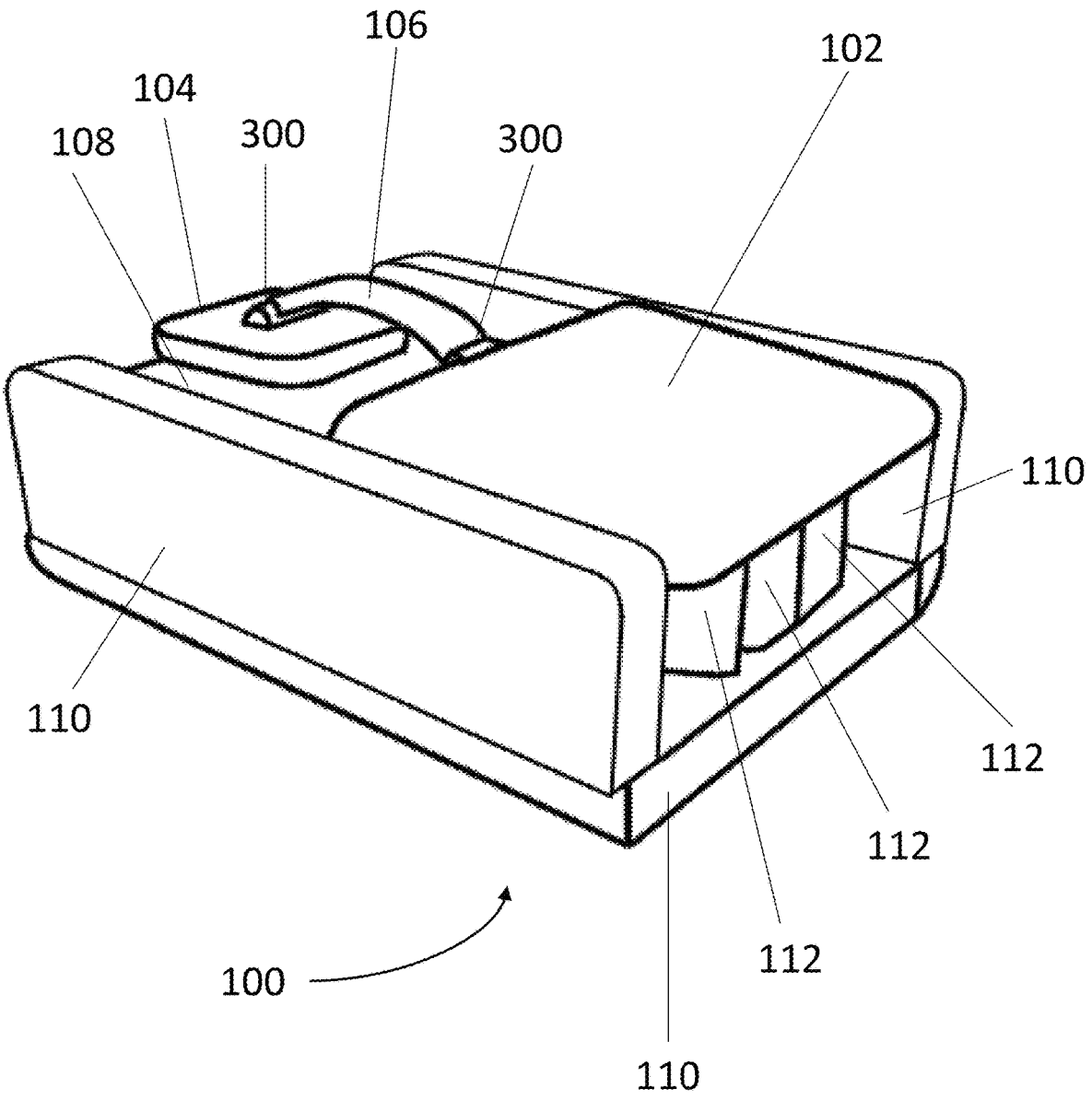
FIG. 3A illustrates a front perspective view of the seat system in a collapsed state according to one embodiment of the present invention.

FIG. 3A illustrates a front perspective view of the seat system in a collapsed state according to one embodiment of the present invention. The backrest 104 is in a fully extended position from the seat 102 via the spine 106, i.e. the backrest 104 is rotated 180 degrees from the seat 102. The assembly of the seat 102, the backrest 104, and the spine 106 forms one side of the collapsed seat system assembly. The risers 108 are stacked and then placed between the base 110 and the backrest 104. The spine 106 is connected to the backrest 104 and the seat 102 via two swivels 300. When in the collapsed state, the seat 102, the backrest 104, the spine 106, and the risers fit between the base 110.

Figure 3B:
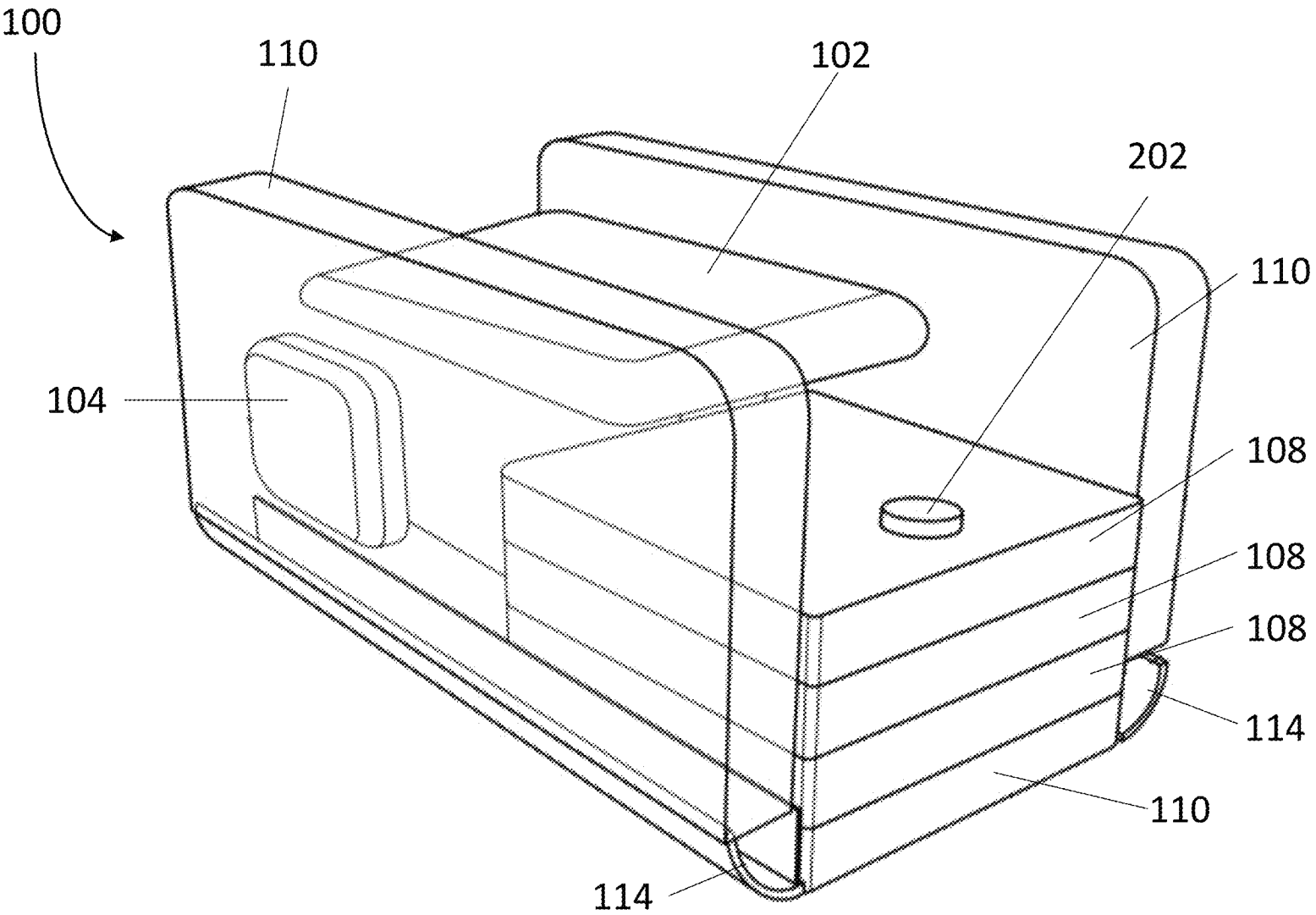
FIG. 3B illustrates a front perspective view of the seat system in an elongated collapsed state according to one embodiment of the present invention.

FIG. 3B illustrates a front perspective view of the seat system in an elongated collapsed state according to one embodiment of the present invention. Portions of the base 110 are operable to fold upward 90 degrees using base hinges 114, enabling the seat system 100 to fold into an elongated collapsed state. In the elongated collapsed state, the seat 102, riser plates 108, and back rest 104 are operable to sit between the upward-folding base 110 portions. The base 110 portions are operable to fold upward via the base hinges 114, attached where a portion of the base 110 has been cut away. In one embodiment, the base hinges 114 are operable bend to a 90-degree angle. In one embodiment, the base hinges 114 are comprised of fabric. The fabric on top is still flat when the base 110 is placed on the floor.

Figure 3C:
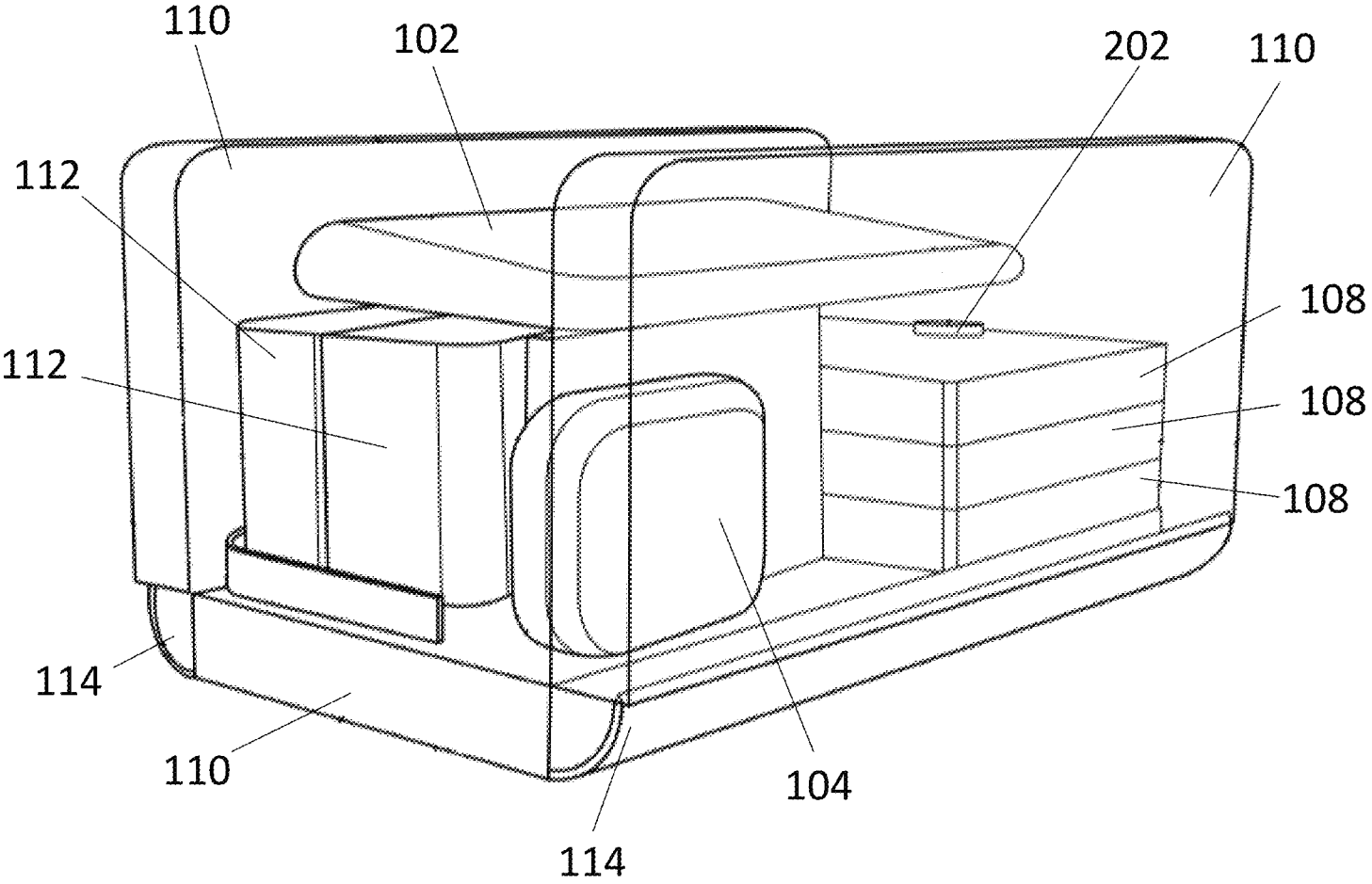
FIG. 3C illustrates a rear perspective view of the seat system in an elongated collapsed state according to one embodiment of the present invention.

FIG. 3C illustrates a rear perspective view of the seat system in an elongated collapsed state according to one embodiment of the present invention. Portions of the base 110 are operable to fold upward 90 degrees, enabling the seat system 100 to fold into an elongated collapsed state using base hinges 114. In the elongated collapsed state, the seat 102, riser plates 108, back rest 104, and spine 106 are operable to sit between the upward-folding base 110 portions.

Figure 3D:
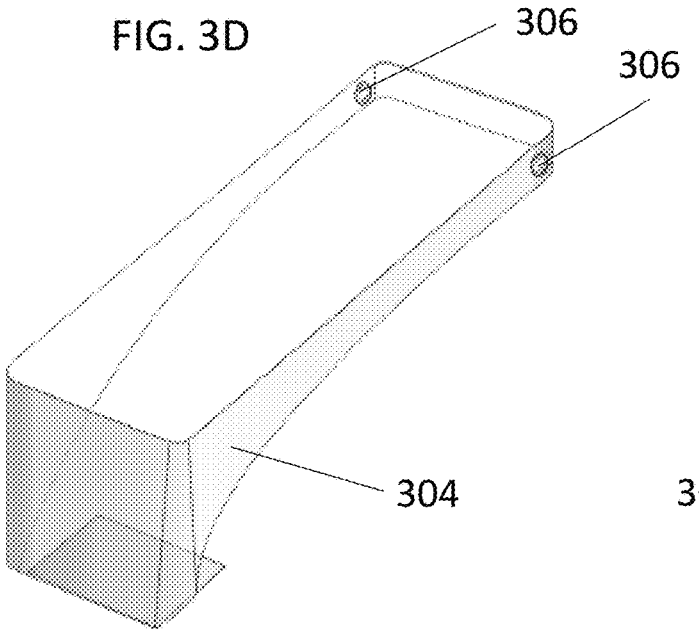
FIG. 3D illustrates a cover for the seat system in a collapsed state according to one embodiment of the present invention.

FIG. 3D illustrates a cover for the seat system in a collapsed state according to one embodiment of the present invention. The cover 304 is held in place when the cover is placed on the base by at least two magnets 306 which magnetically connect with at least two corresponding magnetics on the base. In one embodiment, the cover 304 is made of LYCRA. LYCRA is a polyurethane-based synthetic fiber, also known as spandex or elastane. By using a cover, every component of the seat system is secure when the seat system is in the collapsed state. In another embodiment, the cover 304 is made of a synthetic polyamide, an organic petrochemical compound. In another embodiment, the cover 304 is made of viscose or rayon, a fiber constructed with regenerated cellulose. In yet another embodiment, the cover 304 is made of polyester-elastane (PET), modified ethylene glycol and purified terephthalic acid.

In another embodiment, the cover 304 is comprised of fabric and is operable to roll up and attach to the base of the seat. In this embodiment, the cover 304 does not require the use of magnets in order to attach to the collapsed seat system.

Figure 3E:
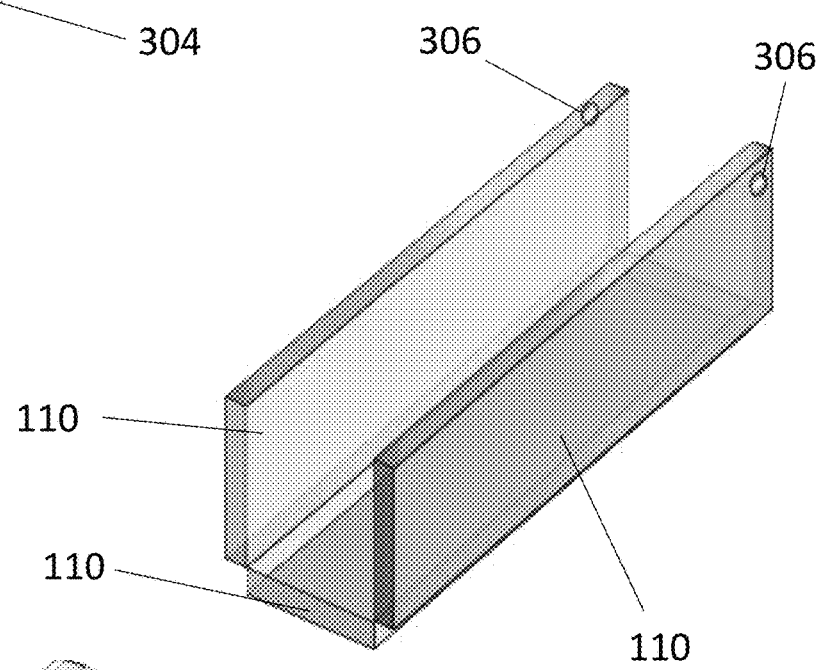
FIG. 3E illustrates a front perspective view of the base of the seat system in a collapsed state according to one embodiment of the present invention.

FIG. 3E illustrates a front perspective view of the base components of the seat system in a collapsed state according to one embodiment of the present invention. The two side components of the base 110 are operable to fold upwards at a 90-degree angle from the horizontal plane of the base. Each of the two side components of the base operable to fold upward and each contains at least one magnet 306 for magnetically connecting the base to corresponding magnets in the cover.

Figure 3F:
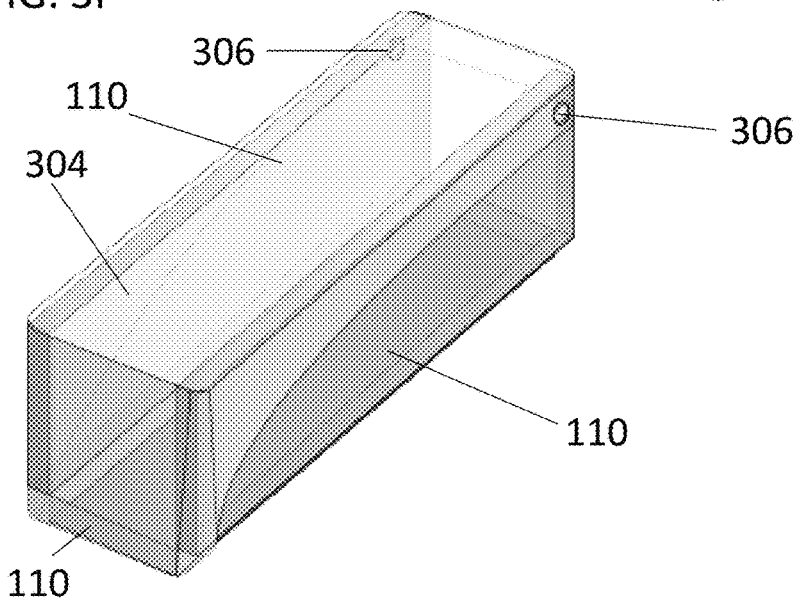
FIG. 3F illustrates a front perspective view of a collapsed seat system with a cover placed around the base of the collapsed seat system according to one embodiment of the present invention.

FIG. 3F illustrates a front perspective view of a collapsed seat system with a cover placed around the collapsed seat system in one embodiment of the present invention. The cover 304 is placed over the upward-folding base 110 components and is attached to the upward-folding base components via at least two magnets 306 of the base which magnetically connect to at least two magnets 306 of the cover. In one embodiment, the cover uses hook and loop tape (e.g. VELCRO) instead of magnets in order to connect to the collapsed seat system. In another embodiment, the cover uses buttons to connect to the collapsed seat system. In another embodiment, the cover uses snapping mechanisms to connect to the collapsed seat system. In yet another embodiment, the cover uses laces to connect to the collapsed seat system. In yet another embodiment, the cover uses a hook-and-eye closure to connect to the collapsed seat system. In yet another embodiment, the cover uses buckles to connect to the collapsed seat system.

Figure 3G:
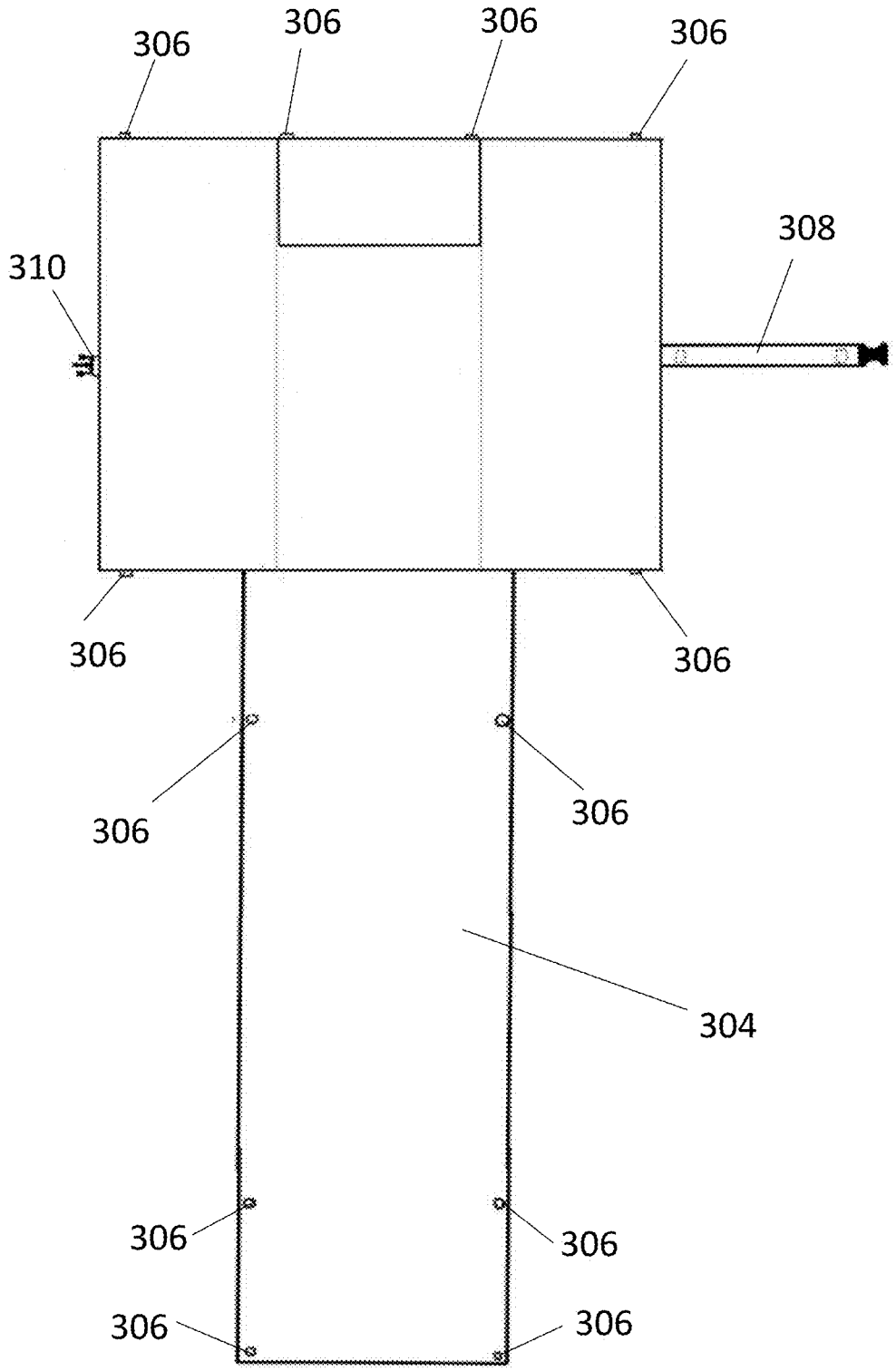
FIG. 3G illustrates a top orthogonal view of a cover for a collapsed seat system according to one embodiment of the present invention.
Figure 3H:
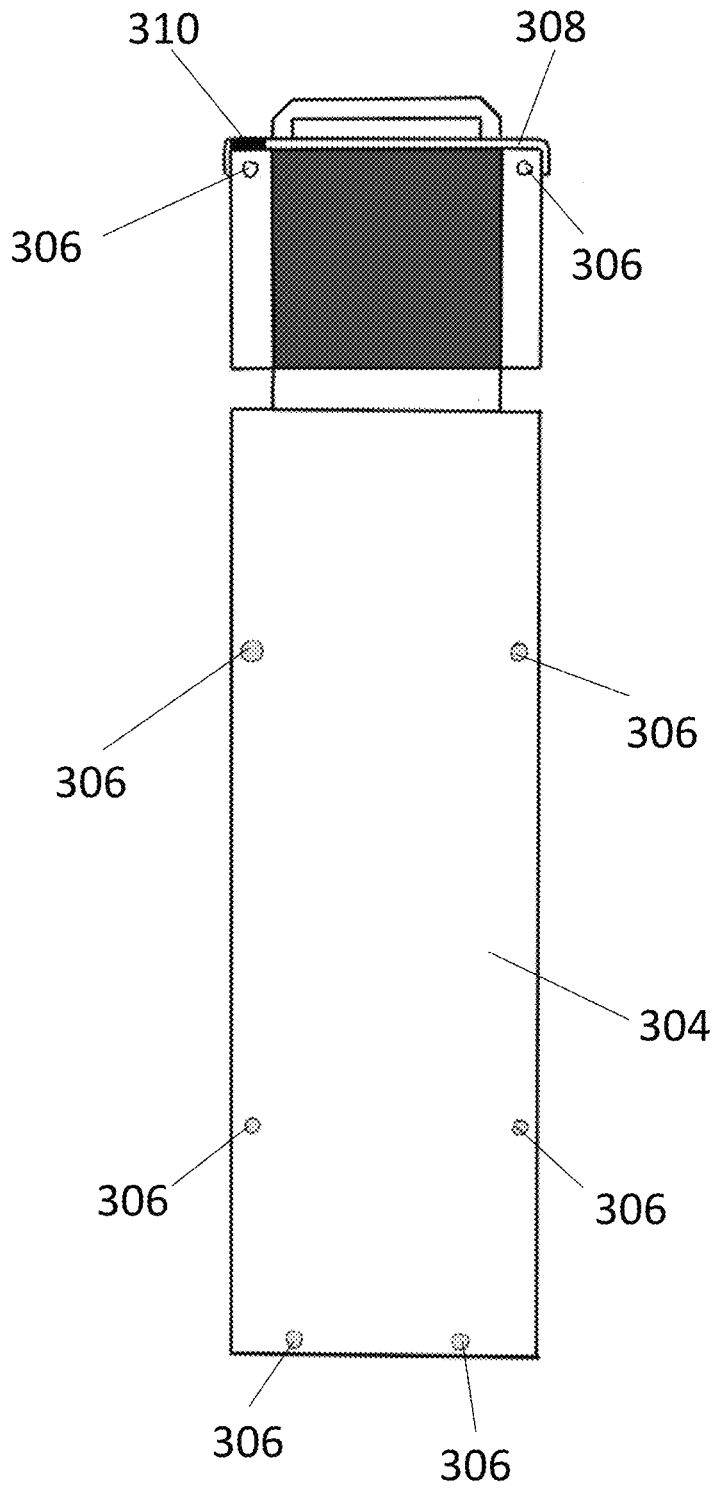
FIG. 3H illustrates a top perspective view of a cover for a collapsed seat system according to another embodiment of the present invention.

FIG. 3G illustrates a top orthogonal view of a cover for a collapsed seat system in one embodiment of the present invention. The cover 304 is operable to attach to the top of the seat system via magnets 306. In addition, the cover 304 includes a strap 308 and a side release buckle 310 operable to attach to the strap 308. The cover 304 measures approximately 49 inches in length. The cover is operable to fold over the collapsed seat system, measuring approximately 24 inches in length and 10.5 inches in height, FIG. 3H illustrates a top perspective view of a cover for a collapsed seat system in one embodiment of the present invention. The cover 304 measures approximately 15.0 inches wide and 49.0 inches in length. The strap 308 is operable to connect the sides of the base via a side release buckle 310 when the seat system is in the collapsed state, maintaining the overall shape of the collapsed seat system.

Figure 3I:
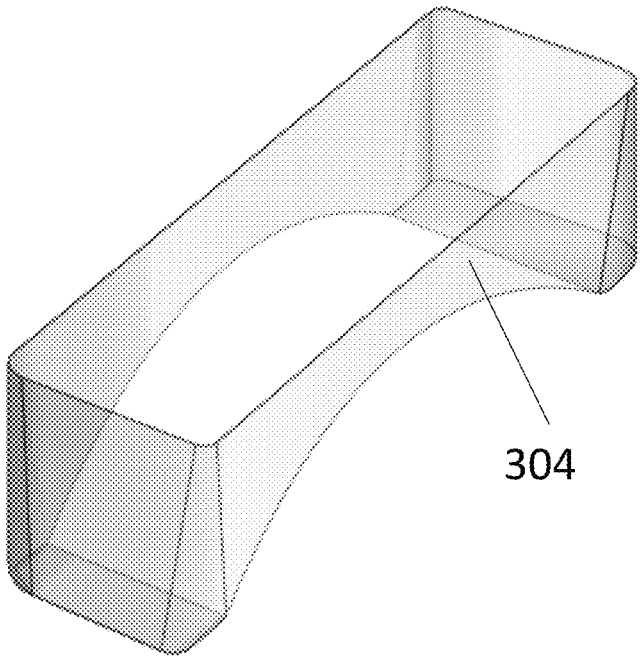
FIG. 3I illustrates a cover for the seat system in a collapsed state according to another embodiment of the present invention.

FIG. 3I illustrates a cover for the seat system in a collapsed state according to another embodiment of the present invention. The cover 304 is operable to extend over the sides of the collapsed seat system and tuck underneath the base of the seat system. This embodiment does not require the use of magnets in order for the cover 304 to connect to the base and maintain the overall shape of the collapsed seat system.

Figure 3J:
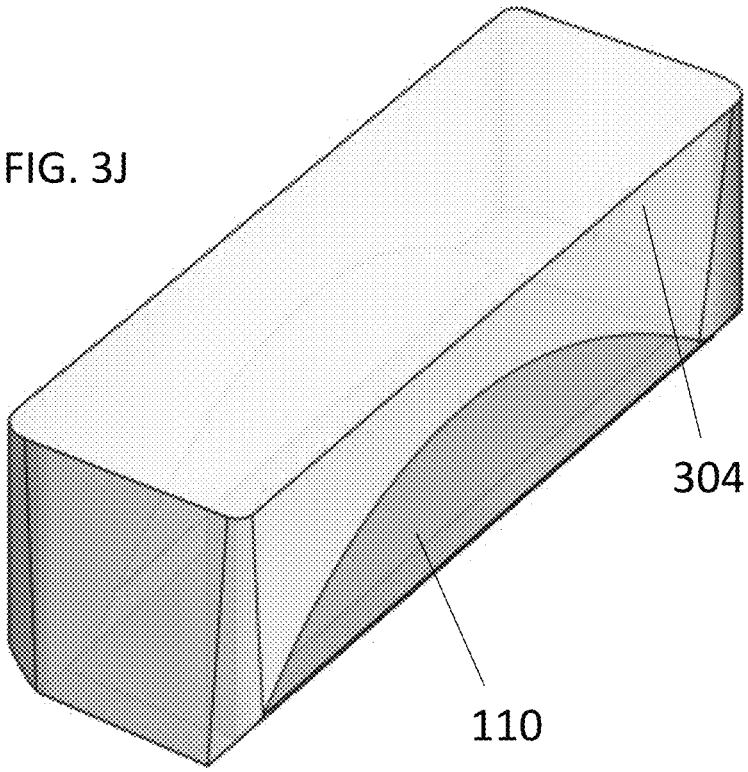
FIG. 3J illustrates a front perspective view of a collapsed seat system with a cover placed around the base of the collapsed seat system according to another embodiment of the present invention.

FIG. 3J illustrates a front perspective view of a collapsed seat system with a cover placed around the base of the collapsed seat system according to another embodiment of the present invention. The cover 304 is operable to extend over the sides of the base 110 and tuck underneath the base 110 of the seat system, thereby holding the components of the seat system together. This enables a user to transport the seat system without losing the seat components. In one embodiment, the cover does not require magnets in order to secure the seat components within the collapsed seat system.

Figure 4A:
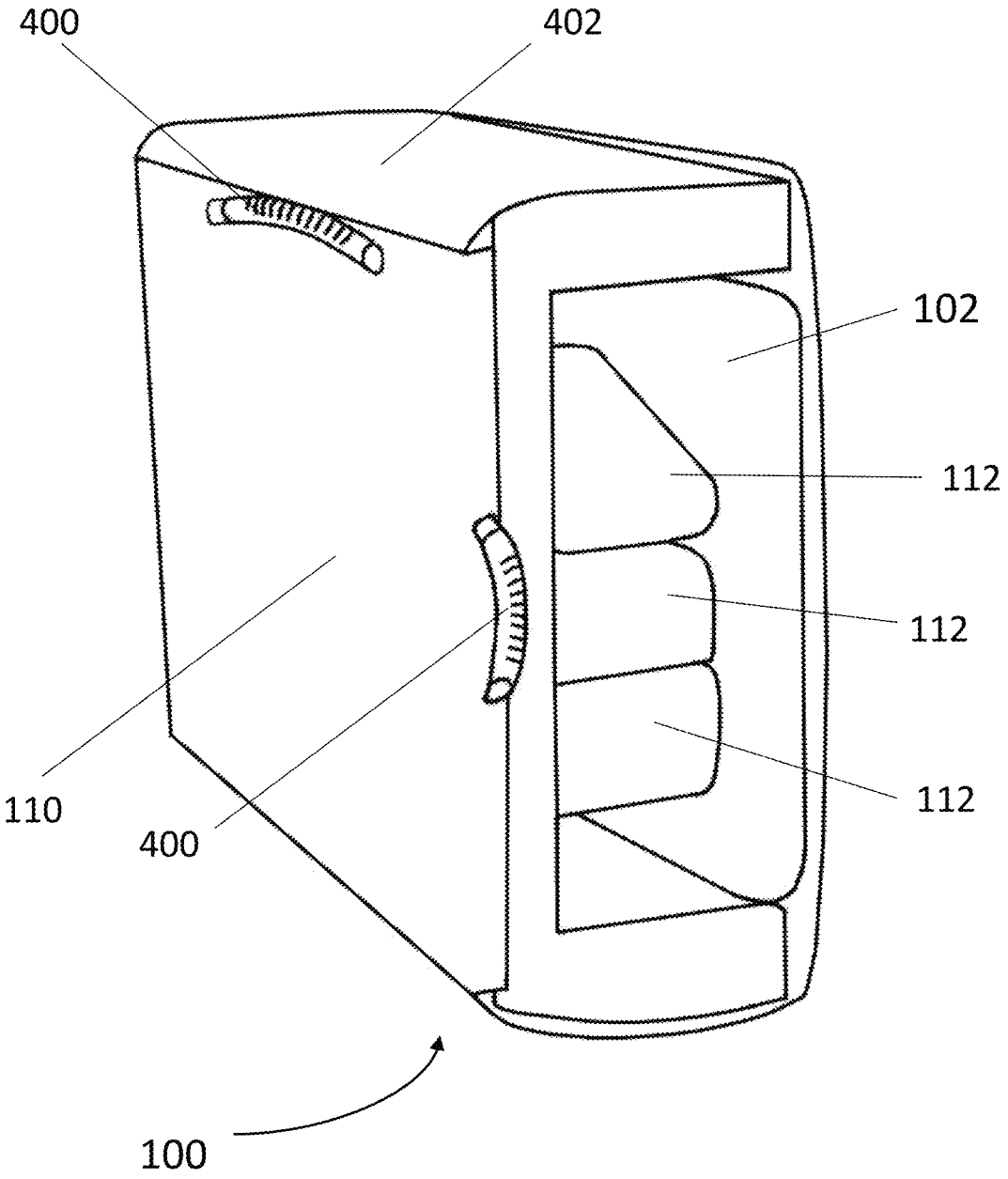
FIG. 4A illustrates a rear perspective view of the seat system in a collapsed state according to one embodiment of the present invention.

FIG. 4A illustrates a rear perspective view of the seat system in a collapsed state according to one embodiment of the present invention. The backrest 104, the base 110, the seat 102, the spine 106, the risers 108, and handles 400 are adjusted into the collapsed seat system 100. The knee blocks 112 are operable to fit between the seat 102 and the base 110. In another embodiments, the handles are cutout from the base or are integrally formed with the base. Alternatively, the handles are operable to collapse into the base when not in use or when pressure is applied to the handles.

Figure 4B:
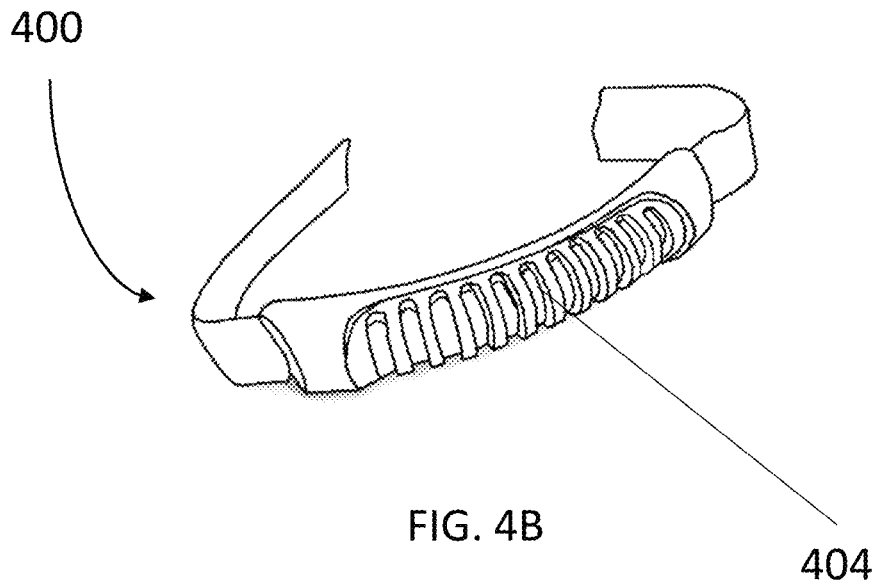
FIG. 4B illustrates a handle for the seat system in a collapsed state according to one embodiment of the present invention.

FIG. 4B illustrates a handle for the seat system in a collapsed state according to one embodiment of the present invention. In one embodiment, the handle is a nylon handle and uses a grip 404. In one embodiment, the grip is a vinyl grip. In one embodiment, the grip is a plastic grip. In another embodiment, the grip is a foam grip. In another embodiment, the grip is a thermoplastic grip. In another embodiment, the grip is a silicone grip. When the seat system is not in a collapsed state, the handle 400 remains exposed and/or is operable to tuck under the base of the seat system. In one embodiment, the handle is a strap with no grip component. In one embodiment, the handle is a plastic handle. In another embodiment, the handle is detachable from the seat system.

Figure 4C:
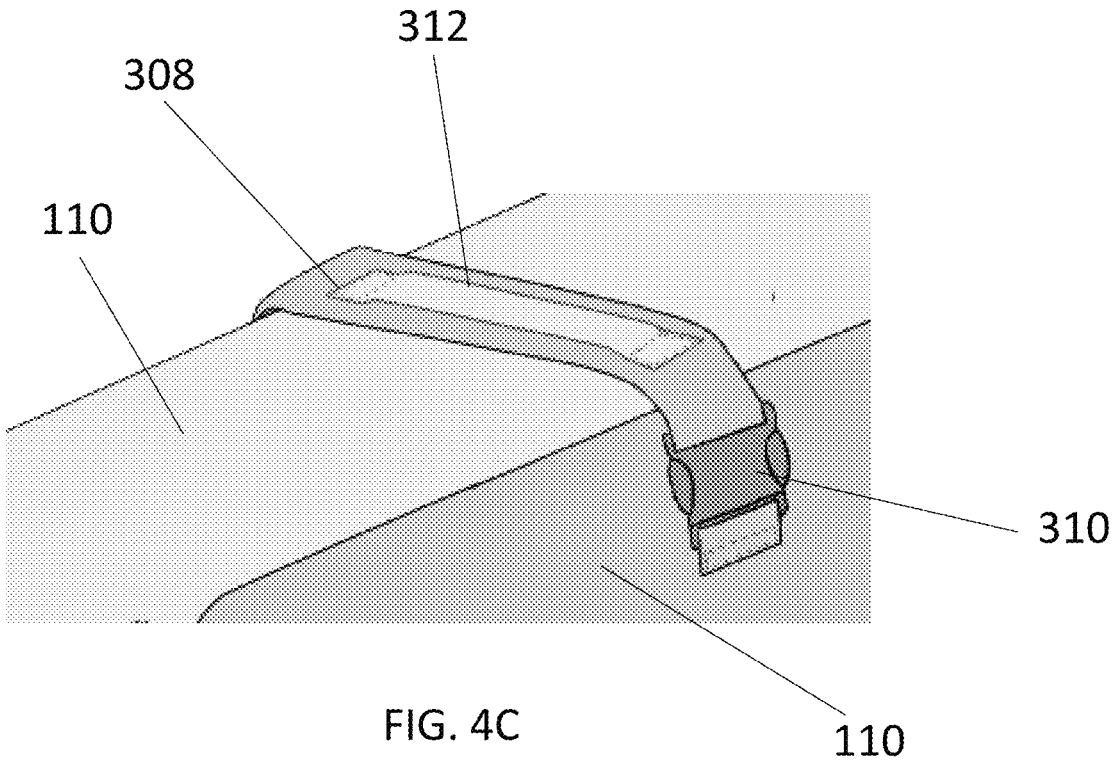
FIG. 4C illustrates a strap connecting base components for the seat system in a collapsed state according to one embodiment of the present invention.

FIG. 4C illustrates a strap connecting base components for the seat system in a collapsed state according to one embodiment of the present invention. The strap 308 connects the sides of the base 110 together using at least one side release buckle 310. In addition, the strap includes a handle 312, enabling the collapsed seat system to be easily transported. In one embodiment, the strap 308 is a nylon strap.

Figure 4D:
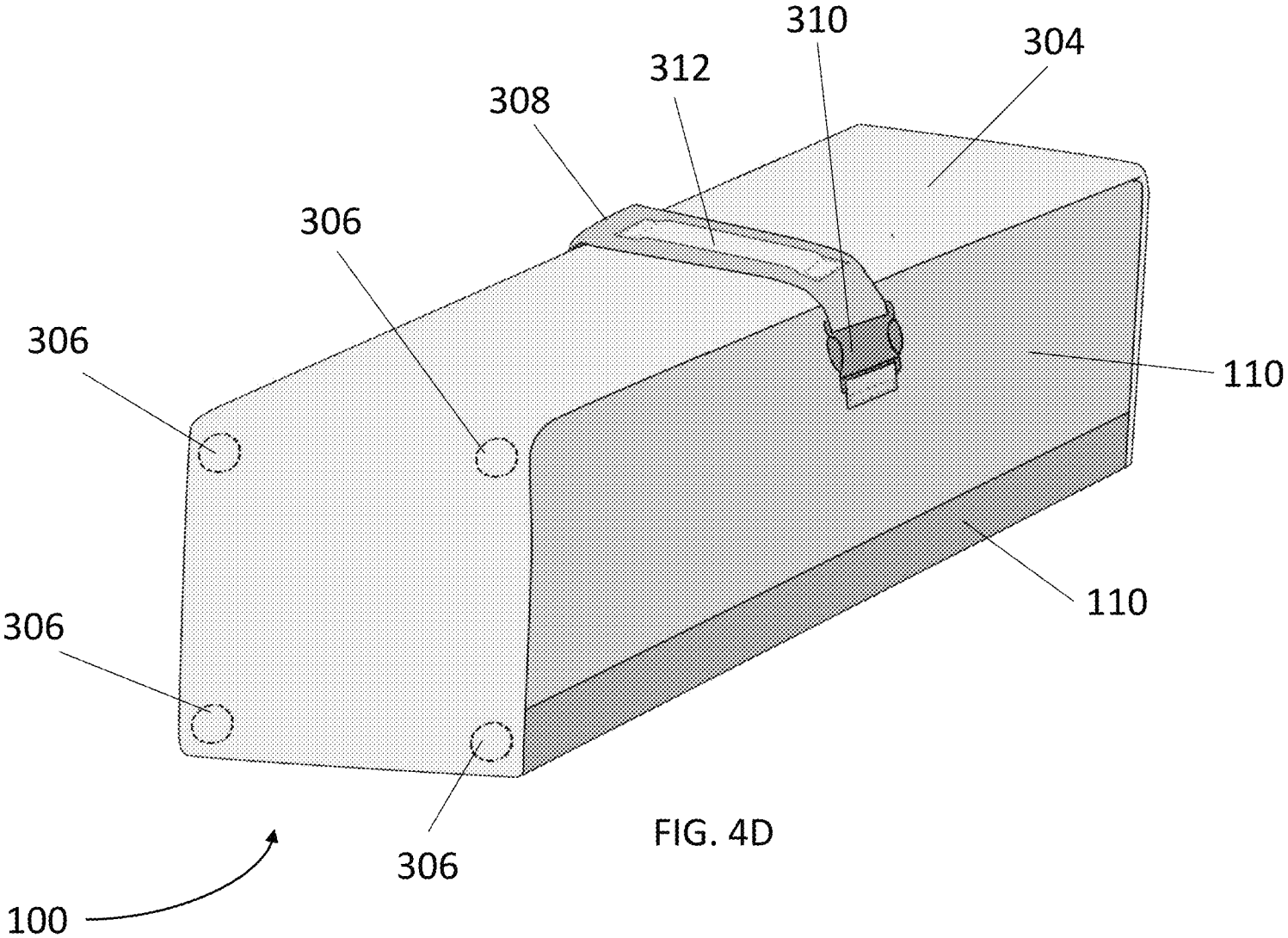
FIG. 4D illustrates a cover for the seat system and a handle connecting base components for the seat system in a collapsed state according to one embodiment of the present invention.

FIG. 4D illustrates a cover for the seat system and a handle connecting base components for the seat system in a collapsed state according to one embodiment of the present invention. A cover 304 connects to the seat system 100 via magnets 306. The cover 304 is further held in place by a strap 308, connecting the two sides of the base 110 to one another when the seat system is in the collapsed state. The strap 308 holds the base 110 components together using a side release buckle 310. In addition, the strap 308 includes a handle 312.

Figure 4E:
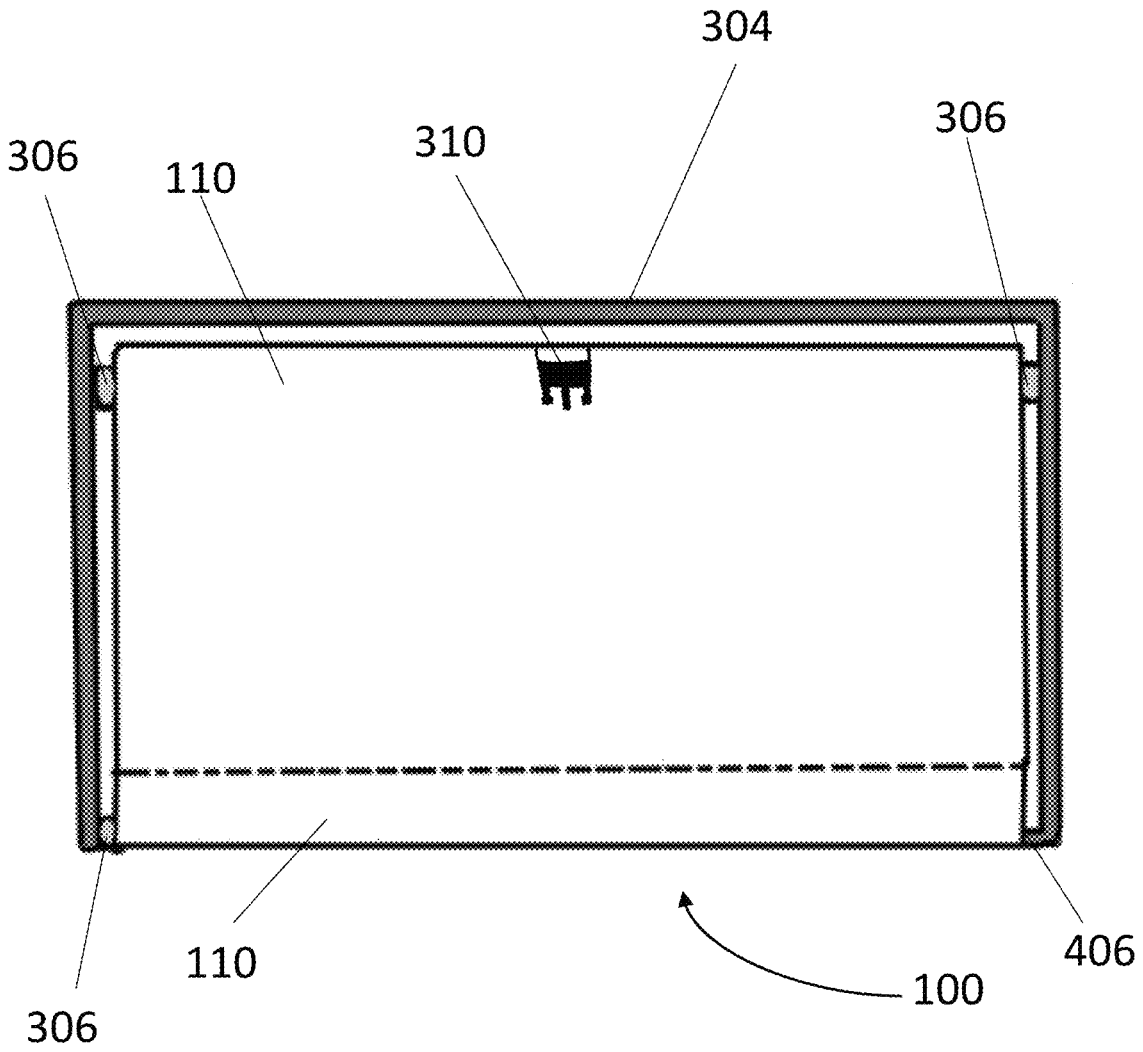
FIG. 4E illustrates a side view of a cover over the seat system in a collapsed state according to one embodiment of the present invention.

FIG. 4E illustrates a side view of a cover over the seat system in a collapsed state according to one embodiment of the present invention. In one embodiment, the cover 304 includes a fold placed approximately 2.0 inches above the base of the collapsed seat system. This fold is the location in which the sides of the base fold upwards. One end of the cover 304 connects to the base 110 via an attachment point 406. In one embodiment, the attachment point is sewn to the base 110, connecting the base 110 and the cover 304.

Figure 5:
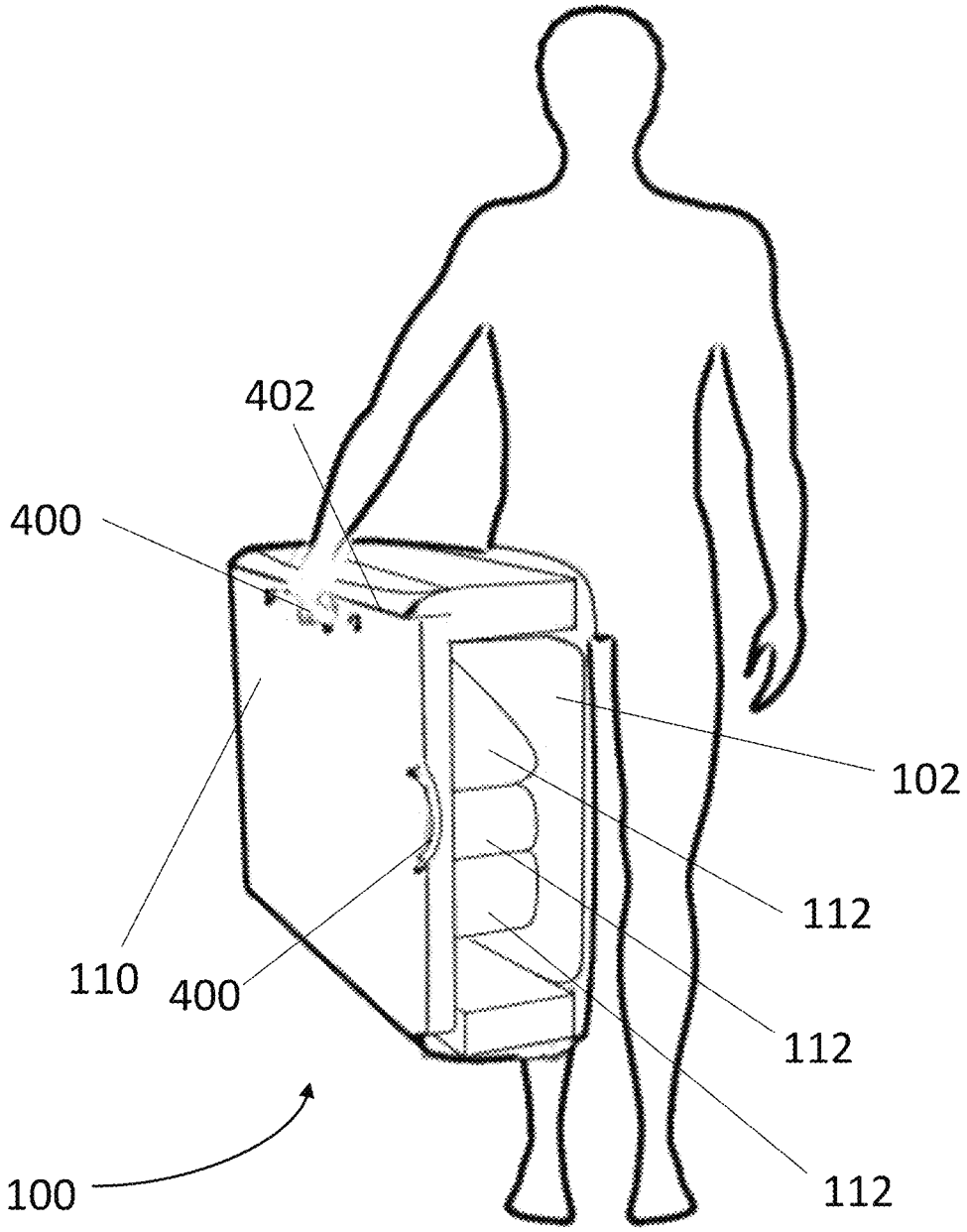
FIG. 5 illustrates a rear perspective view of the seat system in a collapsed state being carried by a user according to one embodiment of the present invention.

FIG. 5 illustrates a rear perspective view of the seat system in a collapsed state being carried by a user according to one embodiment of the present invention. Using one of the handles 400, the seat system 100 in the collapsed state is operable for transportation by the user. Knee blocks 112 are operable to be positioned between the seat 102 and the base 110 of the seat system when the seat system is in the collapsed state.

Figure 6A:
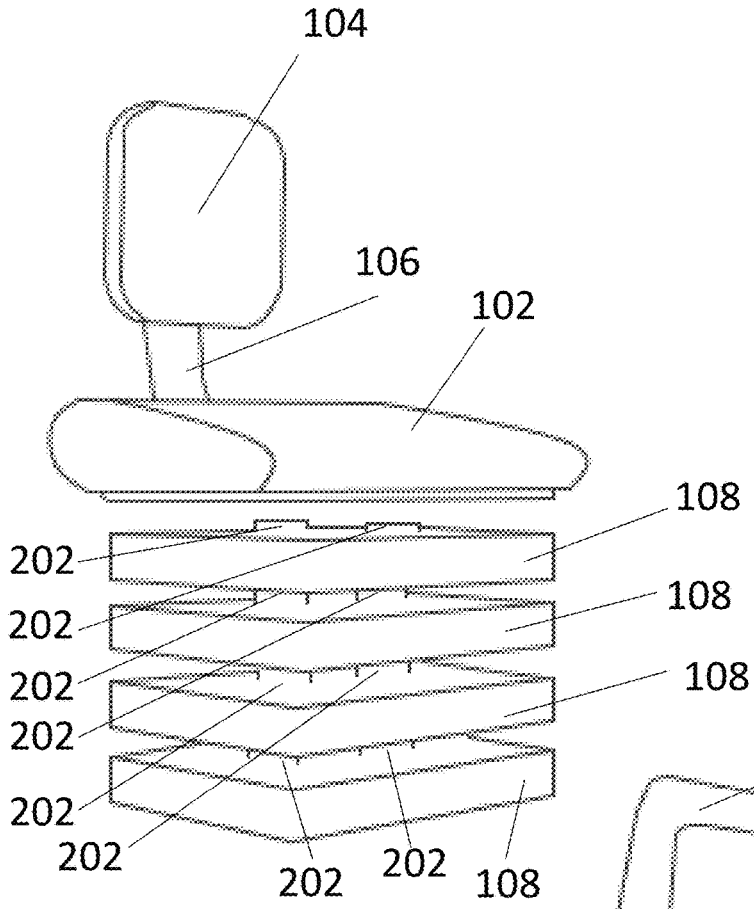
FIG. 6A illustrates a front perspective exploded view of the seat and magnetic risers according to one embodiment of the present invention.

FIG. 6A illustrates a front perspective exploded view of the seat and magnetic risers according to one embodiment of the present invention. The back rest 104 is at a 90-degree angle in relation to the seat 102. Risers 108 are stacked on top of one another according to a user's desired seat 102 height. In one embodiment, each riser 108 contains at least two magnets, enabling each riser 108 to be stacked on top of one another in a secure manner through the at least two magnets engaging indentations operable to receive the magnetic protrusions 202 such that the risers are flush when stacked together. In one embodiment each riser 108 measures approximately 11 inches by 11 inches by 1.5 inches. In one embodiment, the risers 108 are constructed using ethylene-vinyl acetate (EVA) C shore 38 foam. In another embodiment, the risers 108 are constructed using other types of materials including, but not limited to, other closed cell foams, thermoplastic elastomer (TPE) foam, recycled EVA foam, and/or a high-density upholstery foam.

Figure 6B:
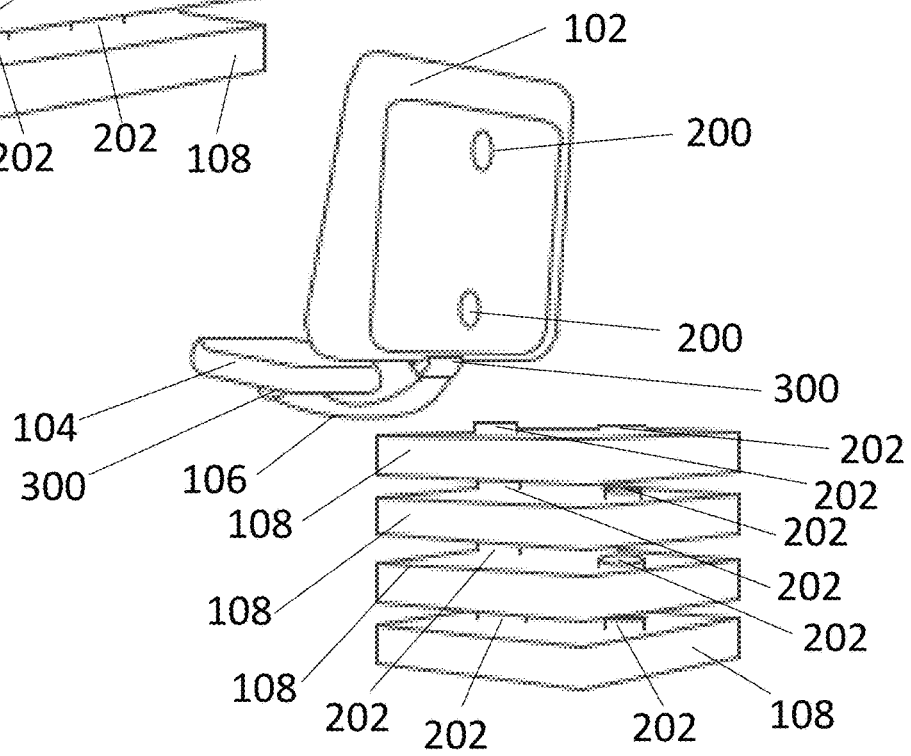
FIG. 6B illustrates a back perspective exploded view of the bottom of the seat and magnetic risers according to one embodiment of the present invention.

FIG. 6B illustrates a back perspective exploded view of the bottom of the seat and magnetic risers according to one embodiment of the present invention. The back rest 104 is at a 90-degree angle in relation to the seat 102. The bottom of the seat contains indentions 200 operable to fit magnetic protrusions 202 of the magnetic risers. The magnetic risers fit together with magnets for height adjustability. In addition, the seat 102 is operable to fit into place on top of the risers through magnetic attachment via the magnetic protrusions 202 of the top riser to the indentations 200 in the bottom of the seat.

Figure 7A:
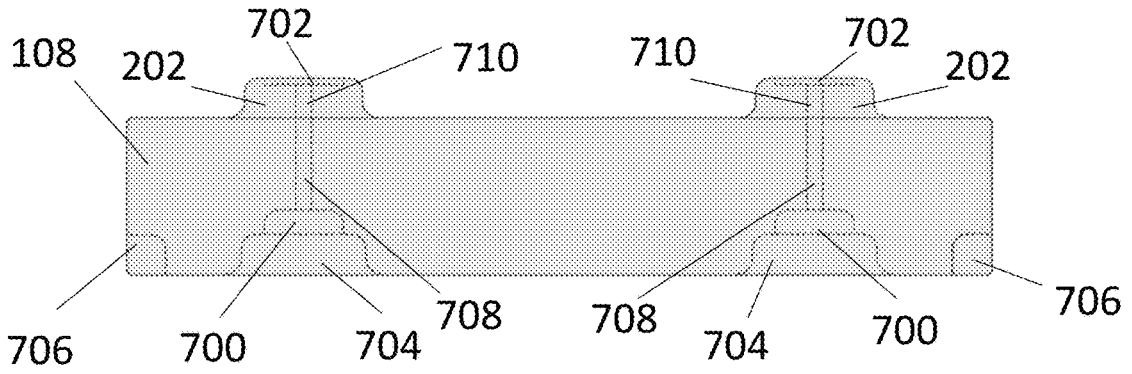
FIG. 7A illustrates a side transparent orthogonal view of a riser plate according to one embodiment of the present invention.

FIG. 7A illustrates a side transparent orthogonal view of a riser plate according to one embodiment of the present invention. Each riser plate 108 includes at least two striker plates 702 and at least two indentations 704 operable to receive the magnetic protrusions 202. A magnet 700 is positioned immediately above each indentation 704 operable to receive the magnetic protrusions 202. The bottom of the magnets 700 sit approximately 0.5 inches from the base of the riser plate 108 and the top of the magnets sit approximately 0.7 inches from the top of the riser plate 108 and approximately 1.5 inches from the top of the magnetic protrusions 202. With the magnetic protrusions 202, the total height of each riser plate 108 is approximately 2.0 inches. Without the magnetic protrusions 202, each riser plate 108 measures approximately 1.5 inches in height. The diameter of the magnetic protrusions 202 extending from each riser plate 108 measure approximately 2.0 inches, with approximately 0.1875-inch radius corners. The diameter of the indentations measures approximately 2.12 inches. The magnets 700 are approximately 0.3 inches in height. In one embodiment, each striker plate 702 is constructed of ferrous steel with a countersunk chamfered through hole, where the countersink sits below the outer layer of the riser plate at a 90-degree angle. In one embodiment, the at least two magnets are N48-grade magnets. In one embodiment, the at least two magnets are neodymium magnets. In another embodiment, the at least two magnets are bonded magnets. In another embodiment, the at least two magnets are ferrite magnets In yet another embodiment, the riser plates do not include magnets and instead are operable to click together using the protrusions. In addition, each riser plate 108 contains at least two grip indentations 706, enabling users to easily detach riser plates 108 from one another and/or the seat system. The at least two grip indentations 706 measure approximately 3.5 inches by 0.5 inches by 0.5 inches. In addition, each riser plate 108 contains at least two screw components 708 and at least two screw receiver components 710, operable to hold the magnets 700 in place.

In one embodiment, the riser plate contains a core cutout located on the bottom of the riser plate. The core cutout is a cutout extending from the bottom of the riser plate inward, towards the center of the riser plate. The core cutout does not extend to the top of the riser plate or to the exact edge of each of the riser plate's sides, but stops the inward extension at the center of the riser plate. Advantageously, this reduces the overall weight of the seat system, increasing the seat system's portability and structural integrity.

Figure 7B:
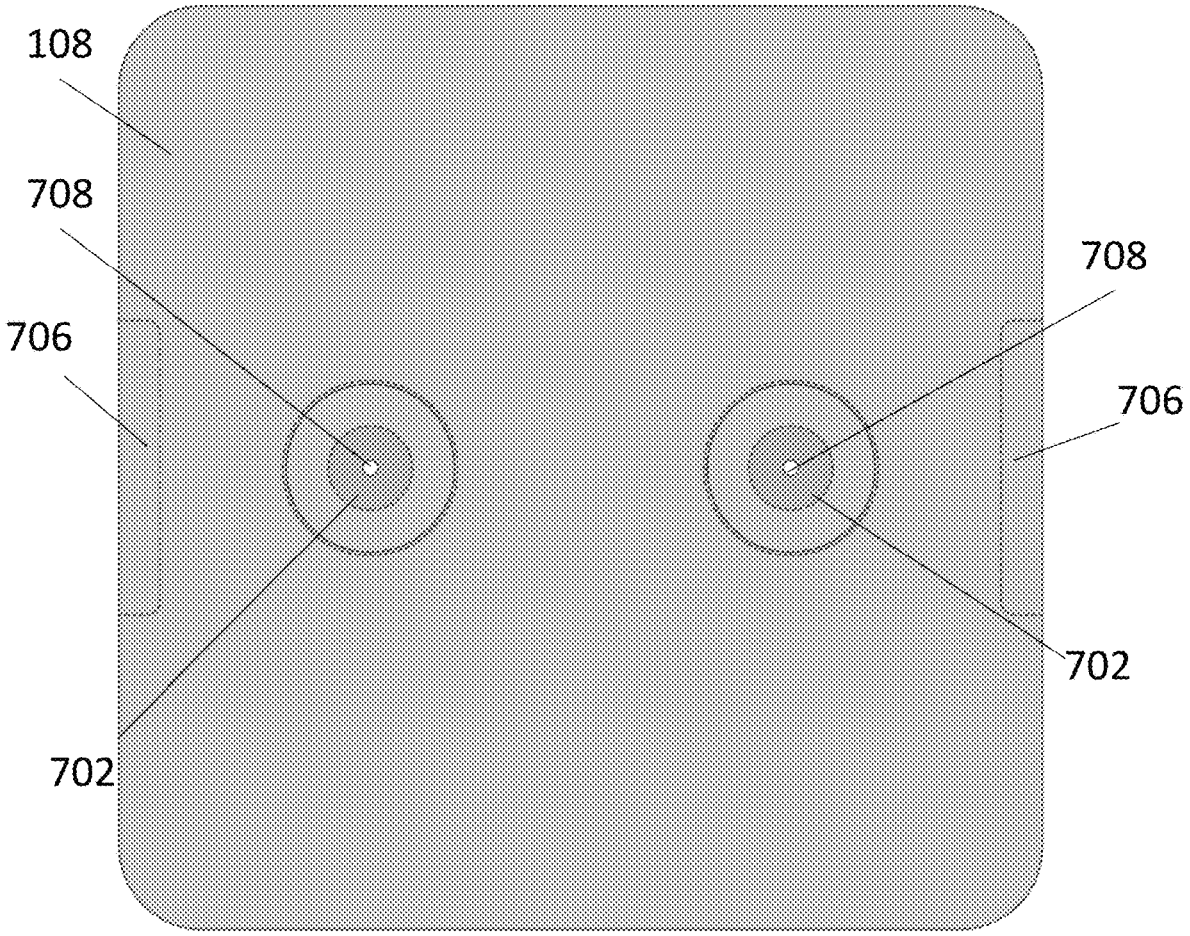
FIG. 7B illustrates a top orthogonal view of the riser plate according to one embodiment of the present invention.

FIG. 7B illustrates a top orthogonal view of the riser plate according to one embodiment of the present invention. Each of the at least two striker plates 702 contain one thru hole 708, located at the center of each striker plate. The thru holes measure approximately 0.20 inches in diameter. In one embodiment, the riser plate measures 11.0 inches by 11.0 inches. The at least two grip indentations 706 are positioned on opposite sides of the riser plate 108 from one another.

FIG. 7C illustrates a top orthogonal view of a riser plate with cutouts according to another embodiment of the present invention. The riser plate includes two magnetic protrusions 202 and each magnetic protrusion 202 includes one thru hole 708, located at the center of each magnetic protrusion 202. The thru holes 708 measure approximately 0.20 inches in diameter. In addition, each thru hole 708 is approximately 5.5 inches inward from the furthest two sides of the riser plate 108. Each rounded corner of the riser plate 108 has an approximate radius of 1.0 inches. Cutouts 710 are placed approximately 1.5 inches inward from the edge of the riser plate 108. Each riser plate 108 measures approximately 11.0 by 11.0 inches.

FIG. 7D illustrates a top orthogonal view of the riser plate with indentations according to another embodiment of the present invention. The riser plate 108 includes two magnetic protrusions 202. Each of the two magnetic protrusions contains one thru hole 708, located at the center of each magnetic protrusion 202. Cutouts 710 are positioned approximately 1.5 inches away from the edges of the riser plate 108. In addition, each cutout 710 is spaced approximately 0.5 inches away from the other cutouts 710.

Figure 7E:
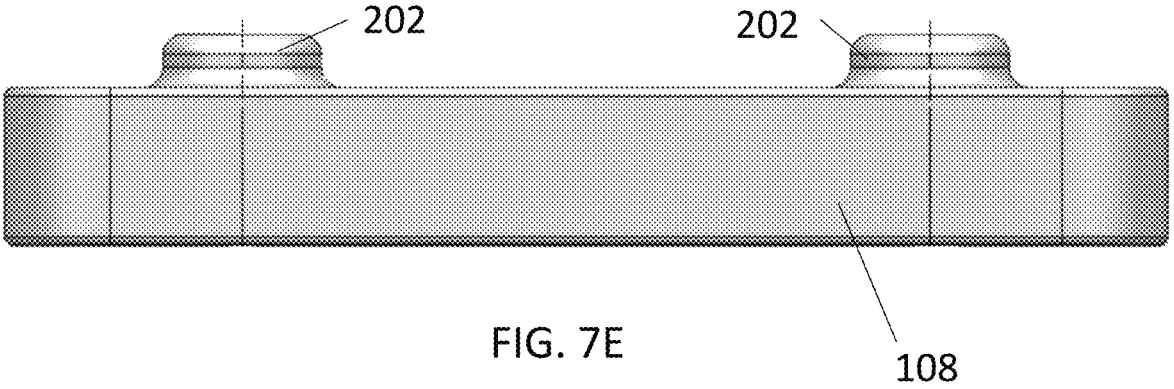
FIG. 7E illustrates a side orthogonal view of the riser plate with indentations according to another embodiment of the present invention.

FIG. 7E illustrates a side orthogonal view of the riser plate with indentations according to another embodiment of the present invention. Each corner of the riser plate 108 has a radius of approximately 0.085 inches. The riser plate 108 includes two magnetic protrusions 202. The two magnetic protrusions 202 measure approximately 0.5 inches in height and have an edge radius of approximately 0.1875 inches. The center of each of the two magnetic protrusions 202 are spaced approximately 6.5 inches apart from one another. In one embodiment, the riser plate does not use magnets for the protrusions.

Figure 7F:
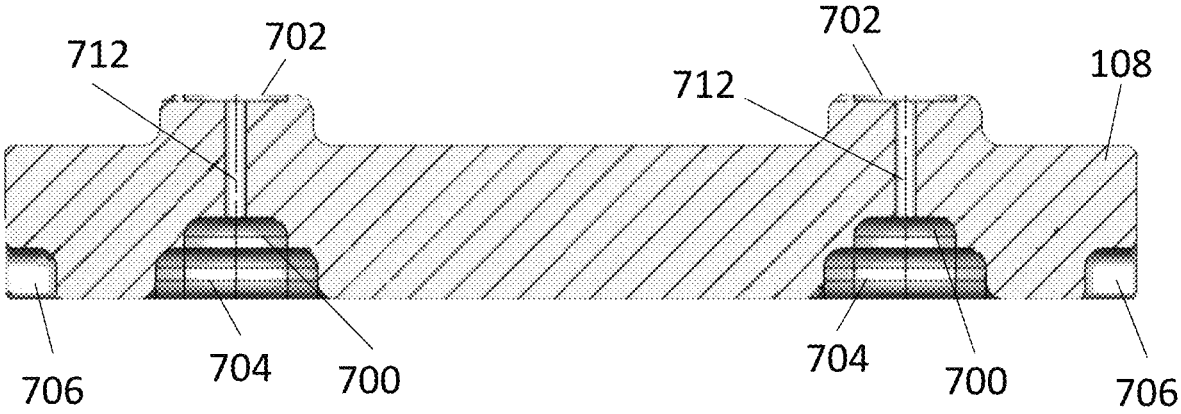
FIG. 7F illustrates another side orthogonal view of the riser plate with indentations according to another embodiment of the present invention.

FIG. 7F illustrates another side orthogonal view of the riser plate with indentations according to another embodiment of the present invention. The riser plate 108 includes at least two striker plates 702. The striker plates 702 have a diameter of approximately 1.0 inches and measure approximately 0.07 inches in height. Each of the at least two striker plates 702 contains a thru hole that measures approximately 0.2 inches in diameter. The at least two striker plates 702 are held in place via a glue 712. In addition, the glue secures the magnets 700 above the indentations 704. The magnets 700 measure approximately 1.0 inches by 0.3 inches, and are placed 0.5 inches inward from the base of the riser plate 108. The indentations 704 measure approximately 1.58 inches by approximately 0.5 inches. The rise plate 108 also includes two grip indentations 706, on opposite sides from one another. The grip indentations 706 have an inner edge radius of approximately 0.1875 inches and an outer edge radius of approximately 0.085 inches. The grip indentations 706 extend into the riser plate 108 approximately 0.5 inches by approximately 0.5 inches. In one embodiment, the riser plates 108 are operable to click together, without the need for protrusions, indentations, striker plates, magnets, screws, and/or glue.

Figure 7G:
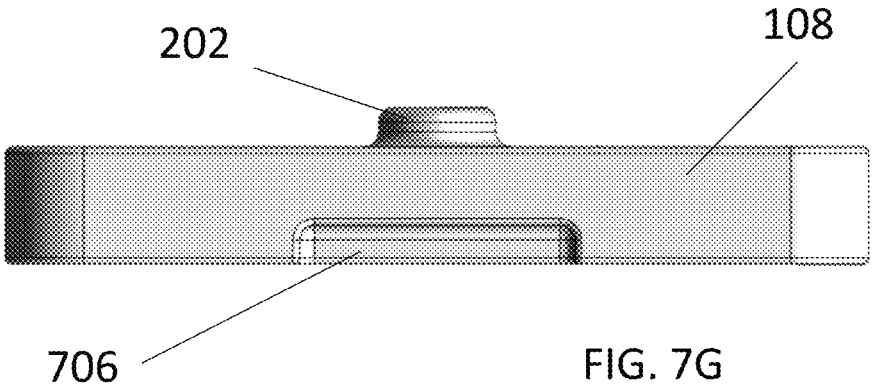
FIG. 7G illustrates another side orthogonal view of the riser plate with indentations according to another embodiment of the present invention.

FIG. 7G illustrates another side orthogonal view of the riser plate with indentations according to another embodiment of the present invention. The at least two grip indentations 706 enable users to attach and/or detach riser plates 108 from one another with ease. The at least two grip indentations are approximately 3.5 inches by approximately 0.5 inches. Each riser plate includes two magnetic protrusions 202. The magnetic protrusions are approximately 0.5 inches tall. The riser plate 108 measures approximately 11.0 inches by approximately 2.0 inches, including the height of the magnetic protrusions 202. Without the magnetic protrusions 202, the riser plate 108 measures approximately 11.0 inches by approximately 1.5 inches.

FIG. 7H illustrates a front perspective view of the riser plate with cutouts according to another embodiment of the present invention. The riser plate 108 includes two magnetic protrusions 202, where each magnetic protrusion 202 contains one thru hole 708 positioned in the center of each of the two magnetic protrusions 202. The riser plate 108 also includes two grip indentations 706, placed on opposite sides of the riser plate 108. Each riser plate 108 includes cutouts 710.

FIG. 7I illustrates a view of the riser plate with indentations according to another embodiment of the present invention. The indentations serve two purposes. First, the riser plates are lighter in weight while retaining sufficient structural integrity to support a user. Second, the indentations provide a unique modern and stylized design. The indentations are operable to be cut out of the riser plate in one embodiment. Alternatively, the riser plate is formed or molded with the indentations.

Figure 7J:
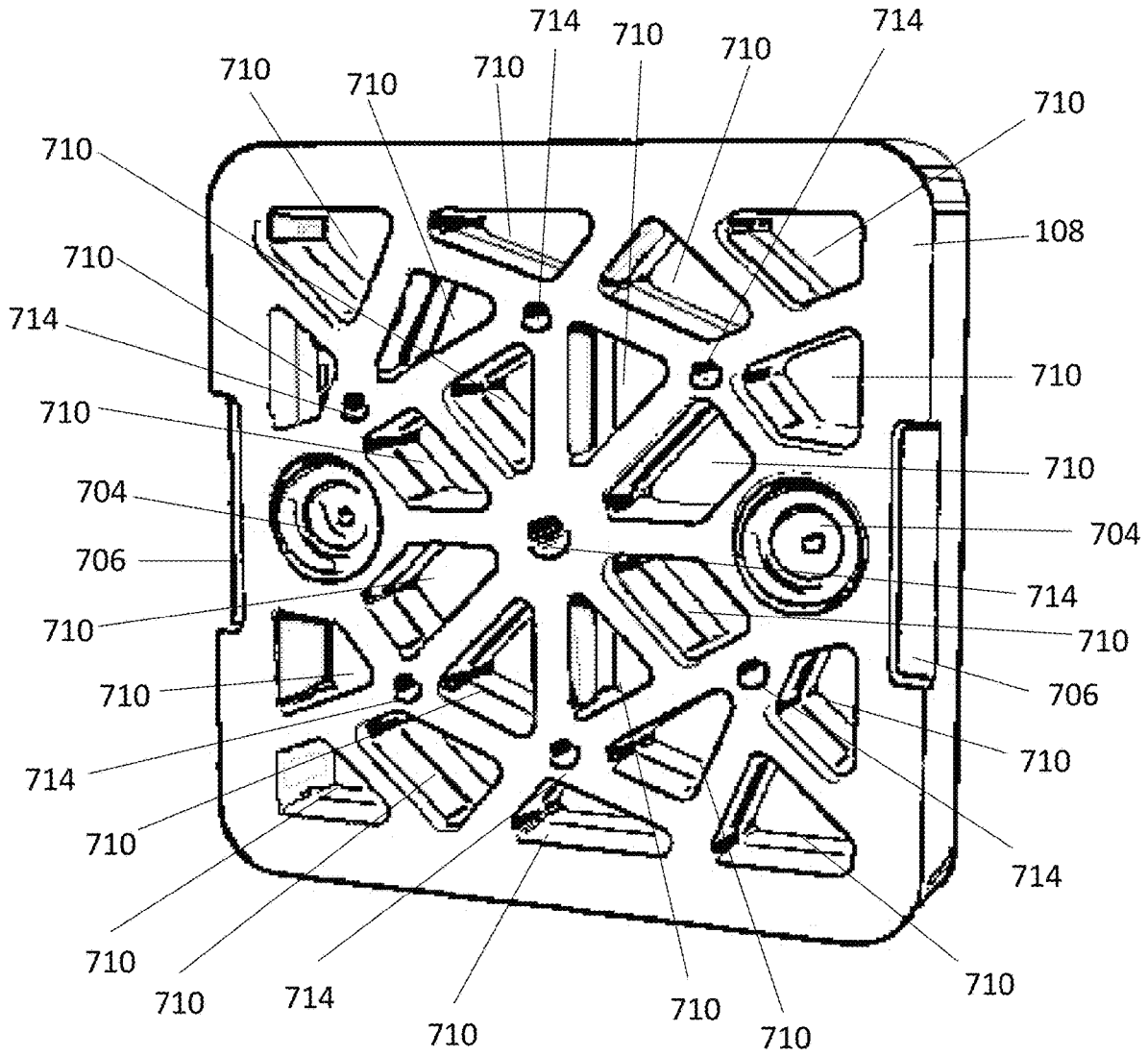
FIG. 7J illustrates a bottom view of the riser plate with indentations according to another embodiment of the present invention.

FIG. 7J illustrates a bottom view of the riser plate with indentations according to another embodiment of the present invention. The riser plate 108 includes two grip indentations 706 and two indentations 704. The indentations 704 are operable to connect with another riser plate's magnetic protrusions. In addition, the riser plate 108 includes cutouts 710, reducing the overall weight of the riser plate 108.

Figure 7K:
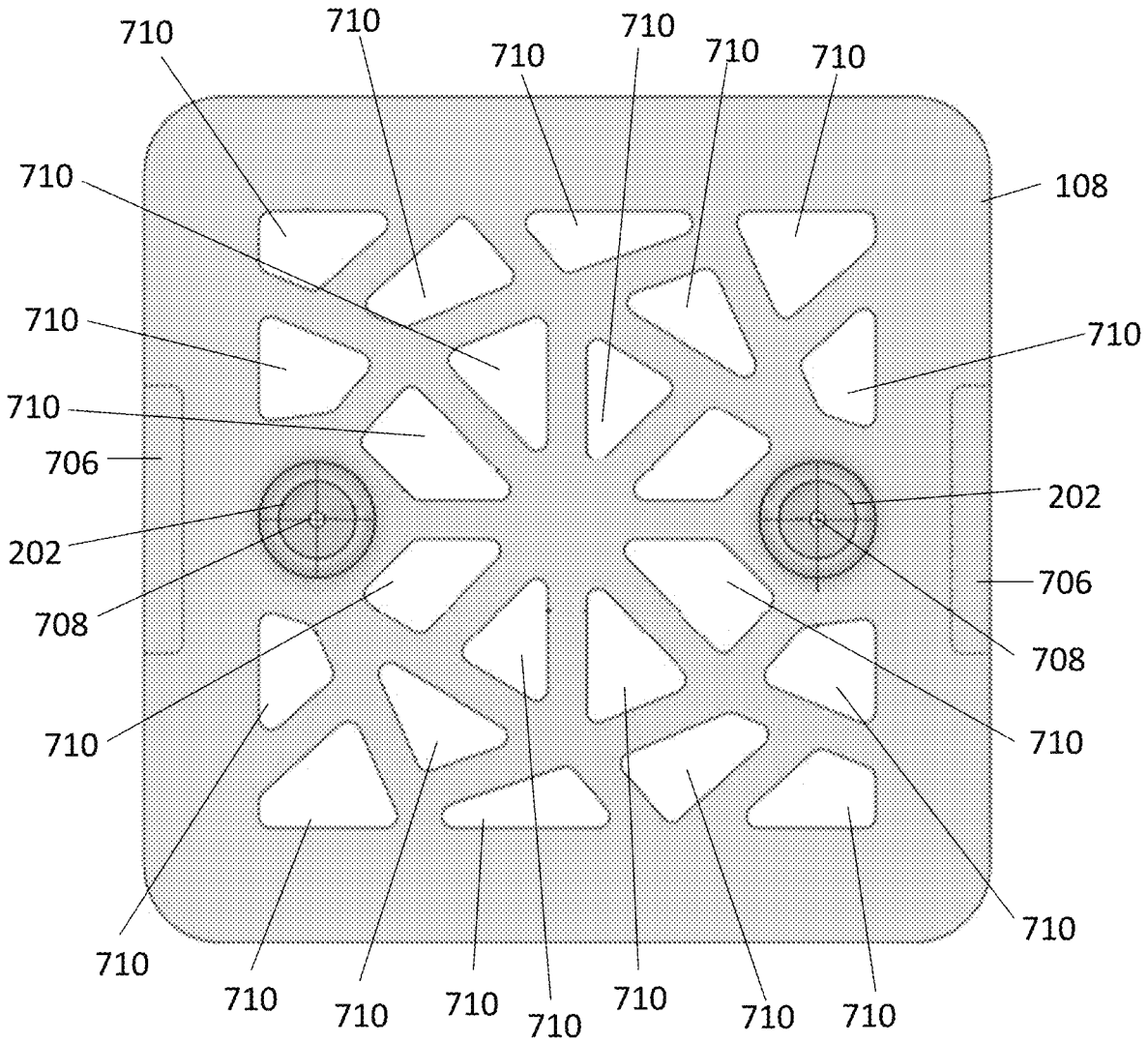
FIG. 7K illustrates a top orthogonal view of the riser plate according to another embodiment of the present invention.

FIG. 7K illustrates a top orthogonal view of the riser plate according to another embodiment of the present invention. The riser plate 108 includes two magnetic protrusions 202, where each of the two magnetic protrusions 202 contains one thru hole 708. The thru holes 708 are approximately 0.2 inches in diameter and are spaced approximately 6.5 inches apart from one another. In addition, each riser plate 108 includes two grip indentations 706. The two grip indentations measure approximately 3.5 inches in length. Each riser plate also includes cutouts 710, where the cutouts 710 are spaced approximately 1.5 inches from the edge of the riser plate. The four rounded corners of each riser plate have a radius of approximately 1.0 inches. The riser plate measures approximately 11 inches by 11 inches. In one embodiment, the riser plate 108 uses protrusions not containing magnets. Instead, these protrusions click together or connect via friction-based locking with corresponding indentations operable to receive the protrusions on another riser plate or a seat above the riser plate 108.

Figure 7L:
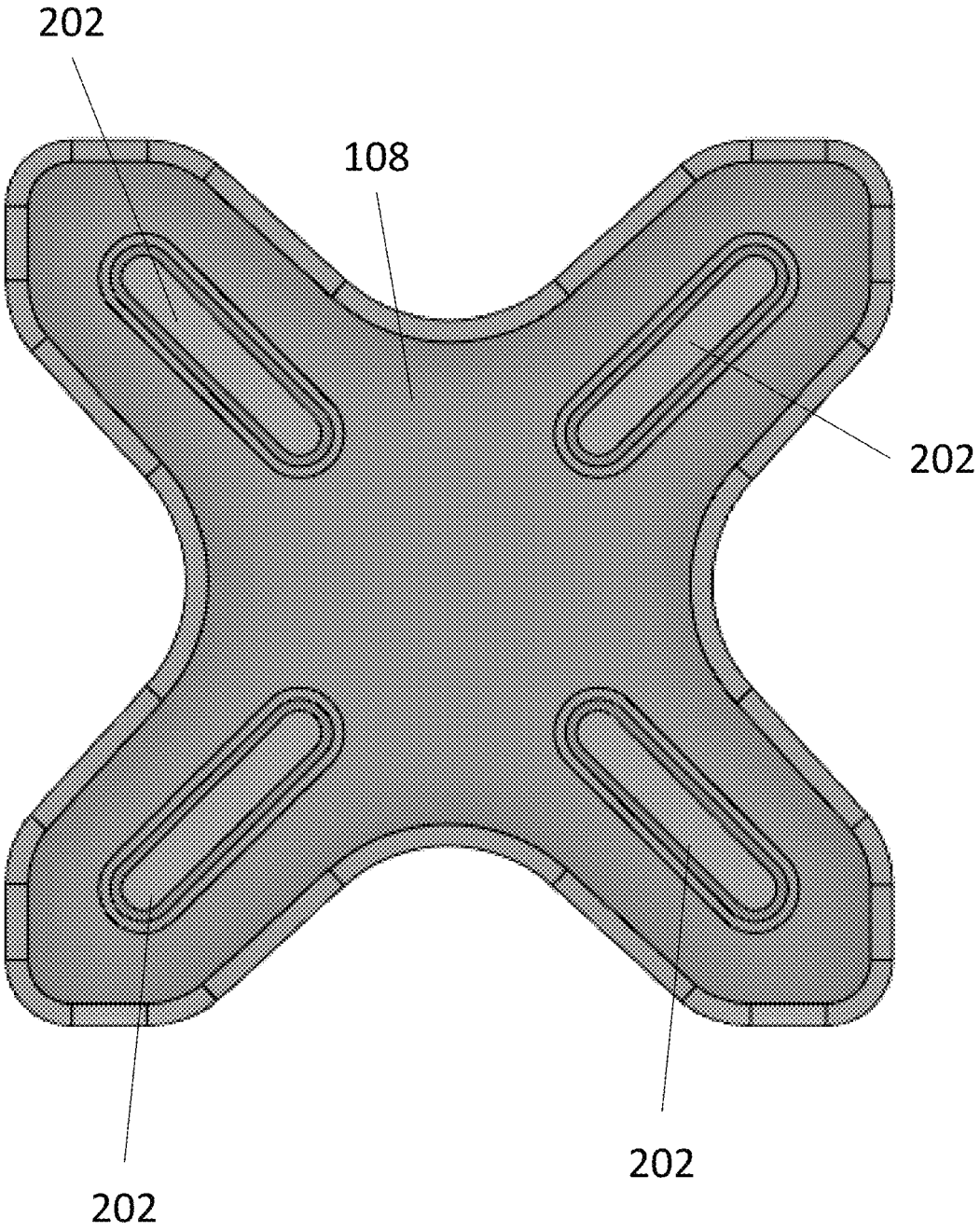
FIG. 7L illustrates a top orthogonal view of the riser plate according to yet another embodiment of the present invention.

FIG. 7L illustrates a top orthogonal view of the riser plate according to yet another embodiment of the present invention. The riser plate 108 is X-shaped, with four protrusions 202 placed near each of the four edges of the riser plate. The four outer edges of the X-shaped riser plate are rounded to a curved point. In addition, the X-shaped riser plate includes four curved inner edges in between each of the outside edges of the riser plate. Notably, the X-shaped risers provide for a heel of a user to move under the pelvis of a user so the legs of the user can be tucked closer to the body of the user. Thus, the legs of the user are not obstructed by the seat or cushion when using X-shaped risers. In one embodiment, the riser plate is circular in shape. In another embodiment, the riser plate is triangular in shape. In another embodiment, the riser plate is pentagonal in shape. In yet another embodiment, the riser plate is hexagonal in shape. In yet another embodiment, the riser plate is octagonal in shape.

Figure 7M:
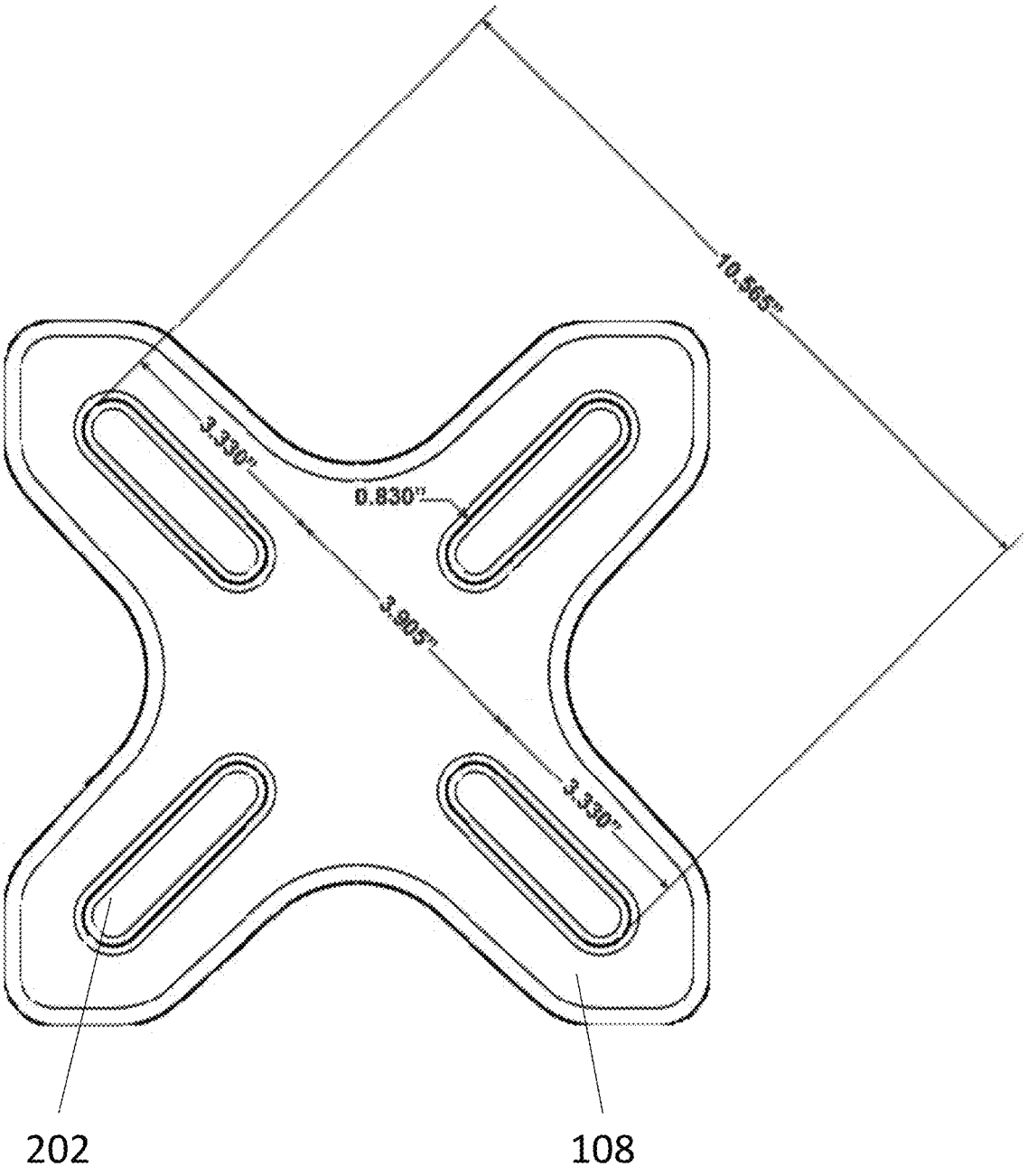
FIG. 7M illustrates a top orthogonal view of the riser plate according to yet another embodiment of the present invention.

FIG. 7M illustrates a top orthogonal view of the riser plate according to yet another embodiment of the present invention. The riser plate 108 is X-shaped and includes four protrusions 202 approximately 3.30 inches in length and approximately 0.830 inches wide. Each of the four protrusions 202 is located near one of the four edges of the X-shaped riser plate 108. Protrusions 202 that are opposite one another are spaced approximately 3.905 inches apart from one another. This distance from the far end of each protrusion 202 to the far end of the opposite protrusion measures approximately 10.565 inches. In addition, each of the four edges of the X-shaped riser plate include tapered edges at an angle of approximately −2.82 degrees.

Figure 7N:
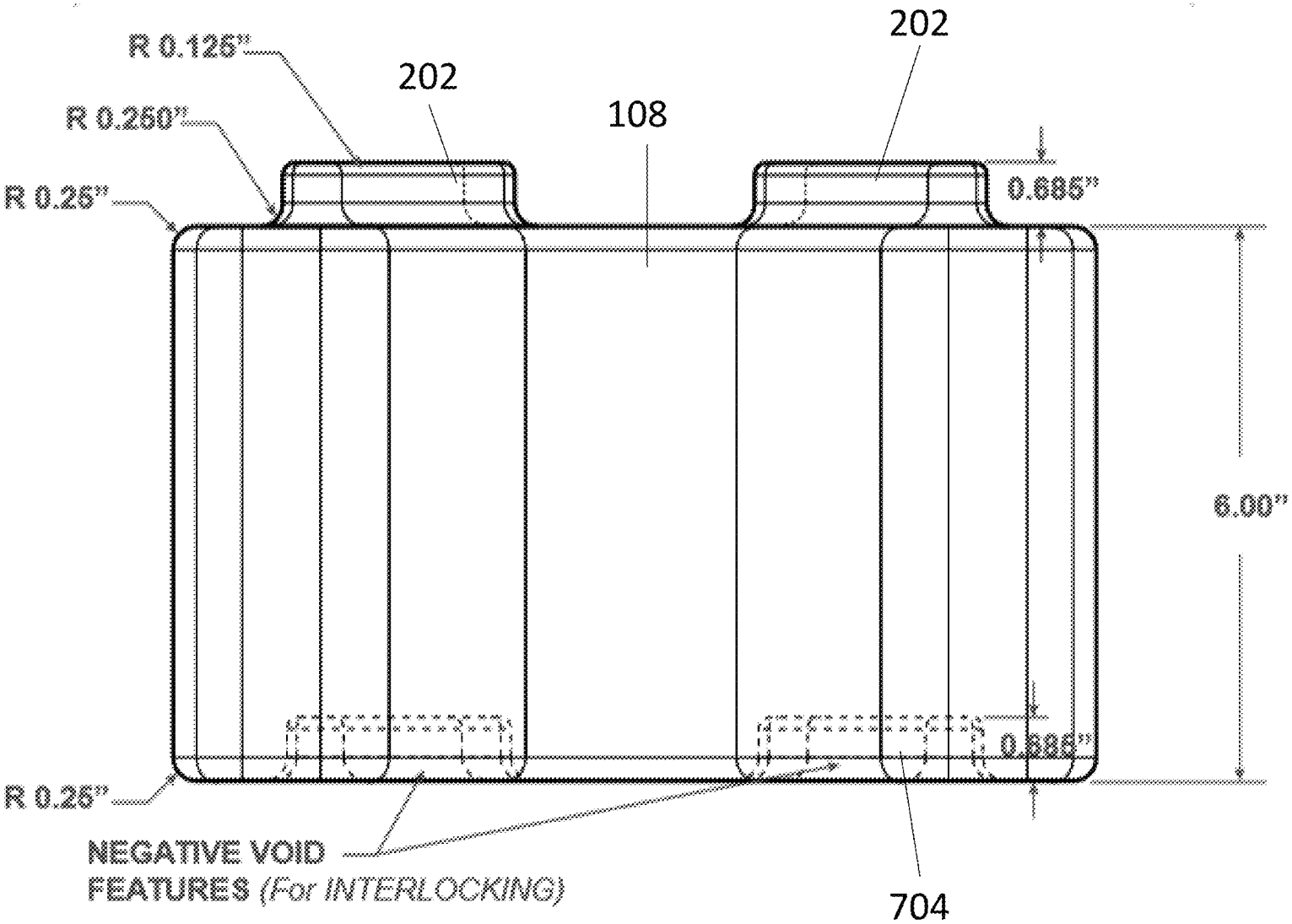
FIG. 7N illustrates a side orthogonal view of the riser plate according to another embodiment of the present invention.

FIG. 7N illustrates a side orthogonal view of the riser plate according to another embodiment of the present invention. The riser plate 108 is X-shaped, and includes four protrusions 202 and four indentations 704. Each of the four protrusions measures approximately 0.685 inches in height. In addition, each of the four protrusions has a radius of approximately 0.125 inches, where the radius at the point where each of the four protrusions meets the riser plate is approximately 0.250 inches. Moreover, the four edges of the X-shaped riser plate have a radius of approximately 0.25 inches. The four indentations 704 measure approximately 0.685 inches in height. Each of the four indentations functions as a negative void, enabling each riser plate to interlock with another riser plate, where the riser plates interlock with one another by inserting the protrusions of one riser plate into the indentations of a connecting riser plate. The riser plate is approximately 6.0 inches in height.

Figure 7O:
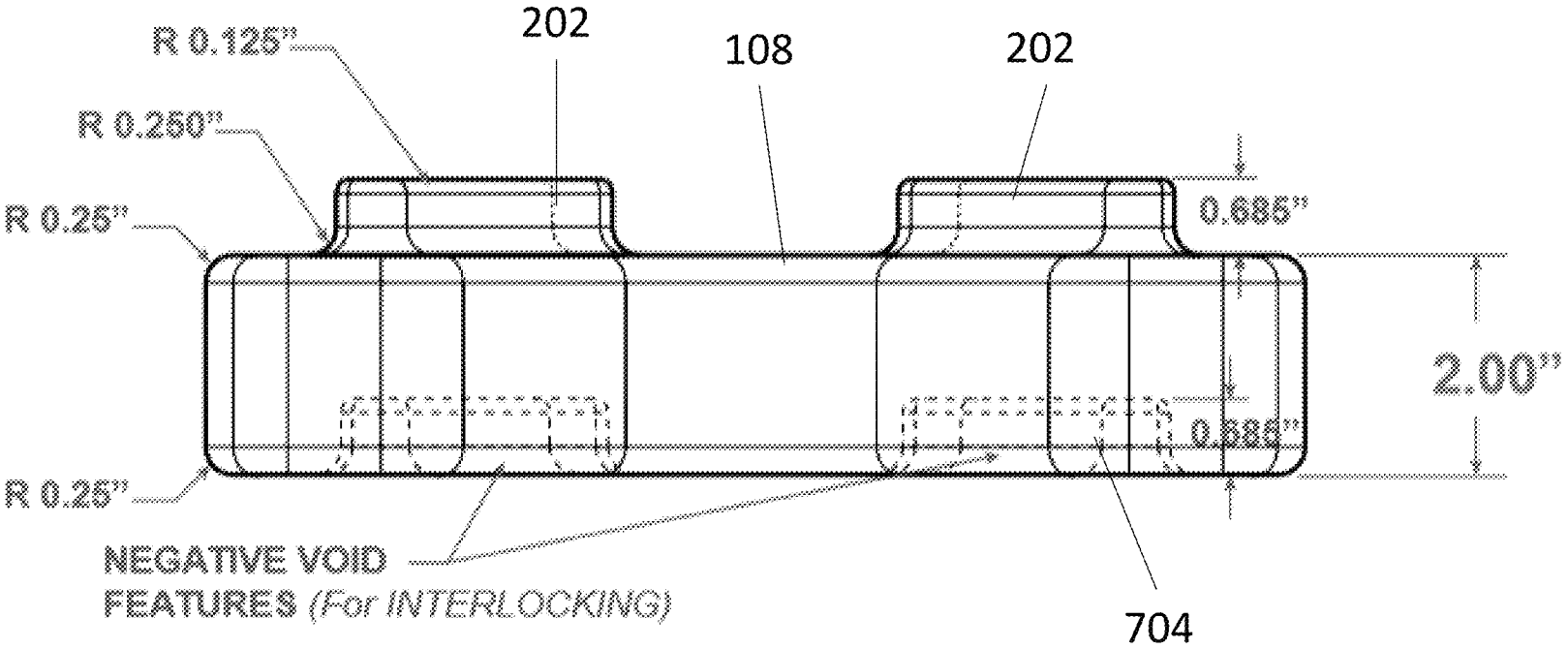
FIG. 7O illustrates a side orthogonal view of the riser plate according to yet another embodiment of the present invention.

FIG. 7O illustrates a side orthogonal view of the riser plate according to yet another embodiment of the present invention. The riser plate 108 is X-shaped, including four protrusions 202 and four indentations 704. In one embodiment, the riser plate measures approximately 2.0 inches in height.

Figure 7P:
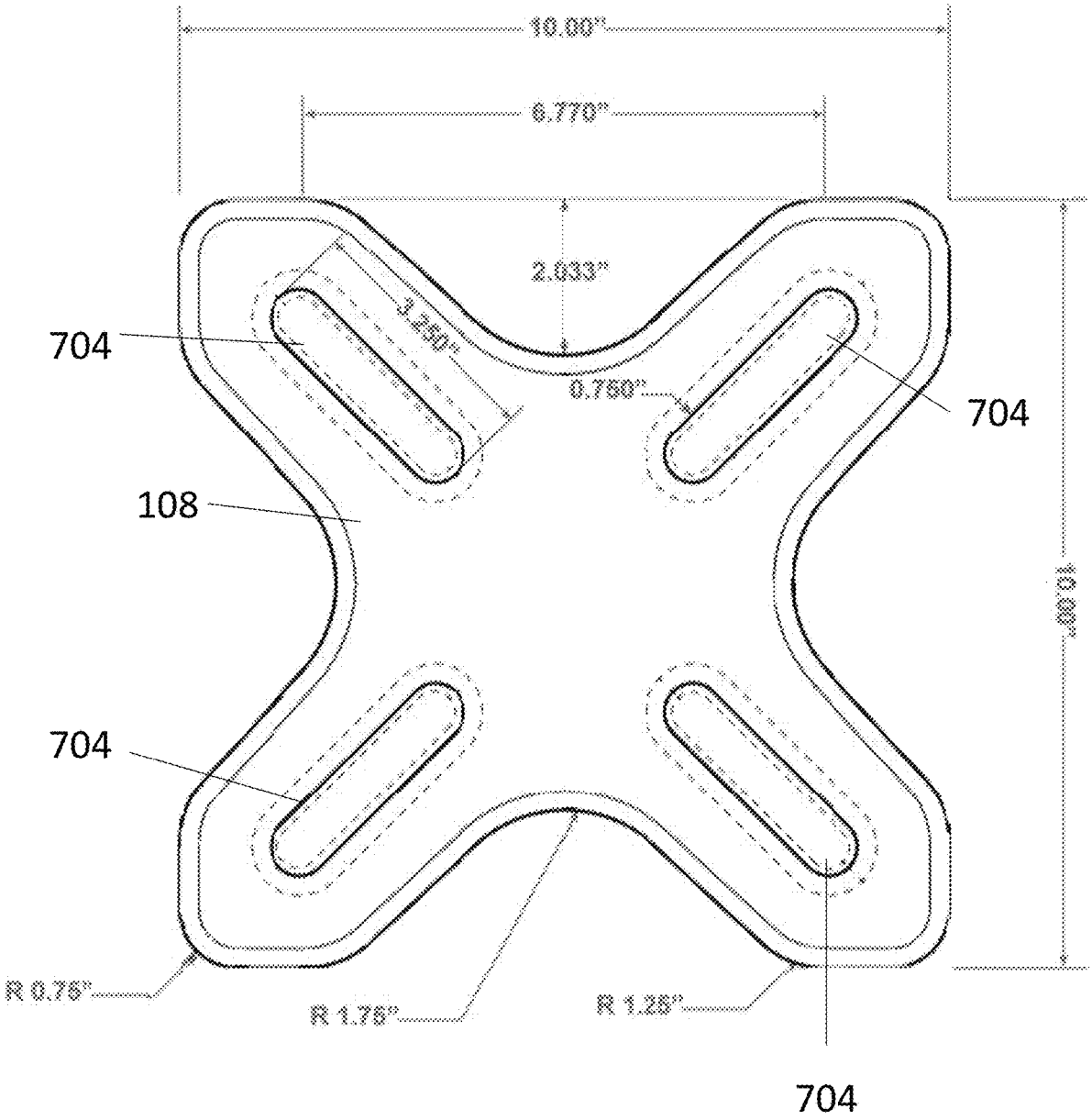
FIG. 7P illustrates a bottom orthogonal view of the riser plate according to another embodiment of the present invention.

FIG. 7P illustrates a bottom orthogonal view of the riser plate according to another embodiment of the present invention. The riser plate 108 is X-shaped, with four curved edges placed between each of the outer four edges of the riser plate, and includes four indentations 704 placed near each of the four edges of the X-shaped riser plate. The riser plate 108 measures approximately 10.0 inches in length and approximately 10.0 inches in width. Each of the four indentations 704 measures approximately 3.250 inches in length and approximately 0.750 inches in width. The top of each of the four indentations has a radius of approximately 0.75 inches. Each of the four curved portions of the riser plate has a radius measuring approximately 1.75 inches. In addition, the outer four edges of the X-shaped riser plate include a curved edge portion coming to a rounded point. This curved edge portion has a radius of approximately 1.25 inches. The outer four edges of the X-shaped riser plate extend approximately 2.033 inches outward from the curved center portions of the riser plate, where each of the outer four edges of the X-shaped riser plate begin curving towards a rounded edge approximately 6.770 inches apart from one another.

Although the riser plates illustrated each include two indentations with magnets and two magnetic protrusions operable to engage the two indentations with magnets, the risers of the present invention are also operable to each include one magnetic protrusion with a corresponding indentation and magnet or more than two indentations with magnets and corresponding magnetic protrusions. By way of example, in one embodiment, the riser plates include four magnetic protrusions and corresponding indentations with magnets positioned close to the four corners of the riser or towards the edge of each side in the center of each side of the riser. Additionally, the prior recited embodiments are operable to be non-magnetic, where the protrusions do not contain magnetic material and the corresponding indentations do not include magnets, whereby the protrusions and corresponding indentations are joined via friction-based locking or connection.

Figure 8A:
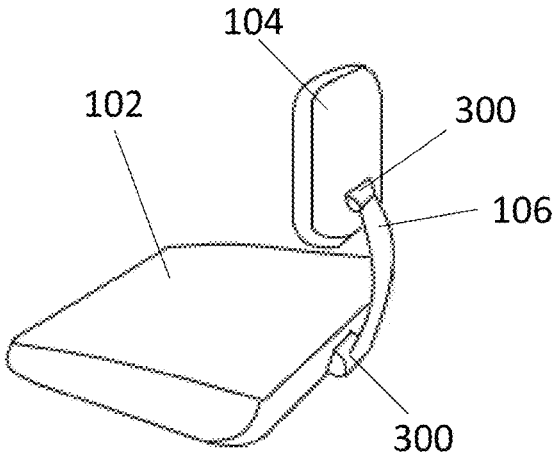
FIG. 8A illustrates a rear perspective view of the seat according to one embodiment of the present invention.
Figure 8B:
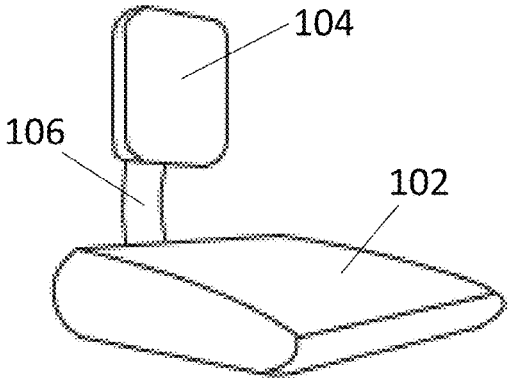
FIG. 8B illustrates a front perspective view of the seat according to one embodiment of the present invention.
Figure 8C:
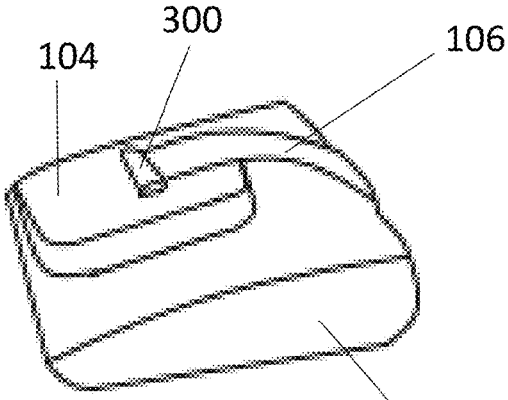
FIG. 8C illustrates a side perspective view of the seat in a collapsed state according to one embodiment of the present invention.
Figure 8D:
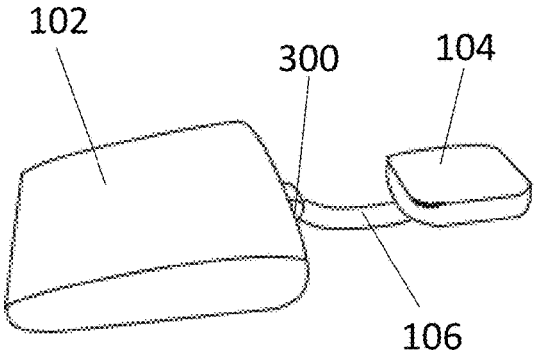
FIG. 8D illustrates a side perspective view of the seat in a fully extended state according to one embodiment of the present invention.

FIG. 8A illustrates a rear perspective view of the seat according to one embodiment of the present invention. The back rest 104 is positioned at a 90-degree angle from the seat 102. A swivel 300 connects the rear of the back rest 104 to the spine 106. A second swivel 300 connects the base of the spine 106 to the seat 102. This connection enables the seat 102 to fold down and back, up to 180 degrees, for portability and user back support preference. The ideal meditation posture is to maintain a straight back. The back rest 104 keeps the user's spine straight, at a 90-degree angle or greater. This setup assists users who find it difficult, due to back issues or other circumstances, to sit for long periods of time. The second swivel 300 connecting the base of the spine 106 to the seat 102 is operable to rotate up to 90 degrees. The back rest 104 measures approximately 16 cm by 20 cm. The distance from the first swivel 300, connecting the back rest 104 to the spine 106, to the second swivel 300, connecting the spine 106 to the seat 102, is approximately 24 cm. The seat 102 measures approximately 38 cm by 33 cm by 8 cm. FIG. 8B illustrates a front perspective view of the seat according to one embodiment of the present invention. The spine 106 connects the back rest 104 to the seat 102. FIG. 8C illustrates a side perspective view of the seat in a collapsed state according to one embodiment of the present invention. The back rest 104, connected to the seat 102 via the spine 106 and swivel 300, is operable fold approximately 90 degrees forward and approximately 90 degrees backward from the substantially vertical orientation of the back rest illustrated in FIG. 8A. Folding the back rest 104 approximately 90 degrees forward causes the seat to be in a collapsed state, thereby providing for increasing portability. FIG. 8D illustrates a side perspective view of the seat in a fully extended state according to one embodiment of the present invention. The back rest 104, connected to the seat 102, via the spine 106, a first swivel 300, and a second swivel 300, is operable to fold to an approximately 180-degree angle backwards, and forwards, relative to the seat 102. Advantageously, the approximate 180-degree range of rotation provided by the back rest 104 of the present invention supports a range of user back support preferences.

Figure 9A:
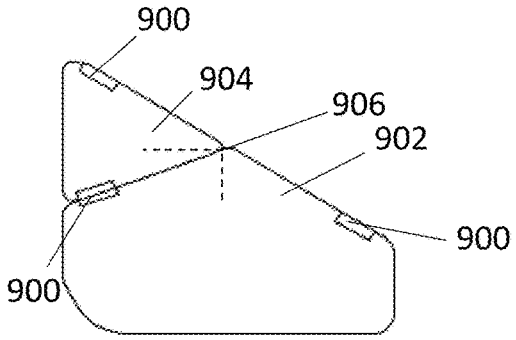
FIG. 9A illustrates a side orthogonal view of the knee block according to one embodiment of the present invention.

FIG. 9A illustrates a side orthogonal view of the knee block according to one embodiment of the present invention. The knee block, or multi-angle knee block (MAK), is comprised of at least two separate foam blocks, larger foam block 902 and smaller foam block 904. Each of the at least two foam blocks are connected to one another via a magnetic disc 900. The magnetic disc 900 is sewn into the fabric of each the foam blocks. In one embodiment, the magnetic discs use neodymium magnets and are recessed into the foam. In one embodiment, the knee blocks are comprised of a recycled plastic fabric. In one embodiment, the recycled plastic fabric is REPREVE. In another embodiment, the knee blocks are comprised of a polyester fiber. Each of the at least two blocks contain at least two magnetic discs 900. A hinge 906 further connects each of the at least two foam blocks together, enabling the MAK to transform its shape based on an individual user's desire. The hinge 906 is located on the seam between larger foam block 902 and smaller foam block 904, and is reinforced. By using multiple magnetic discs 900, a hinge 906, and interlocking knee blocks, larger foam block 902 and smaller foam block 904, the present invention enables a user to sit in a position to their liking and comfort level. This is especially useful for tight-hipped or inflexible people as discussed above, as it is often uncomfortable for these people to sit cross-legged. In one embodiment, each MAK is laser cut or molded. The MAK measures approximately 9.0 inches by 7.5 inches by 6.0 inches. In another embodiment, the hinge 906 is comprised of a fabric covering, requiring no insertion into each MAK. The fabric itself acts as the hinge 906 in order to keep the larger foam block 902 and the smaller foam block 904 attached to one another.

Figure 9B:
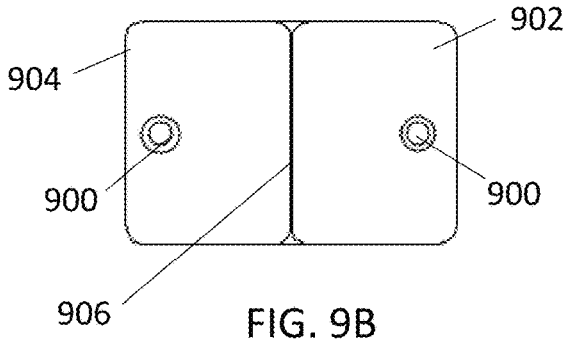
FIG. 9B illustrates a top orthogonal view of the knee block according to one embodiment of the present invention.

FIG. 9B illustrates a top orthogonal view of the knee block according to one embodiment of the present invention. The MAK is comprised of at least two foam blocks, larger foam block 902 and smaller foam block 904, which are connected to one another via a magnetic disc 900 and a hinge 906. Larger foam block 902 is pentagonal in shape, with the back of the foam block comprised of a rounded edge curving upwards, towards smaller foam block 904. Smaller foam block 904 is triangular in shape with a rounded top. Each foam block has at least two magnetic discs 900 sewn into the fabric. A hinge 906 further connects each of the at least two foam blocks 902 and 904 to one another, enabling a 180-degree rotation for smaller foam block 904 from a first locked position to a second locked position.

Figure 9C:
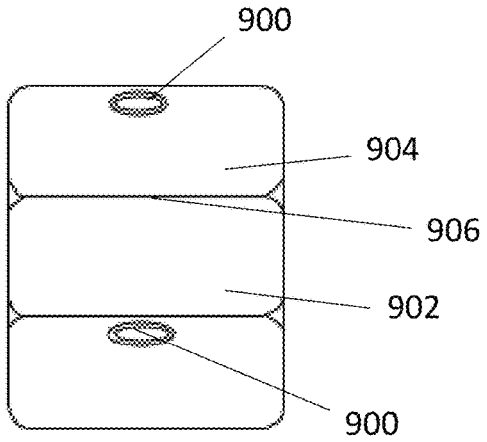
FIG. 9C illustrates a front orthogonal view of the knee block according to one embodiment of the present invention.

FIG. 9C illustrates a front orthogonal view of the knee block according to one embodiment of the present invention. This view of the knee block shows the position of two magnetic discs 900, located on each of the two foam blocks, larger foam block 902 and smaller foam block 904, that make up the knee block. In addition, the hinge 906 connecting the two foam blocks 902 and 904 that make up the knee block is visible.

Figure 9D:
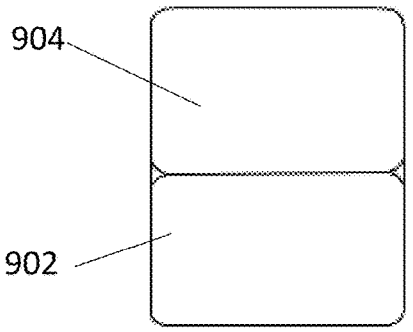
FIG. 9D illustrates a rear orthogonal view of the knee block according to one embodiment of the present invention.

FIG. 9D illustrates a rear orthogonal view of the knee block according to one embodiment of the present invention. The knee block is made up of at least two foam blocks, larger foam block 902 and smaller foam block 904. In one embodiment, the knee block measures approximately 6 inches wide and approximately 7.5 inches tall.

Figure 9F:
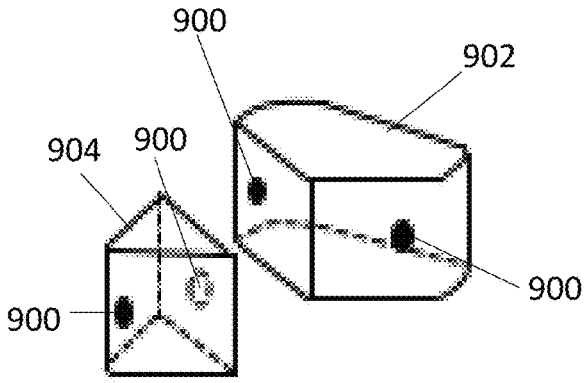
FIG. 9F illustrates a top perspective exploded transparent view of the knee block according to one embodiment of the present invention.
Figure 9E:
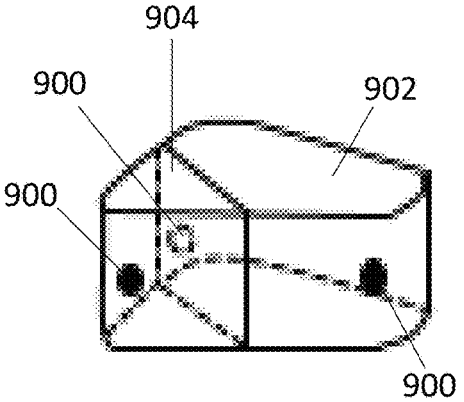
FIG. 9E illustrates a top perspective transparent view of the knee block according to one embodiment of the present invention.

FIG. 9E illustrates a top perspective transparent view of the knee block according to one embodiment of the present invention. The knee block includes at least four magnetic discs 900, which are sewn into the fabric of each foam block, 902 and 904. Each foam block includes at least two magnetic discs 900. In one embodiment, the foam blocks are constructed using a high-density foam such as EVA C shore 38 foam. In another embodiment, the foam blocks 902 and 904 are constructed using other types of materials including, but not limited to, other closed cell foams, thermoplastic elastomer (TPE) foam, recycled EVA foam, and/or a high-density upholstery foam. FIG. 9F illustrates a top perspective exploded transparent view of the knee block according to one embodiment of the present invention.

Figure 10C:
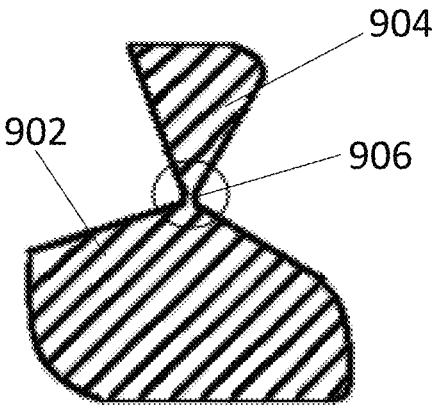
FIG. 10C illustrates a side orthogonal transparent view of the molded knee block in a transitional position according to one embodiment of the present invention.
Figure 10D:
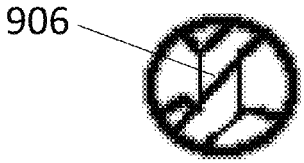
FIG. 10D illustrates a detail side orthogonal view of the hinge of the molded knee block in a transitional position according to one embodiment of the present invention.
Figure 10B:
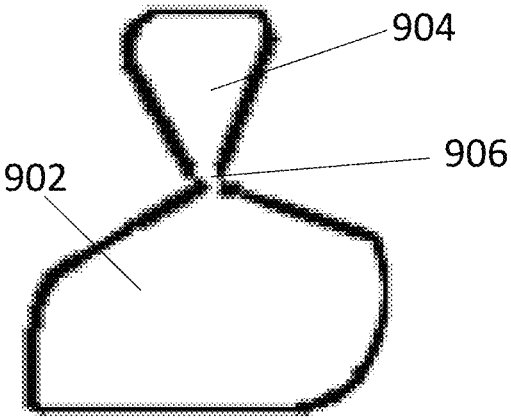
FIG. 10B illustrates a side orthogonal view of the molded knee block in a transitional position according to one embodiment of the present invention.
Figure 10E:
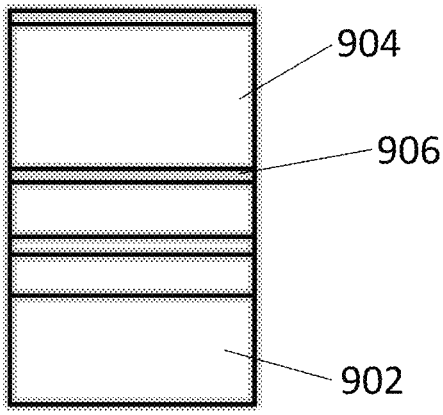
FIG. 10E illustrates a top orthogonal view of the molded knee block in a transitional position according to one embodiment of the present invention.
Figure 10A:
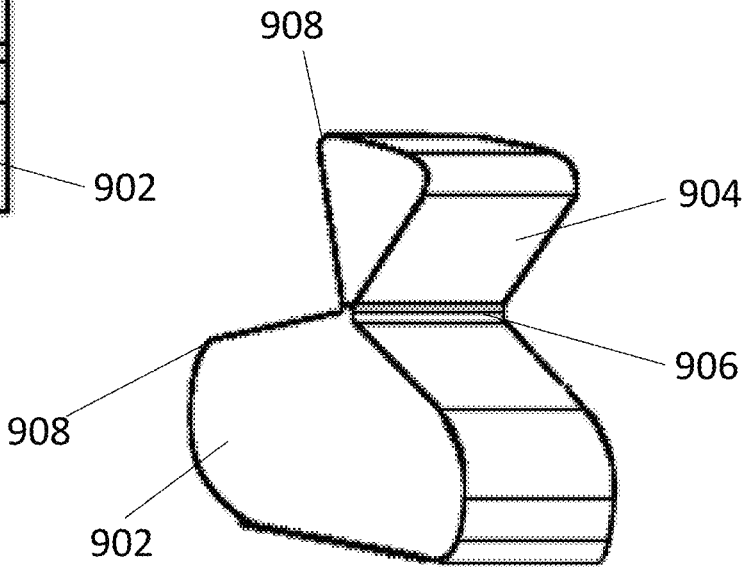
FIG. 10A illustrates a side perspective view of a molded knee block in a transitional position according to one embodiment of the present invention.

FIG. 10A illustrates a side perspective view of a molded knee block in a transitional position according to one embodiment of the present invention. The molded knee block includes ribs 908 along the perimeters of the foam blocks 902 and 904. In this transitional position, the hinge 906 connecting the two foam blocks, 902 and 904, is visible. This enables larger foam block 902 and smaller foam block 904 to adjust to a number of positions, depending upon what is most comfortable to the user or the position the user desires for meditation.

FIG. 10B illustrates a side orthogonal view of the molded knee block in a transitional position according to one embodiment of the present invention. The knee block includes at least two foam blocks, larger foam block 902 and smaller foam block 904, connected to one another via a hinge 906. The knee blocks are further operable to adjust position and connect to one another using magnetic discs. Each foam block is operable to rotate 180 degrees using the hinge 906 connecting the two foam blocks 902 and 904. In one embodiment, the total length of the base foam block is approximately 9.0 inches.

FIG. 10C illustrates a side orthogonal transparent view of the molded knee block in a transitional position according to one embodiment of the present invention. The two molded foam blocks, 902 and 904, are connected to one another via a hinge 906, enabling each molded foam block to rotate 180 degrees.

FIG. 10D illustrates a detail side orthogonal view of the hinge of the molded knee block in a transitional position according to one embodiment of the present invention. The hinge 906 connects the foam blocks, 902 and 904, comprising the molded knee block.

FIG. 10E illustrates a top orthogonal view of the molded knee block in a transitional position according to one embodiment of the present invention. Larger foam block 902 and smaller foam block 904 are connected to one another via a hinge 906.

Figure 10F:
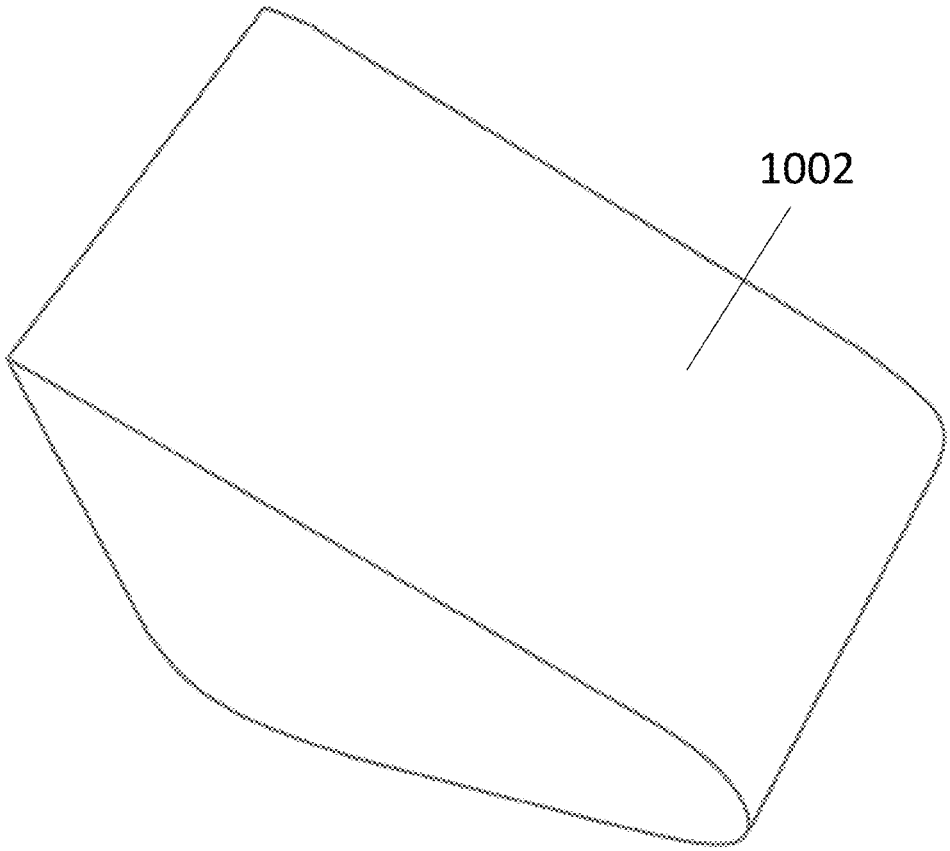
FIG. 10F illustrates a side perspective view of a molded knee block according to another embodiment of the present invention.

FIG. 10F illustrates a side perspective view of a molded knee block according to another embodiment of the present invention. In one embodiment, the molded knee block is comprised of a single knee block 1002. The single knee block 1002 is triangular in shape, with two rounded corners at the base of the single knee block 1002. Specifically, a side orthogonal view of the single knee block 1002 is triangular in shape with two rounded corners and one non-rounded corner. The single knee block 1002 is generally shaped as a triangular prism with rounded corners. In one embodiment, the single knee block includes a plurality of cutouts throughout the structure of the single knee block. Advantageously, this reduces the overall weight of the seat system, increasing the seat system's portability and structural integrity. In another embodiment, the single knee block includes a plurality of cutouts extending from the base of the single knee block to the center of the single knee block. In yet another embodiment, the single knee block is triangular in shape with flat faces and corners. In yet another embodiment, the single knee block includes at least one depression on an inner surface of the single knee block. The at least one depression enables the single knee block to better conform to a user, based on the size and shape of the user. The triangular single knee block 1002 is preferably a right triangle. In one embodiment, the triangular face of the single knee block 1002 is an isosceles triangle. In another embodiment, the triangular face of the single knee block 1002 is a scalene triangle, e.g. a 30-60-90 triangle.

Figure 10G:
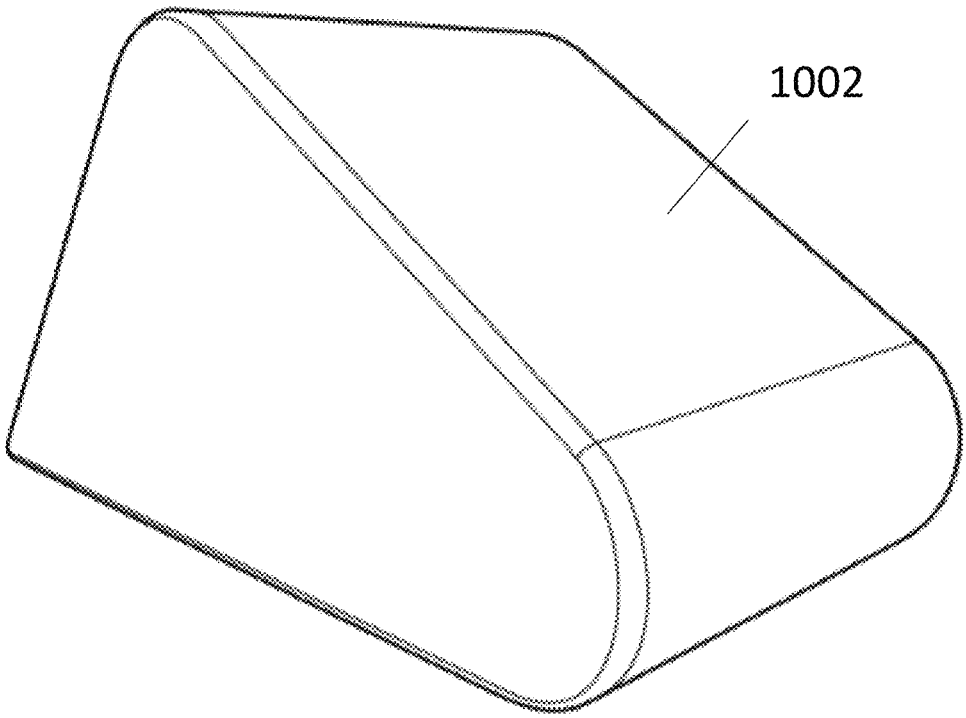
FIG. 10G illustrates a side perspective view of a molded knee block according to another embodiment of the present invention.

FIG. 10G illustrates a side perspective view of a molded knee block according to another embodiment of the present invention. The molded knee block is comprised of a single knee block 1002. The molded knee block is triangular in shape with two rounded corners.

Figure 10H:
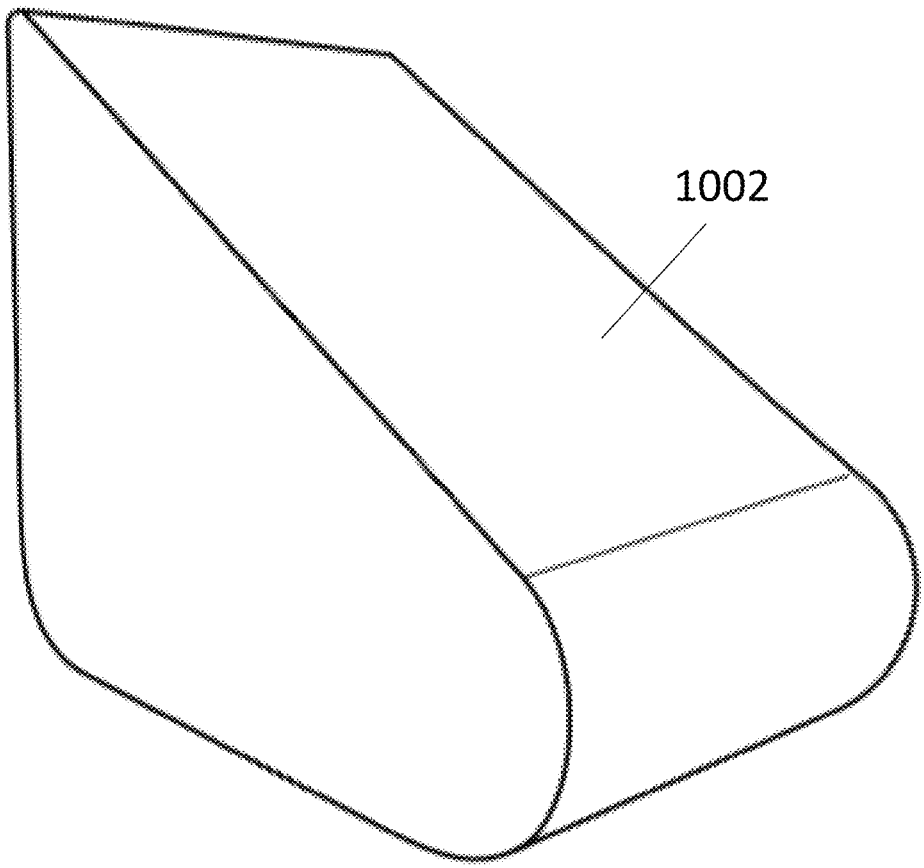
FIG. 10H illustrates a side perspective view of a molded knee block according to another embodiment of the present invention.

FIG. 10H illustrates a side perspective view of a molded knee block according to another embodiment of the present invention. The molded knee block is comprised of a single knee block 1002. The molded knee block is triangular in shape with two rounded corners.

Figure 10I:
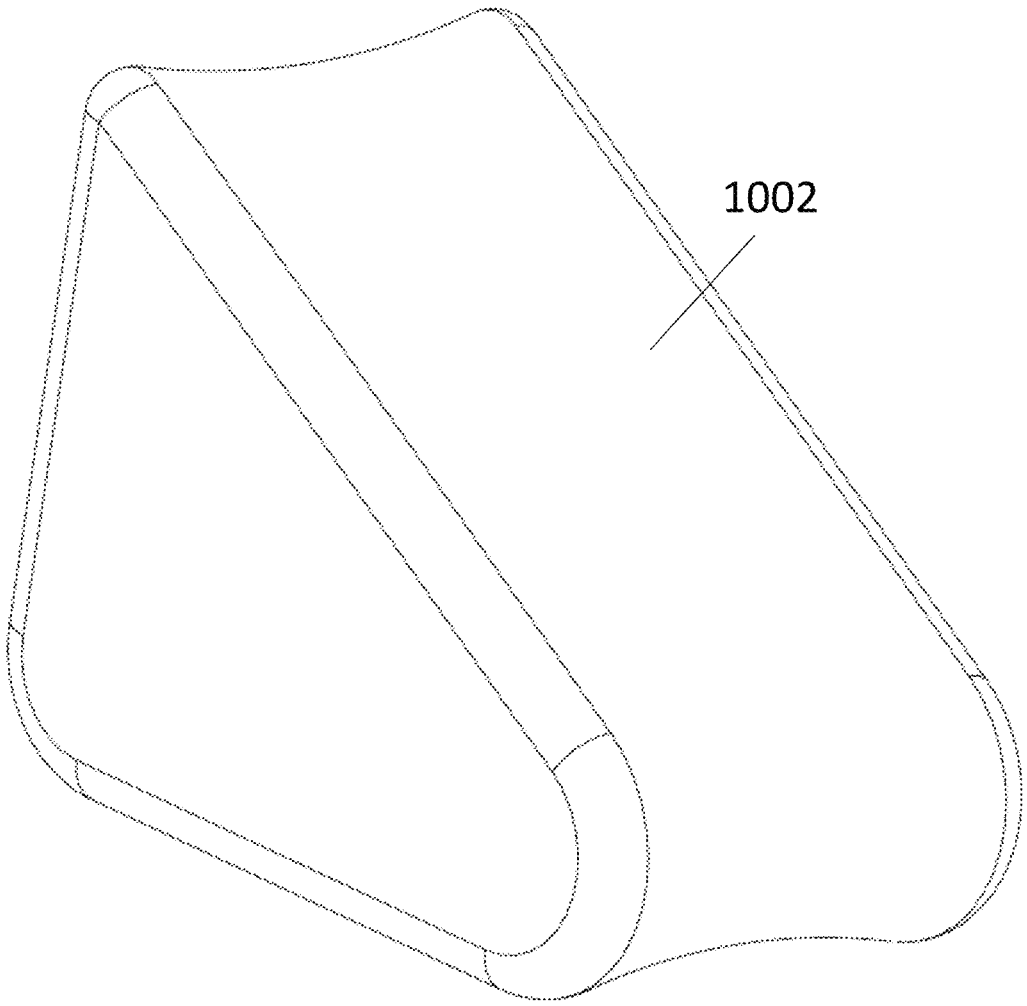
FIG. 10I illustrates a side perspective view of a molded knee block according to yet another embodiment of the present invention.

FIG. 10I illustrates a side perspective view of a molded knee block according to yet another embodiment of the present invention. The molded knee block is comprised of a single knee block 1002. The molded knee block is triangular in shape with three rounded corners. The molded knee block is further lined to create rounded edges.

Figure 11:
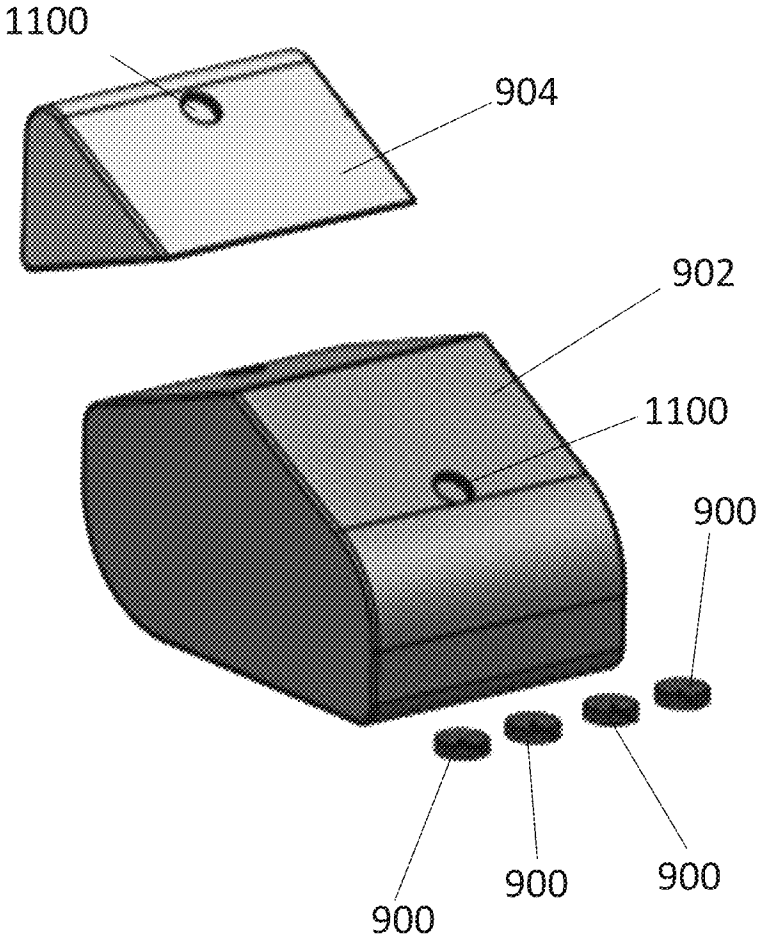
FIG. 11 illustrates an exploded front perspective view of a laser cut knee block according to one embodiment of the present invention.

FIG. 11 illustrates an exploded front perspective view of a laser cut knee block according to one embodiment of the present invention. Larger foam block 902 and smaller foam block 904 each have at least two indentations 1100 operable to contain magnetic discs 900. Once magnetic discs 900 have been inserted into the foam blocks 902 and 904, the foam blocks are operable to adjust their position using the magnetic discs 900 and a hinge.

Figure 12A:
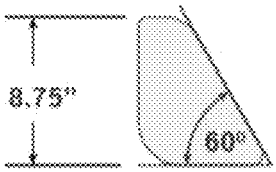
FIG. 12A illustrates a side orthogonal view of the knee block resting on a first side of the knee block according to one embodiment of the present invention.

With different users requiring a different level of hip support, the MAKs advantageously provide users with at least seven different variations. FIG. 12A illustrates a side orthogonal view of the knee block resting on a first side of the knee block according to one embodiment of the present invention. In one embodiment, the knee block resting on the first side of the knee block measures approximately 8.75 inches in height. In addition, a side of the knee block closest to the seat of the present invention resting on the first side of the knee block is at a 60-degree angle in relation to the base of the seat assembly system.

Figure 12B:
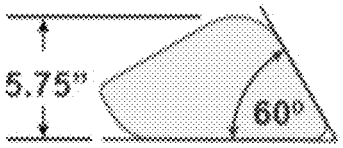
FIG. 12B illustrates a side orthogonal view of the knee block resting on a top of the knee block according to one embodiment of the present invention.

FIG. 12B illustrates a side orthogonal view of the knee block resting on a top of the knee block according to one embodiment of the present invention. In one embodiment, the knee block resting on the top of the knee block measures approximately 5.75 inches in height. In addition, the knee block closest to the seat of the present invention resting on the first side of the knee block is at a 60-degree angle in relation to the base of seat assembly system. The knee blocks are operable to adjust to angles including, but not limited to, 18 degrees, 30 degrees, 45 degrees, and/or 60 degrees.

Figure 12C:
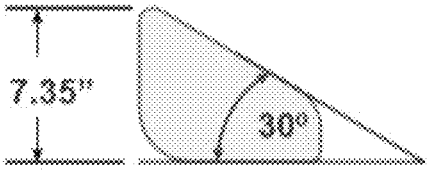
FIG. 12C illustrates a side orthogonal view of the knee block resting on a base of the knee block according to one embodiment of the present invention.

FIG. 12C illustrates a side orthogonal view of the knee block resting on a base of the knee block according to one embodiment of the present invention. In one embodiment, the knee block resting on the base of the knee block measures approximately 7.35 inches in height. In addition, the knee block closest to the seat of the present invention resting on the base of the knee block is at a 30-degree angle in relation to the base of the seat assembly system.

Figure 12D:
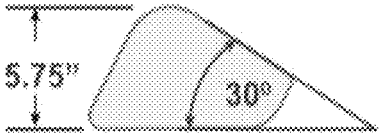
FIG. 12D illustrates a side orthogonal view of the knee block resting on a base of the knee block rotated 180 degrees from the position of the knee block in FIG. 12B according to one embodiment of the present invention.

FIG. 12D illustrates a side orthogonal view of the knee block resting on a base of the knee block rotated 180 degrees from the position of the knee block in FIG. 12B according to one embodiment of the present invention. In one embodiment, the knee block measures 5.75 in this position, and is positioned at a 30-degree angle in relation to the base of the seat assembly system.

Figure 12E:
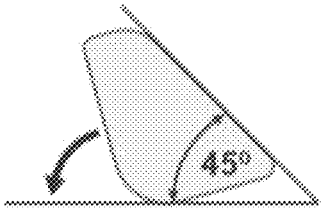
FIG. 12E illustrates a side orthogonal view of the knee block resting on a portion of the first side and a portion of the rounded corner formed by the first side of the knee block and a top of the knee block according to one embodiment of the present invention.

FIG. 12E illustrates a side orthogonal view of the knee block resting on a portion of the first side and a portion of the rounded corner formed by the first side of the knee block and a top of the knee block according to one embodiment of the present invention. The knee block closest to the seat of the present invention resting on a portion of the first side and a portion of the rounded corner formed by the first side of the knee block and top of the knee block is positioned at a 45-degree angle in relation to the base of the seat assembly.

Figure 12F:
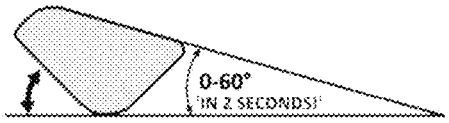
FIG. 12F illustrates a side orthogonal view of the knee block resting on a portion of the first side and a portion of the rounded corner formed by the first side of the knee block and a top of the knee block according to one embodiment of the present invention.

FIG. 12F illustrates a side orthogonal view of the knee block resting on a portion of the first side and a portion of the rounded corner formed by the first side of the knee block and a top of the knee block according to one embodiment of the present invention. In one embodiment, the knee block in this position is operable to rotate such that a portion of the surface of the knee block is at an angle between 0 and 60 degrees in relation to the base of the seat assembly system.

Figure 12G:
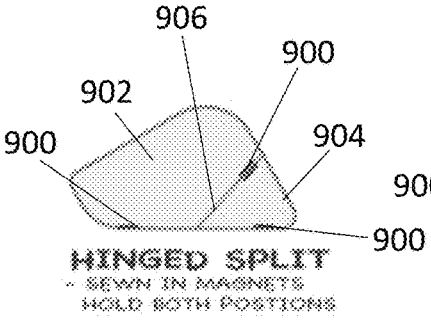
FIG. 12G illustrates a side transparent orthogonal view of the knee block resting on a top of the knee block according to one embodiment of the present invention.

FIG. 12G illustrates a side transparent orthogonal view of the knee block resting on a top of the knee block according to one embodiment of the present invention. A hinge 906 is present, separating the knee block into two different foam blocks, larger foam block 902 and smaller foam block 904. Within each foam block, magnetic discs 900 have been sewn in, enabling the knee block to assume a variety of positions. The magnetic discs 900 are operable to hold the knee block together.

Figure 12H:
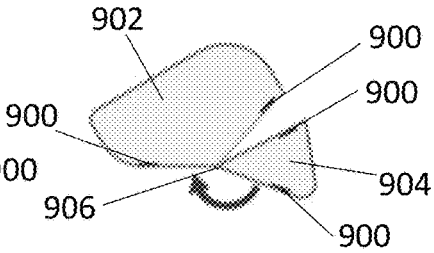
FIG. 12H illustrates a side transparent orthogonal view of a wedge of the knee block rotating about the base of the knee block via the hinge according to one embodiment of the present invention.

FIG. 12H illustrates a side transparent orthogonal view of a wedge of the knee block rotating about the base of the knee block via the hinge according to one embodiment of the present invention. The hinge 906, in conjunction with magnetic discs 900 sewn into each of the two foam blocks that make up the knee block, larger foam block 902 and smaller foam block 904, enables the two foam blocks to rotate around one another.

Figure 12I:
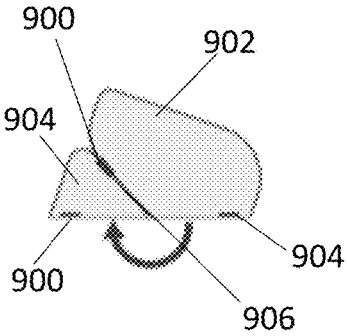
FIG. 12I illustrates a side transparent orthogonal view of the wedge of the knee block rotated about the base of the knee block via the hinge according to one embodiment of the present invention.

FIG. 12I illustrates a side transparent orthogonal view of the wedge of the knee block rotated about the base of the knee block via the hinge according to one embodiment of the present invention. The hinge 906 enables the knee block, comprised two separate foam blocks, larger foam block 902 and smaller foam block 904, to rotate into a variety of positions, where the knee block is held in place by magnetic discs 900 sewn within each foam block.

Figure 12J:
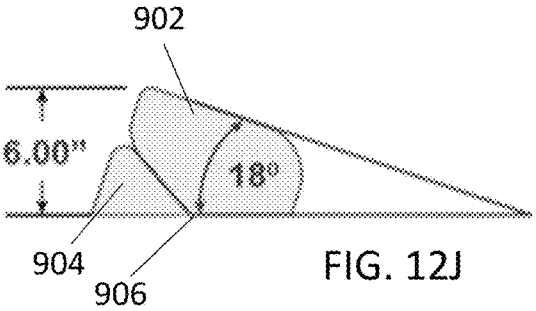
FIG. 12J illustrates a side orthogonal view of the wedge of the knee block rotated about the base of the knee block via the hinge according to one embodiment of the present invention.

FIG. 12J illustrates a side orthogonal view of the wedge of the knee block, comprised of a larger foam block 902 and smaller foam block 904, rotated about the base of the knee block via the hinge 906 according to one embodiment of the present invention. In one embodiment, the knee block measures approximately 6.0 inches in height and is operable to rotate to a maximum angle of 18-degrees in relation to the base of the seat assembly system.

Figure 13A:
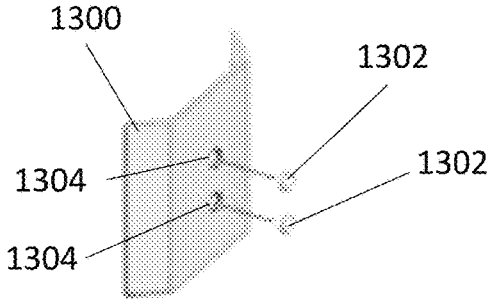
FIG. 13A illustrates a side perspective view of a back plate for a back rest according to one embodiment of the present invention.

FIG. 13A illustrates a side orthogonal view of a back plate for a back rest according to one embodiment of the present invention. The back plate 1300 includes two magnets 1302, where the two magnets 1302 are operable to fit into magnet slots 1304 cutout from the back plate 1300. The back plate 1300 is rectangular in shape, with two edges placed at an angle from the main structure. In one embodiment, the back plate includes a screw plate, where the screw plate is operable to attach to the back rest and connect the back rest to a spine via screws.

Figure 13B:
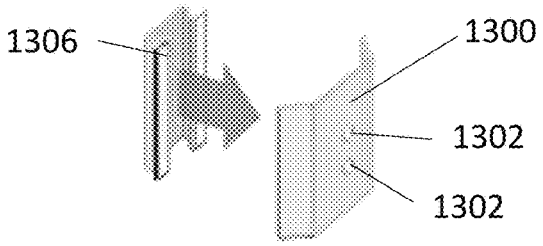
FIG. 13B illustrates a side perspective view of a black plate and a slider for a back rest according to one embodiment of the present invention.

FIG. 13B illustrates a side orthogonal view of a black plate and a slider for a back rest according to one embodiment of the present invention. The back plate 1300 connects to a slider 1306 via two magnets 1302.

Figure 13C:
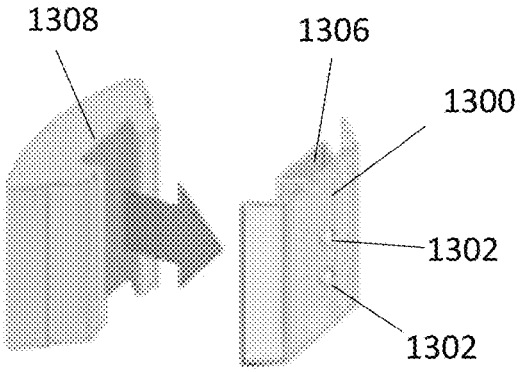
FIG. 13C illustrates a side perspective view of a back plate, a slider, and a back cushion for a back rest according to one embodiment of the present invention.

FIG. 13C illustrates a side orthogonal view of a back plate, a slider, and a back cushion for a back rest according to one embodiment of the present invention. The back plate 1300, connected to the slider 1306 via two magnets 1302, is operable to connect to the back cushion 1308. The slider 1306 enables the back cushion 1308 to slide onto the back plate 1300.

Figure 13D:
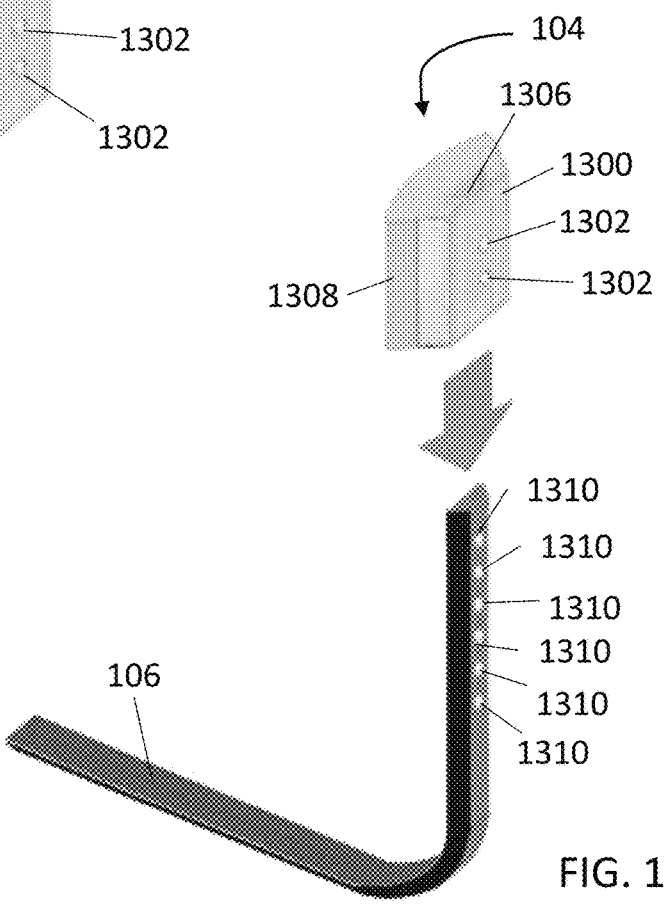
FIG. 13D illustrates a side perspective view of a back rest lowering onto a spine according to one embodiment of the present invention.

FIG. 13D illustrates a side orthogonal view of a back rest lowering onto a spine according to one embodiment of the present invention. The back cushion 1308 attached to the back plate 1300, via the two magnets 1302 and slider 1306, is operable to slide onto the spine 106. Once on the spine, spine magnets 1310 enable the back rest 104 to adjust in height.

Figure 13E:
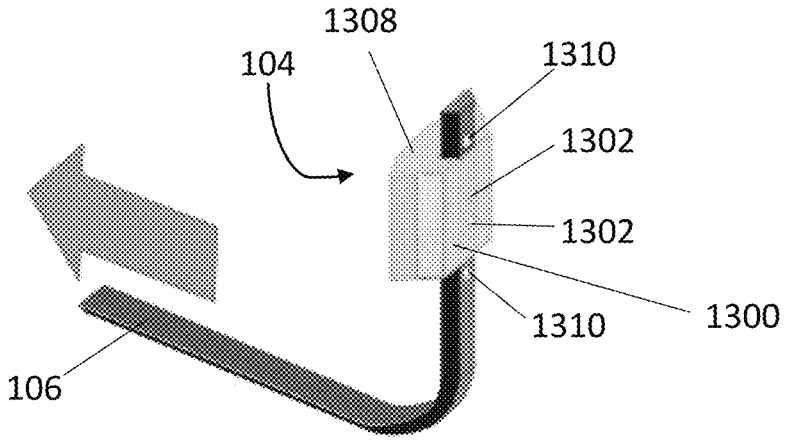
FIG. 13E illustrates a side perspective view of a back rest attached to a spine according to one embodiment of the present invention.

FIG. 13E illustrates a side orthogonal view of a back rest attached to a spine according to one embodiment of the present invention. The back rest 104, comprised of the back plate 1300 and back cushion 1308, connected to one another via two magnets 1302, is operable to slide onto the spine 106. Once on the spine, the back rest 104 is operable to adjust in height using spine magnets 1310. The spine 106 and back rest 104 are then operable to attach to a seat.

Figure 13F:
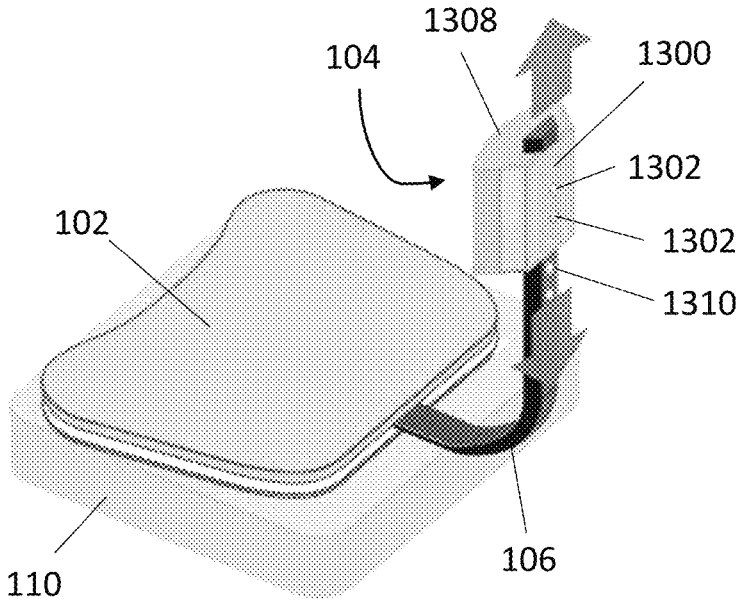
FIG. 13F illustrates a side perspective view of a back rest and a spine connected to a seat according to one embodiment of the present invention.

FIG. 13F illustrates a side orthogonal view of a back rest and a spine connected to a seat according to one embodiment of the present invention. The back rest 104, comprised of the back plate 1300 connected to the back cushion 1308 via two magnets 1302, slides onto the spine 106 and connects via spine magnets 1310. The spine 106 is operable to connect to the seat 102, which sits on top of the base 110 of the seat system.

Figure 13G:
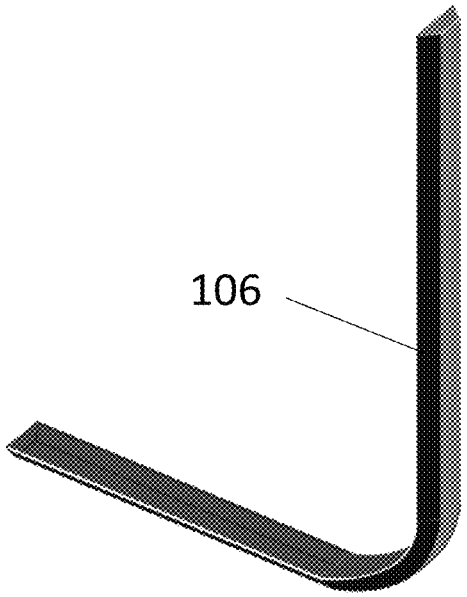
FIG. 13G illustrates a side perspective view of a spine according to one embodiment of the present invention.

FIG. 13G illustrates a side perspective view of a spine according to one embodiment of the present invention. In one embodiment, the spine 106 is made of steel.

Figure 13H:
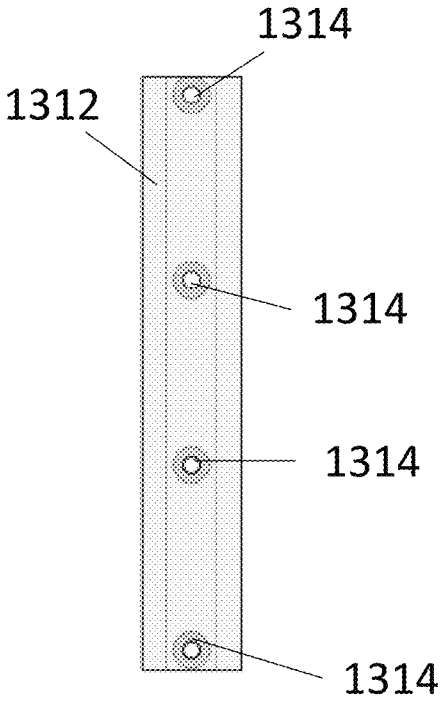
FIG. 13H illustrates front perspective view of a screw plate for a spine according to one embodiment of the present invention.

FIG. 13H illustrates front perspective view of a screw plate for a spine according to one embodiment of the present invention. The screw plate 1312 includes four screw holes 1314 operable to connect a seat support to a spine via screws. In one embodiment, the screw plate is made of aluminum. In one embodiment, the screw plate is made of steel. In another embodiment, the screw plate is made of plastic. In another embodiment, the screw plate is made of wood.

Figure 13I:
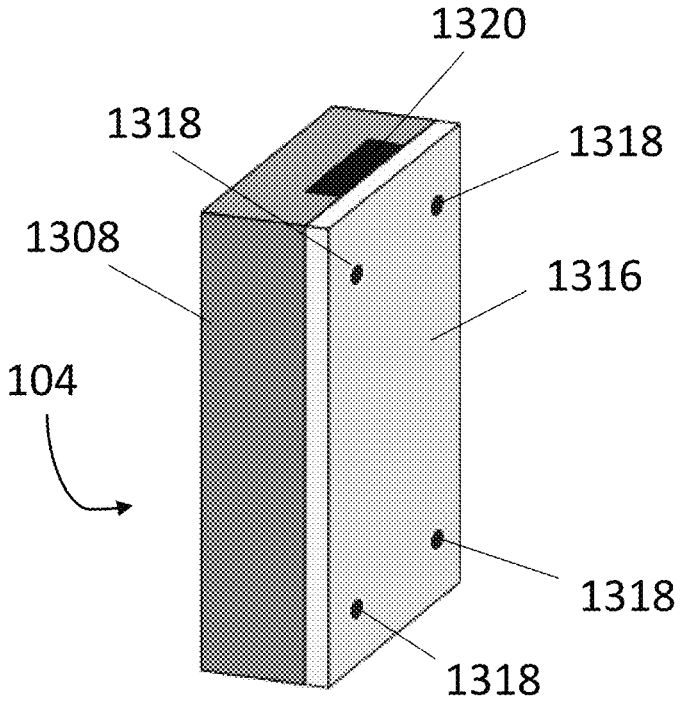
FIG. 13I illustrates a side perspective view of a back rest according to one embodiment of the present invention.

FIG. 13I illustrates a side perspective view of a back rest according to one embodiment of the present invention. The back rest 104 includes a cushion 1308 and a bracket 1316. In one embodiment, the cushion 1308 is connected to the bracket 1316 via four screw holes 1318. In another embodiment, the cushion 1308 is adhered to the bracket 1316. In one embodiment the cushion 1308 is a foam pad cushion. In one embodiment, the bracket 1316 is made of plywood. The back rest 104 further includes a rectangular cutout 1320 operable to allow a spine to connect to the backrest by sliding one end of the spine into the rectangular cutout 1320.

Figure 14A:
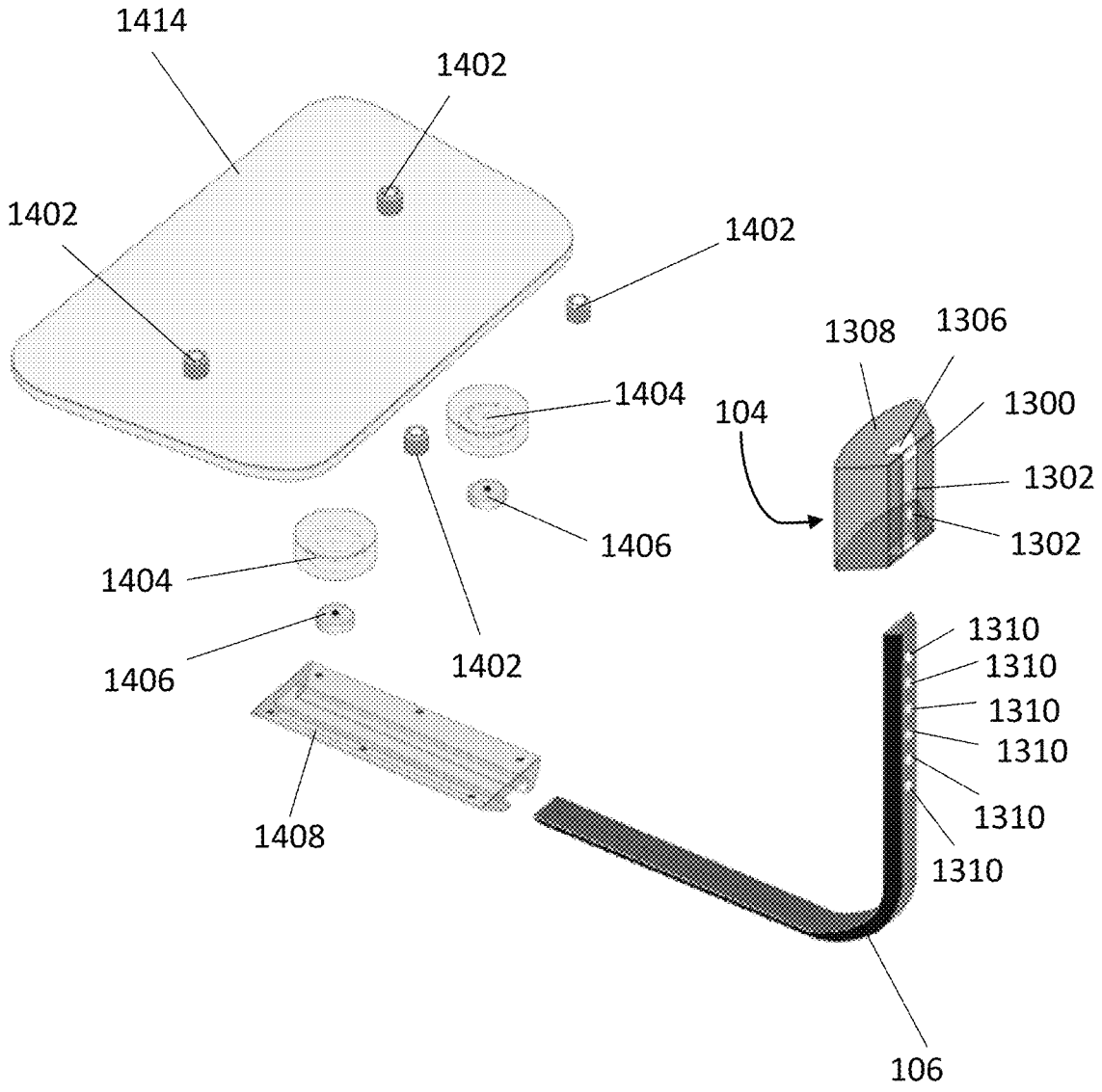
FIG. 14A illustrates an exploded view of a seat support, spine, and back rest according to one embodiment of the present invention.

FIG. 14A illustrates an exploded view of a seat support, spine, and back rest according to one embodiment of the present invention. The back rest 104, comprised of the back cushion 1308, slider 1306 and back plate 1300, connects to the spine 106 via the spine magnets 1310 and the two magnets 1302 on the back rest. The spine 106 is operable to slide into and attach to the seat connector 1408 via screws 1402. The seat connector 1408 is operable to attach to a seat support 1414, enabling greater back rest support for the seat system. In one embodiment, the seat support 1414 is comprised of wood. In one embodiment, the seat support 1414 is comprised of plastic. In another embodiment, the seat support 1414 is comprised of cardboard. In another embodiment, the seat support 1414 is comprised of bioplastic. Riser receivers 1404 and 1406 enable the riser plates to click into the seat support 1410. The seat support 1414 connects to the seat of the seat system and is covered once both components are attached to one another. In one embodiment, the cover over the seat and the seat support 1414 is a foam cover. In one embodiment, the cover over the seat and the seat support 1414 is a cotton cover.

FIG. 14B illustrates a side orthogonal view of a seat support and riser plate according to one embodiment of the present invention. The seat support 1414 is operable to connect to the riser plate 108 via two magnetic protrusions 202. The two magnetic protrusions 202 slide into the two corresponding riser receivers 1412 located on the seat support 1414. The riser plate 108 includes cutouts 710, decreasing the overall weight of each riser plate, as well as grip indentations 706. In addition, each of the two magnetic protrusions 202 includes one thru hole 708.

Figure 14C:
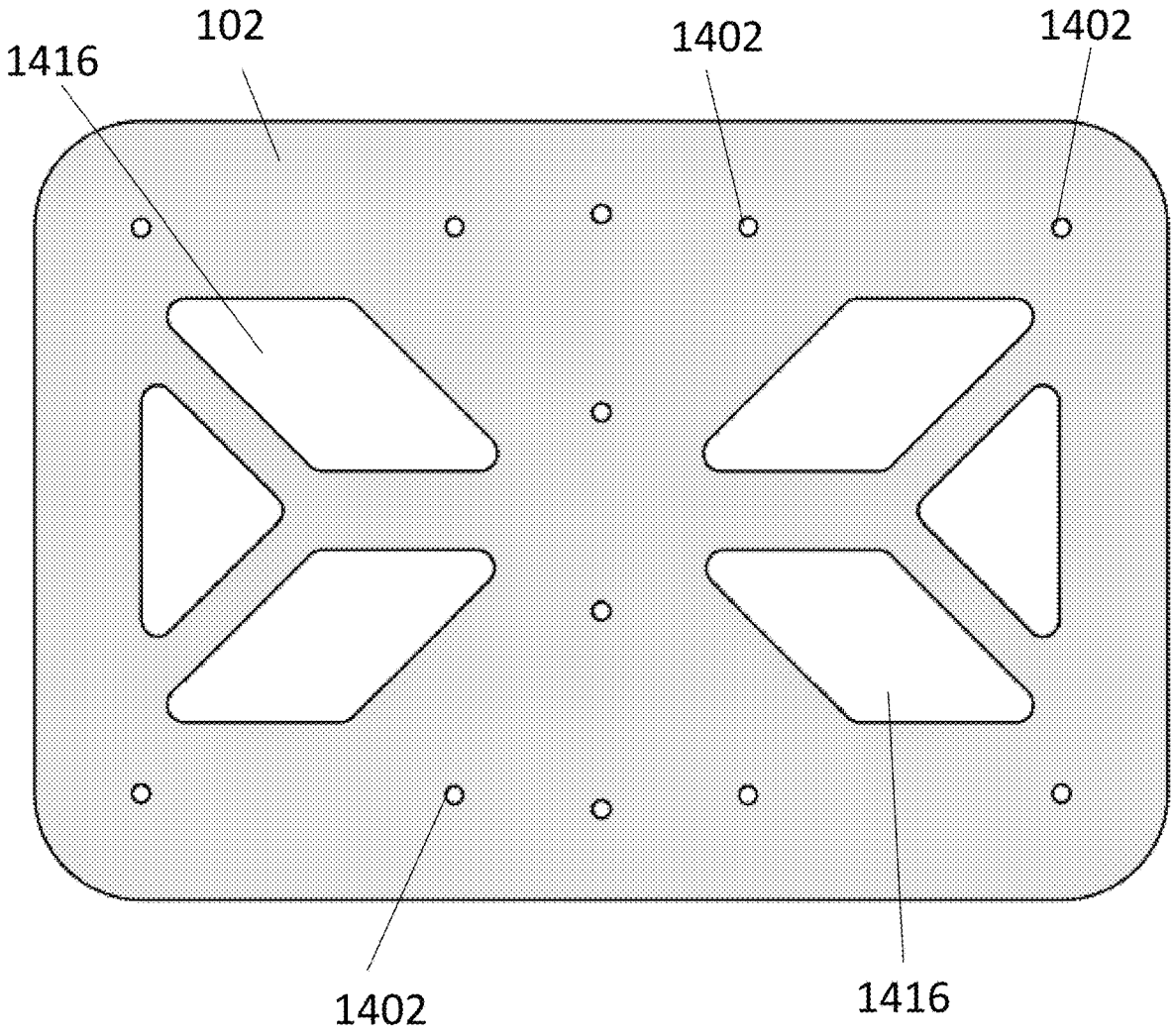
FIG. 14C illustrates a bottom view of a seat according to one embodiment of the present invention.

FIG. 14C illustrates a bottom view of a seat according to one embodiment of the present invention. The seat 102 includes a plurality of screw holes 1402, some of which are labeled in FIG. 14C, and a plurality of seat cutouts 1416, some of which are labeled in FIG. 14C. The plurality of screw holes enables the seat 102 to connect to a seat support. Furthermore, the plurality of seat cutouts 1416 decrease the overall weight of the seat system, increasing the seat system's portability and structural integrity.

Figure 14D:
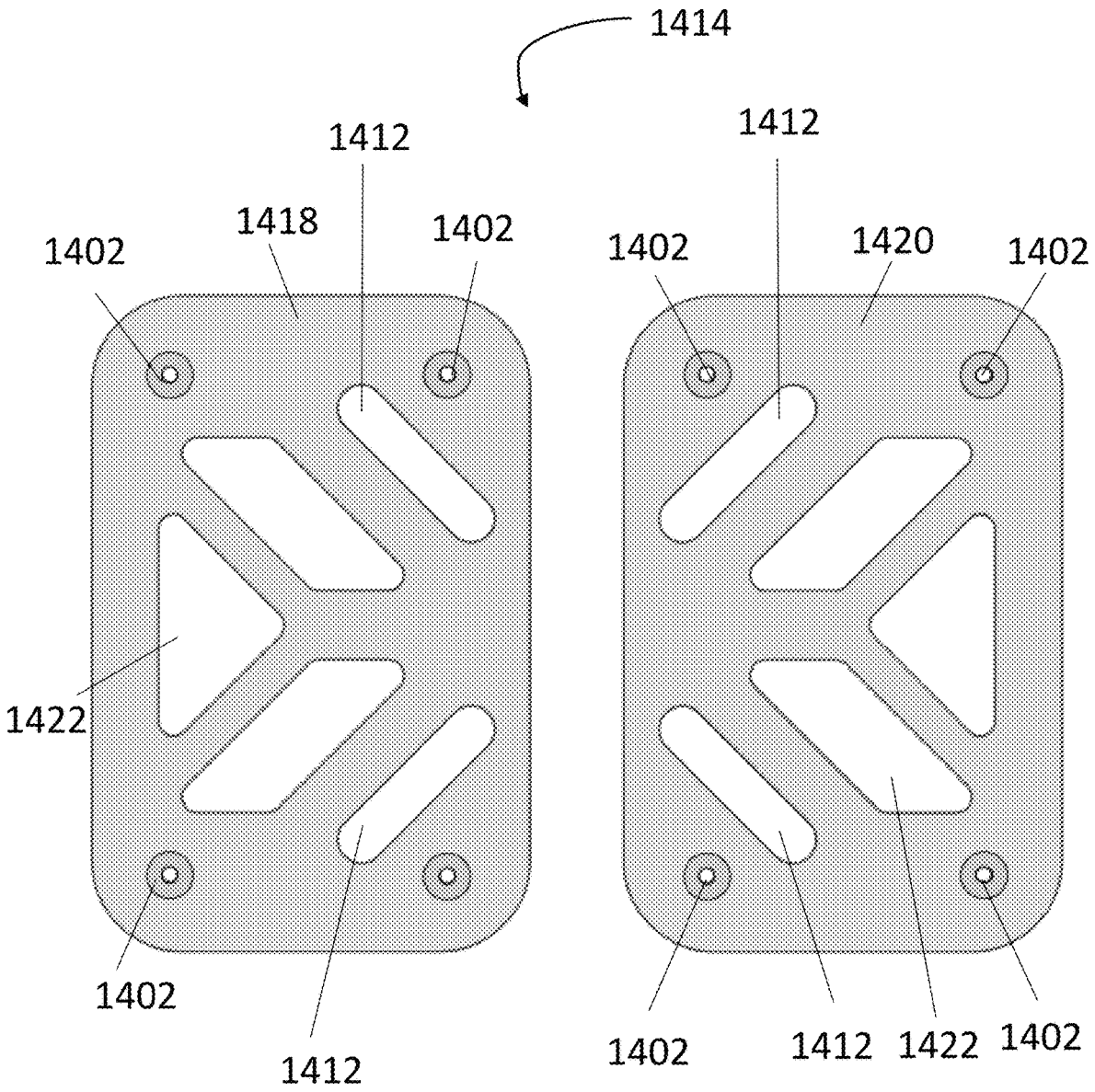
FIG. 14D illustrates a bottom view of a seat support according to one embodiment of the present invention.

FIG. 14D illustrates a bottom view of a seat support according to one embodiment of the present invention. The seat support 1414 is comprised of two pieces, a first seat support piece 1418 and a second seat support piece 1420. Each of the first and second seat support pieces, 1418 and 1420, includes four screw holes 1402, two riser receivers 1412, and a plurality of seat support cutouts 1422, some of which are labeled in FIG. 14D. Each of the riser receivers 1412 is operable to receive a protrusion placed on each riser plate. In one embodiment, the riser receivers are operable to receive protrusions placed on X-shaped riser plates. In addition, the plurality of seat support cutouts decreases the overall weight of the seat system, increasing the seat system's portability and structural integrity.

Figure 14E:
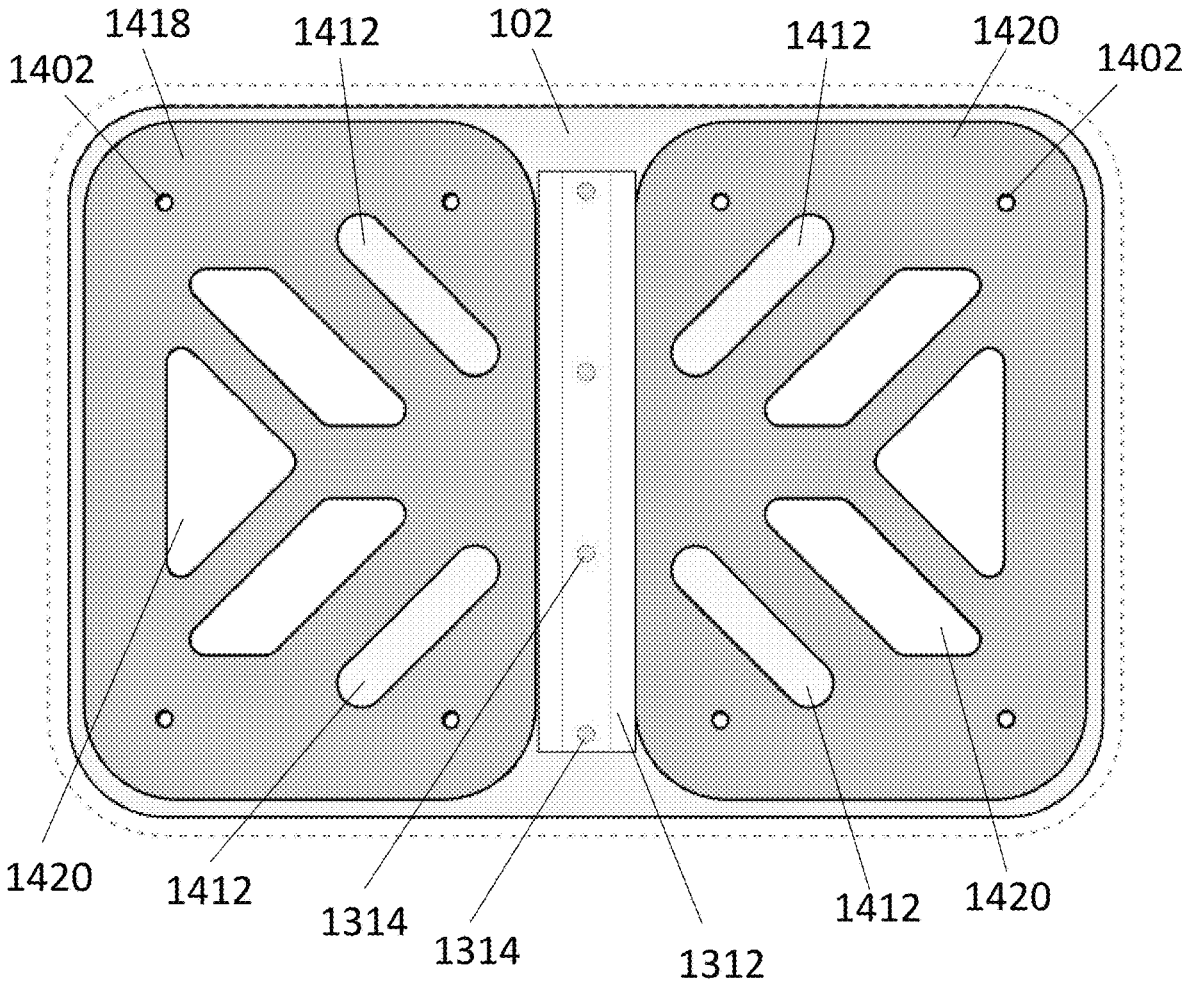
FIG. 14E illustrates a bottom view of a seat support connected to a seat according to one embodiment of the present invention.

FIG. 14E illustrates a bottom view of a seat support connected to a seat according to one embodiment of the present invention. The seat 102 is connected to the seat support via a first seat support piece 1418, a second seat support piece 1420, and a screw plate 1312. The screw plate 1312 is operable to hold at least four screws via screw holes 1314, some of which are labeled in FIG. 14E. The seat support connected to the seat is further operable to connect to a riser plate via four riser receivers 1412, where the first seat support piece includes two riser receivers 1412 and the second seat support piece includes two riser receivers 1412. In addition, the first seat support piece and the second seat support piece both include a plurality of seat support cutouts 1420, some of which are labeled in FIG. 14E. The first seat support piece 1418 and the second seat support piece 1420 are further connected to the seat 102 via a plurality of screws 1402.

In one embodiment, the screw plate is an extrusion between the first seat support piece and the second seat support piece, where the screw plate connects a spine to the seat support system. The spine is operable to slide onto or slide into the screw plate and is held in place via screws, enabling a user to adjust the position of a backrest attached to the spine. In addition, where the screw plate is an extrusion between the first seat support piece and the second support piece, this positioning allows a user to remove the spine and the backrest from the seat system, allowing for greater portability of the seat system.

Figure 14F:
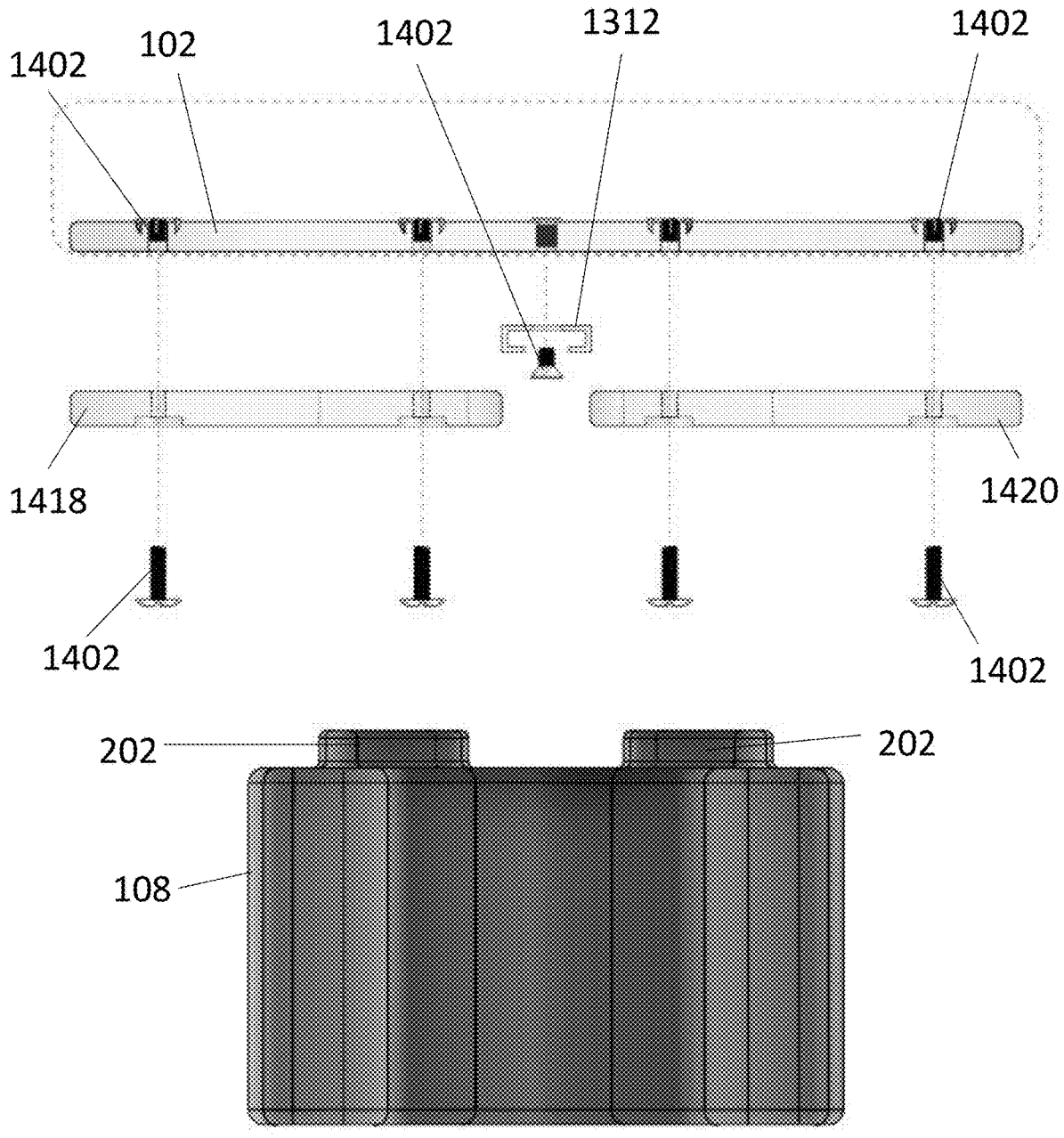
FIG. 14F illustrates a side-exploded view of a seat and seat support connecting to a riser plate according to one embodiment of the present invention.

FIG. 14F illustrates a side-exploded view of a seat and seat support connecting to a riser plate according to one embodiment of the present invention. The seat 102 connects to the seat support, which is comprised of a first seat support piece 1418 and a second seat support piece 1420, via screws 1402 and a screw plate 1312. The screw plate 1312 connects to the seat 102 via screws 1402, some of which are labeled in FIG. 14F. The seat and seat support are then operable to connect to a riser plate 108 via protrusions 202, where the protrusions 202 are operable to slide into the first seat support piece 1418 and the second seat support piece via riser receivers.

Figure 14G:
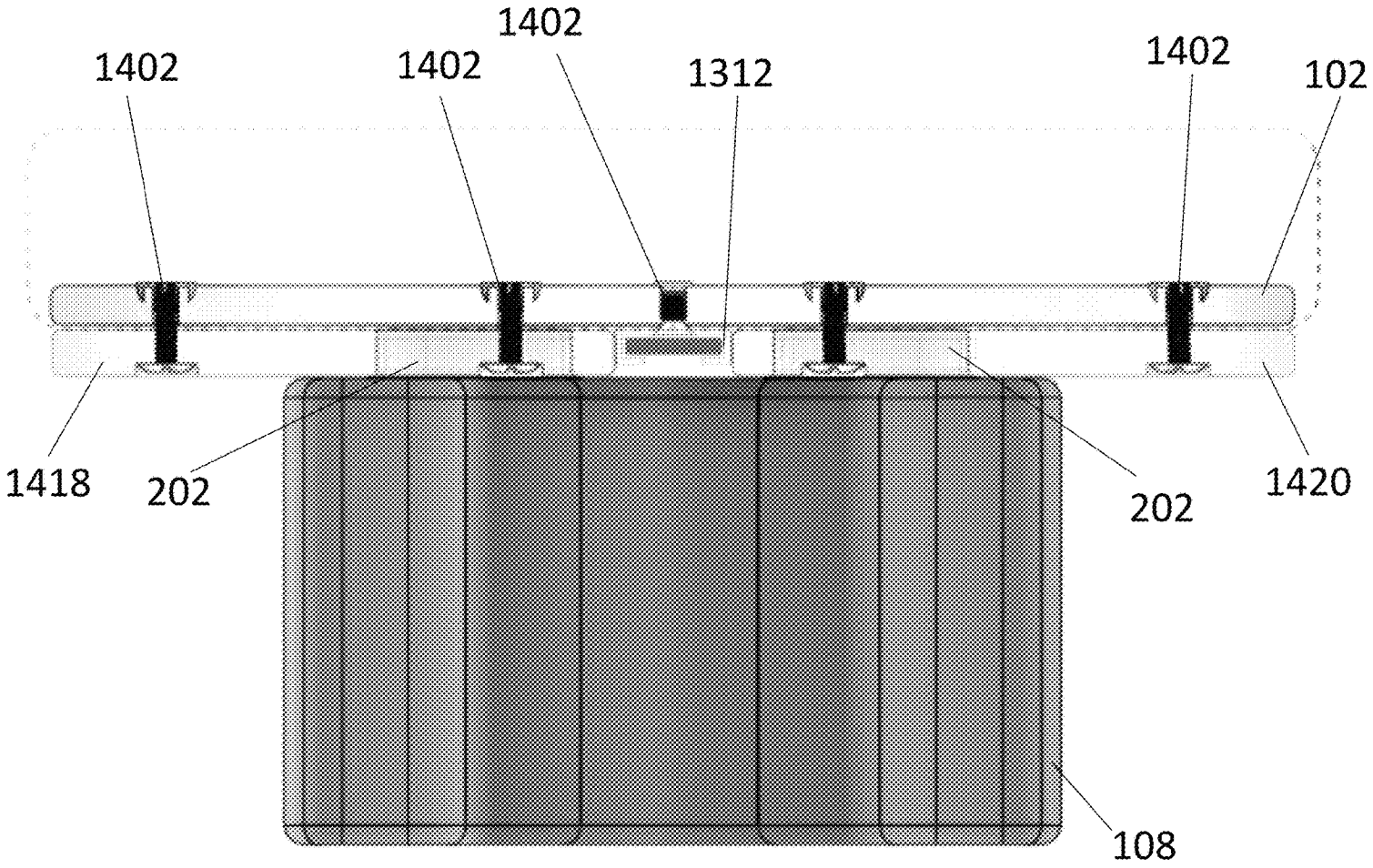
FIG. 14G illustrates an orthogonal side view of a seat and seat support connected to a riser plate according to one embodiment of the present invention.

FIG. 14G illustrates an orthogonal side view of a seat and seat support connected to a riser plate according to one embodiment of the present invention. The seat 102 connects to the seat support, comprised of a first seat support piece 1418 and a second seat support piece 1420, via screws 1402. The connected seat and seat support are then operable to connect to a riser plate 108 via protrusions 202 on the riser plate. The protrusions 202 slide into the first seat support piece 1418 and the second seat support piece 1420.

Figure 14H:
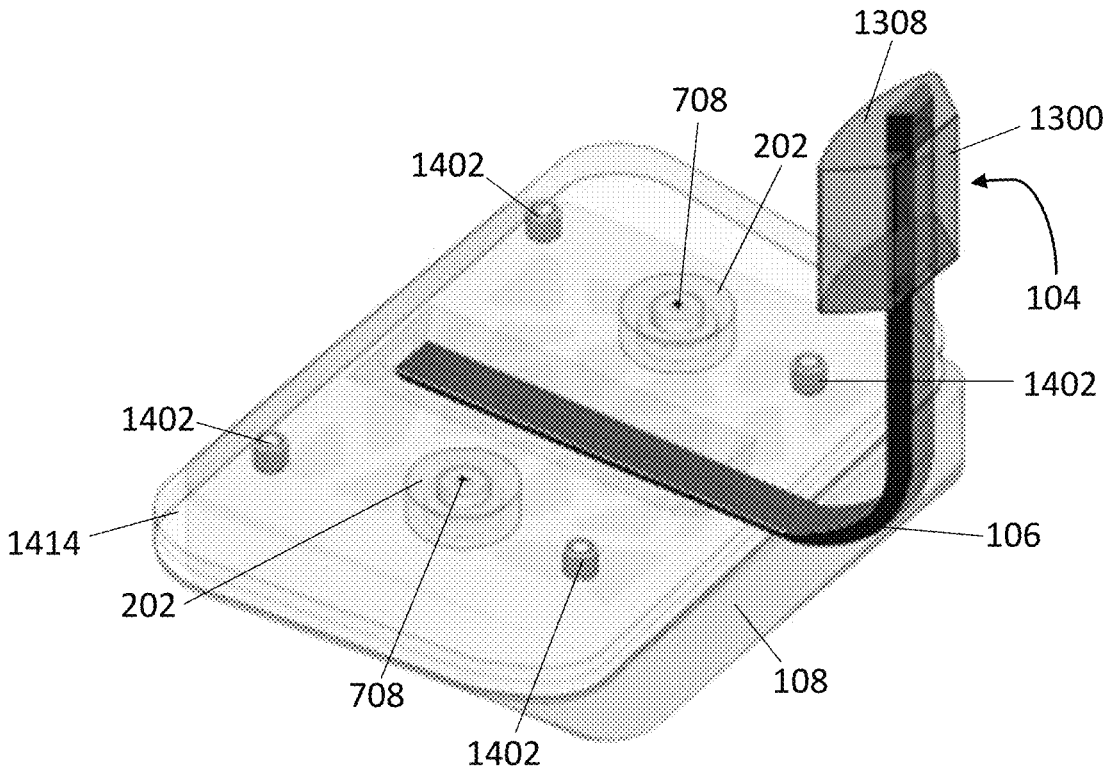
FIG. 14H illustrates a side perspective view of a seat support attached to a riser plate, spine, and back rest according to one embodiment of the present invention.

FIG. 14H illustrates a side orthogonal view of a seat support attached to a riser plate, spine, and back rest according to one embodiment of the present invention. The seat support 1414 connects to the riser plate 108 via two magnetic protrusions 202, where each of the two magnetic protrusions 202 contains one thru hole 708. The seat support 1414 includes two riser receivers 1412 which are operable to receive the two magnetic protrusions 202, connecting the riser plate 108 to the seat support 1414. The seat support 1414 is held in place by four screws 1402. The back rest 104, comprised of the back cushion 1308 and back plate 1300, is operable to adjust in height on the spine 106.

Figure 15:
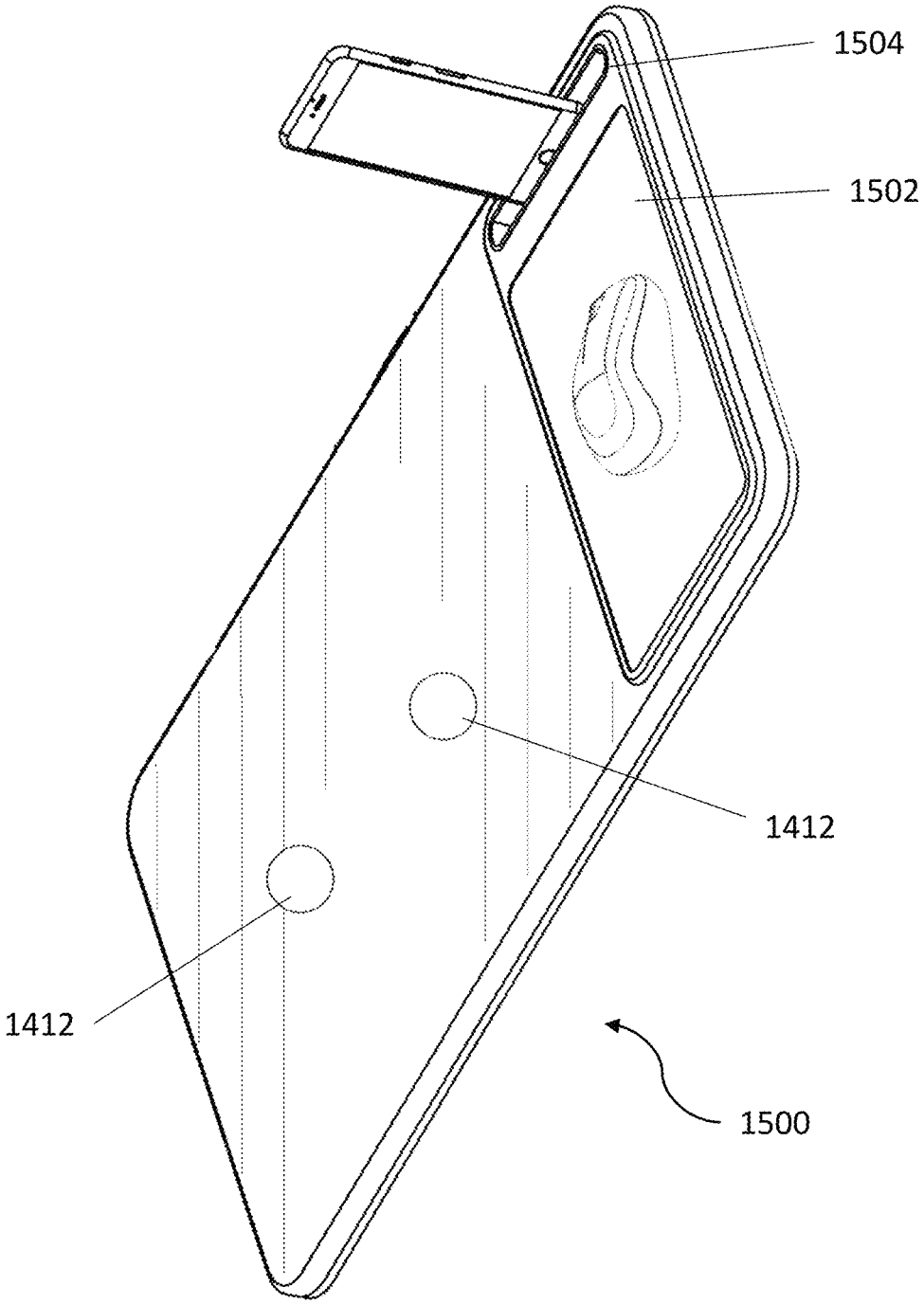
FIG. 15 illustrates a front perspective view of a desk attachment according to one embodiment of the present invention.

In another embodiment, the present invention includes a desk component operable to be used as a writing surface or surface on which a laptop computer, tablet, or other electronic mobile device is operable to be supported. FIG. 15 illustrates a front perspective view of a desk component according to one embodiment of the present invention. The desk component 1500 includes two riser receivers 1412 operable to receive protrusions from a riser plate immediately below the desk component 1500. The desk component includes a mouse pad area 1502 and a mobile device holder 1504. Advantageously, the desk component 1500 of the present invention is operable to be placed on a stack of risers instead of the seat support, and a user is operable to utilize the desk component in a kneeling position or a cross-legged position using the knee blocks of the present invention as support. Alternatively, the desk component 1500 and a set of risers are operable to be utilized simultaneously with the seat and a set of risers, such that a user of the seat system sits in the seat and simultaneously uses the desk component 1500.

Figure 16A:
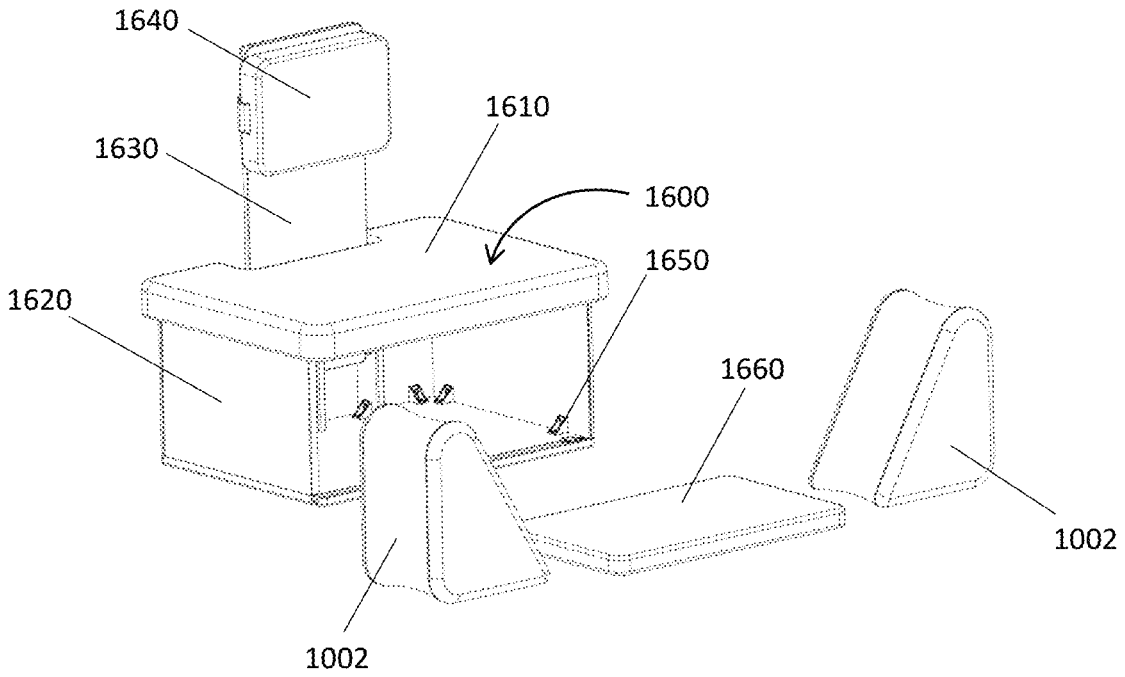
FIG. 16A illustrates a front perspective view of a seat system according to an alternative embodiment of the present invention.

FIG. 16A illustrates a front perspective view of a seat system according to an alternative embodiment of the present invention including a seat 1600, knee blocks 1002, and a mat 1660. The seat 1600 is connected to a backrest 1640 via a spine 1630. The seat 1600 includes a hollow base 1620, wherein at least one side of the base is operable to be removed, and a cushion 1610 on top of the base 1620. The hollow base 1620 is preferably a rectangular box, wherein the sides of the rectangular box are held together by L-shaped fasteners 1650. In one embodiment, the base is wood. In another embodiment, the base is plastic. The plastic includes recycled plastic in one embodiment. In one embodiment, the cushion 1610 is attached to a lid of the hollow base. The seat 1600 is operable to support the weight of a person, up to 250 pounds, or alternatively, up to 400 pounds. In one embodiment, the seat 1600 is large enough that a person can sit cross-legged on the seat 1600. In one embodiment, the size of the seat 1600 is such that part of the person's legs hang off the front of the seat 1600 when the person is seated cross-legged on the seat 1600. The knee blocks 1002 are operable to support any part of the person's legs that are not supported by the seat 1600. In one embodiment, at least one of the knee blocks 1002 is a multi-angle knee block. In one embodiment, at least one of the knee blocks 1002 is a molded knee block. In another embodiment, at least one of the knee blocks 1002 is a single knee block. In one embodiment, the seat system includes two knee blocks. In another embodiment, the seat system includes more than two (e.g., four) knee blocks. In one embodiment, the triangular face of each knee block 1002 measures about 190.5 mm tall and about 233 mm wide, and the knee block 1002 is about 152.4 mm wide. The mat 1660 measures approximately 380 mm by approximately 240 mm. The hollow base 1620 is operable to hold the mat 1660, the knee blocks 1002, the backrest 1640, and the spine 1630, thus creating a convenient storage space for the components of the seat system.

Figure 16B:
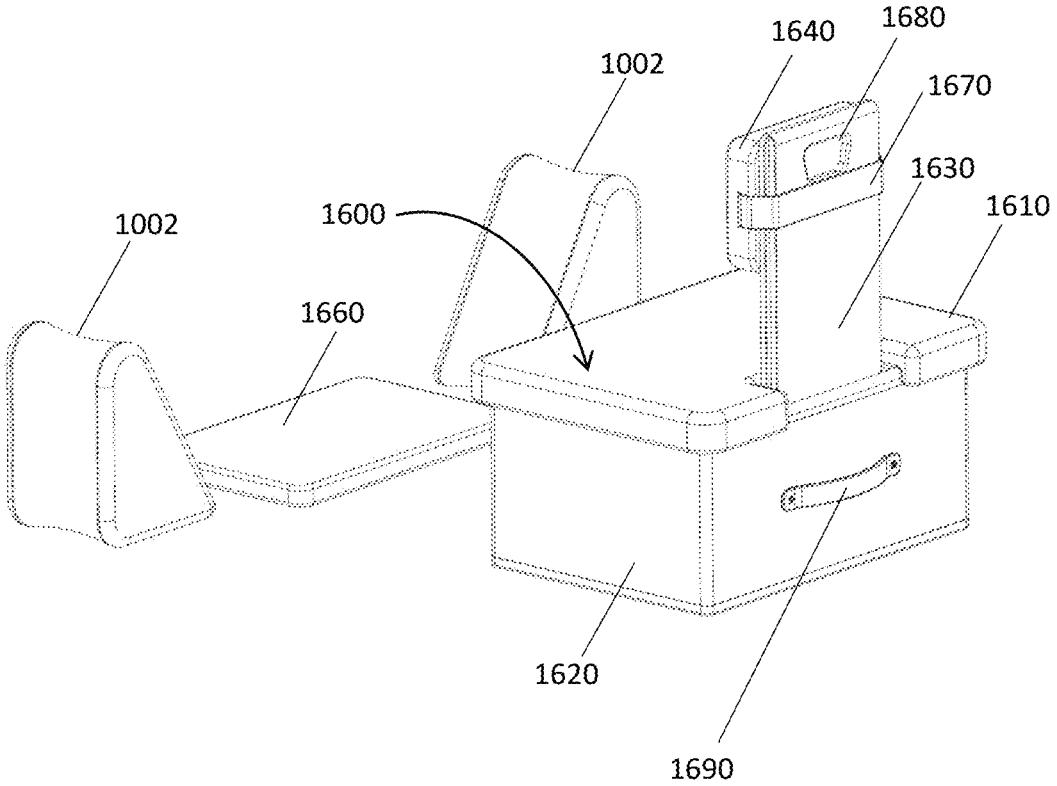
FIG. 16B illustrates a back perspective view of the seat system according to one embodiment of the present invention.

FIG. 16B illustrates a back perspective view of the seat system according to one embodiment of the present invention. The backrest 1640 is operable to be attached to the spine 1630 with a strap 1670. The backrest 1640 is operable to be removed from the spine 1630 by sliding the backrest 1640 and the strap 1670 over the top of the spine 1630. In one embodiment, the strap 1670 includes hook and loop tape (e.g., VELCRO). In another embodiment, the strap 1670 is elastic. The spine 1630 includes a cutout 1680 wherein the cutout 1680 is operable to be used for holding and/or transporting the spine 1630. The hollow base 1620 of the seat includes a handle 1690. In one embodiment, the handle 1690 is a fabric handle. In another embodiment, the handle 1690 is a plastic handle. Alternatively, the handle 1690 is a metal handle. In one embodiment, the handle 1690 is detachable from the seat system. In one embodiment, the handle 1690 is attached to the back wall of the base. In another embodiment, the handle 1690 is attached to a side wall of the base. The handle 1690 is operable to be used for carrying the seat system when the knee blocks 1002, the backrest 1640, the mat 1660, and the spine 1630 are held by the hollow base 1620.

Figure 17A:
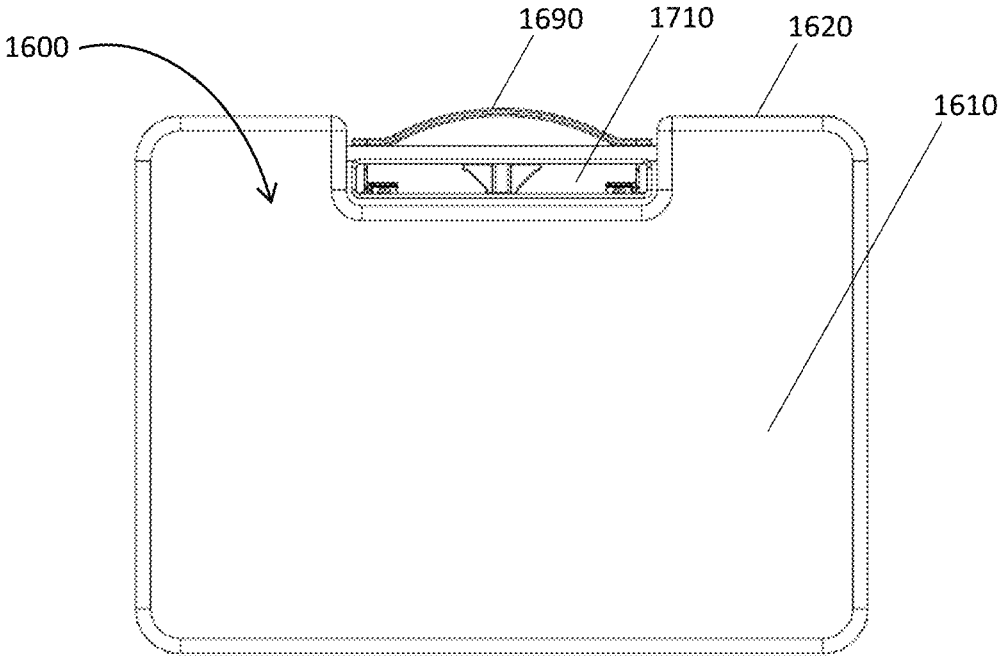
FIG. 17A illustrates a top orthogonal view of the seat according to one embodiment of the present invention.
Figure 17B:
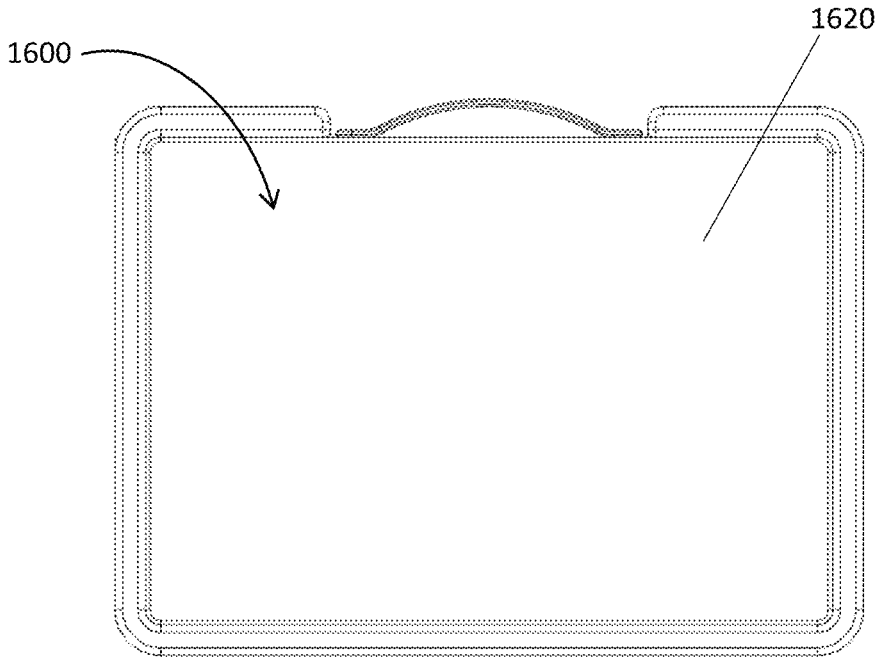
FIG. 17B illustrates a bottom orthogonal view of the seat according to one embodiment of the present invention.

FIG. 17A illustrates a top orthogonal view of the seat 1600 according to one embodiment of the present invention including the handle 1690. The back wall of the base 1620 includes an opening 1710, wherein the opening 1710 is operable to hold the spine. The cushion 1610 includes a cutout to fit around the opening 1710. The opening 1710 is about 215 mm wide. FIG. 17B illustrates a bottom orthogonal view of the seat 1600 according to one embodiment of the present invention. The opening 1710 in the back wall does not extend through the bottom of the base 1620.

Figure 18A:
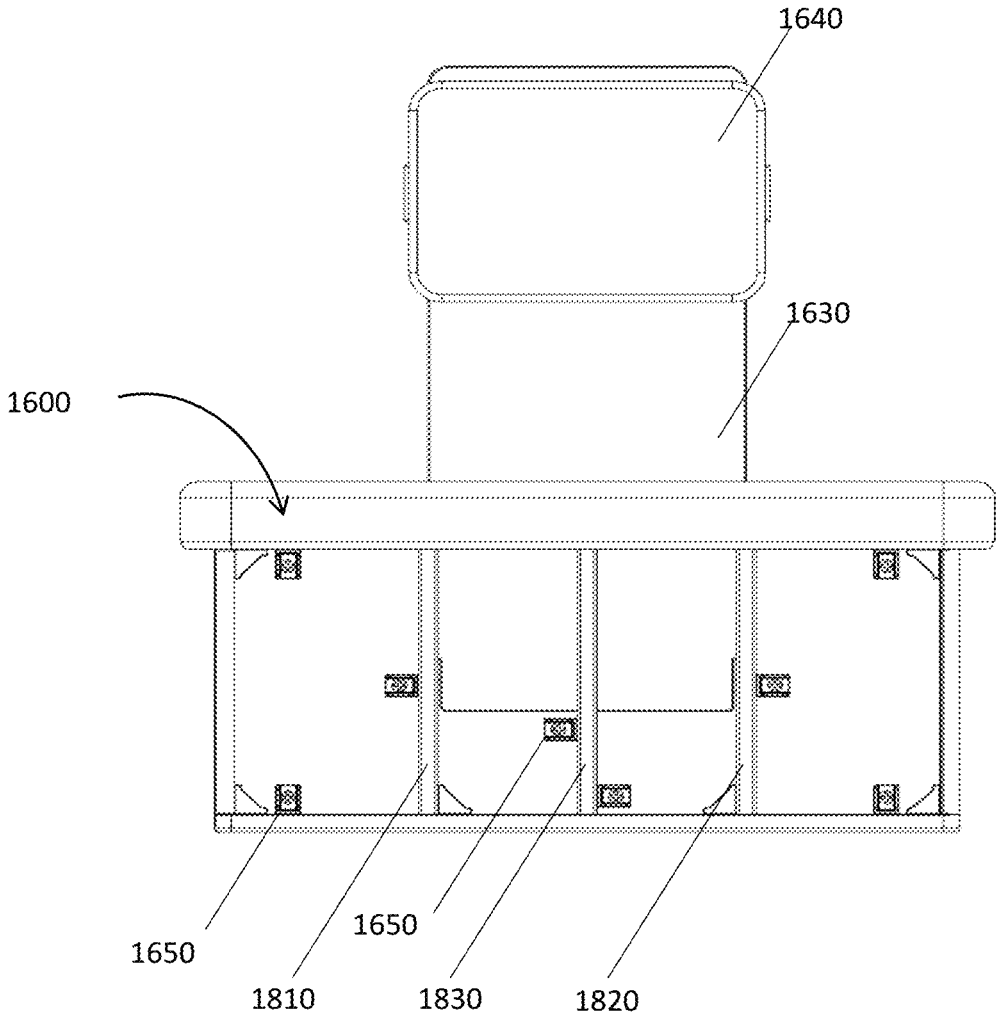
FIG. 18A illustrates a front orthogonal view of the seat system including the seat, the spine, and the backrest according to one embodiment of the present invention.

FIG. 18A illustrates a front orthogonal view of the seat system including the seat 1600, the spine 1630, and the backrest 1640 according to one embodiment of the present invention. The spine 1630 is inserted into the opening in the back wall of the base 1620. The opening includes at least two rails affixed to the back wall such that the two rails are parallel to the back wall. The distance between the first rail 1810 and the second rail 1820 is approximately the width of the spine. In one embodiment, the bottom of the spine rests on at least one L-shaped fastener 1650 when the spine is inserted in between the two rails. In another embodiment, the bottom of the spine rests on a bracket when the spine is inserted in between the two rails. In yet another embodiment, the bottom of the spine rests on a flat shelf when the spine is inserted between the two rails. In one embodiment, the opening further includes a third rail 1830 wherein the third rail 1830 is affixed to the back wall parallel to the first rail 1810 and the second rail 1820 and approximately equidistant between the first rail 1810 and the second rail 1820. In one embodiment, the spine 1630 includes a center groove, wherein the groove fits around the third rail 1830. The rails hold the spine 1630 in place when it is inserted into the opening such that the spine 1630 does not move from side to side. The rails are affixed to the back wall using L-shaped fasteners 1650. The rails are preferably the same material as the base 1620. The height of the seat system when the spine 1630 is inserted into the opening is approximately 520 mm. The spine 1630 is about 215 mm wide and about 450 mm tall. The backrest 1640 is approximately 150 mm tall and approximately 192 mm wide.

Figure 18B:
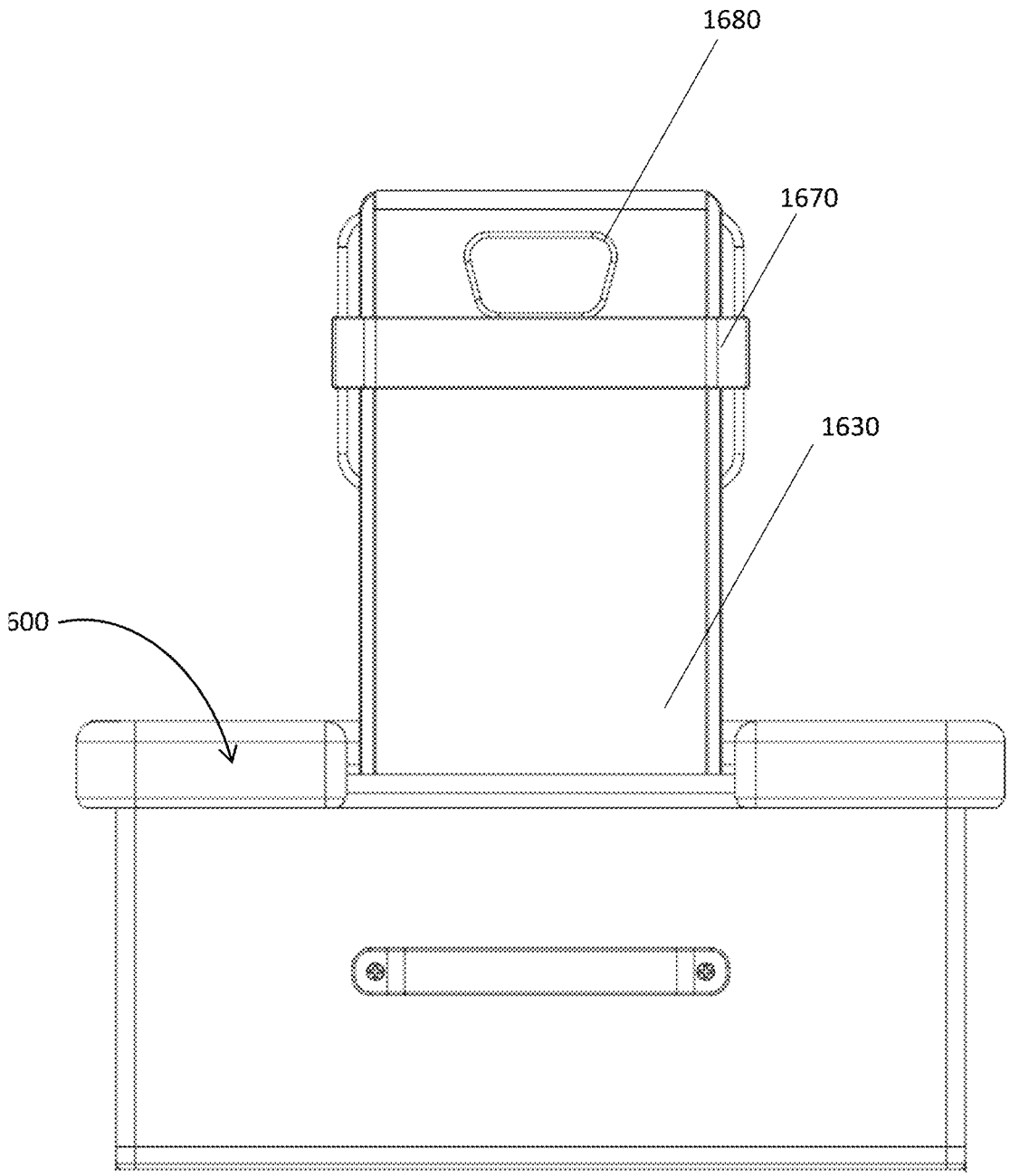
FIG. 18B illustrates a back orthogonal view of the seat system according to one embodiment of the present invention.
Figure 18C:
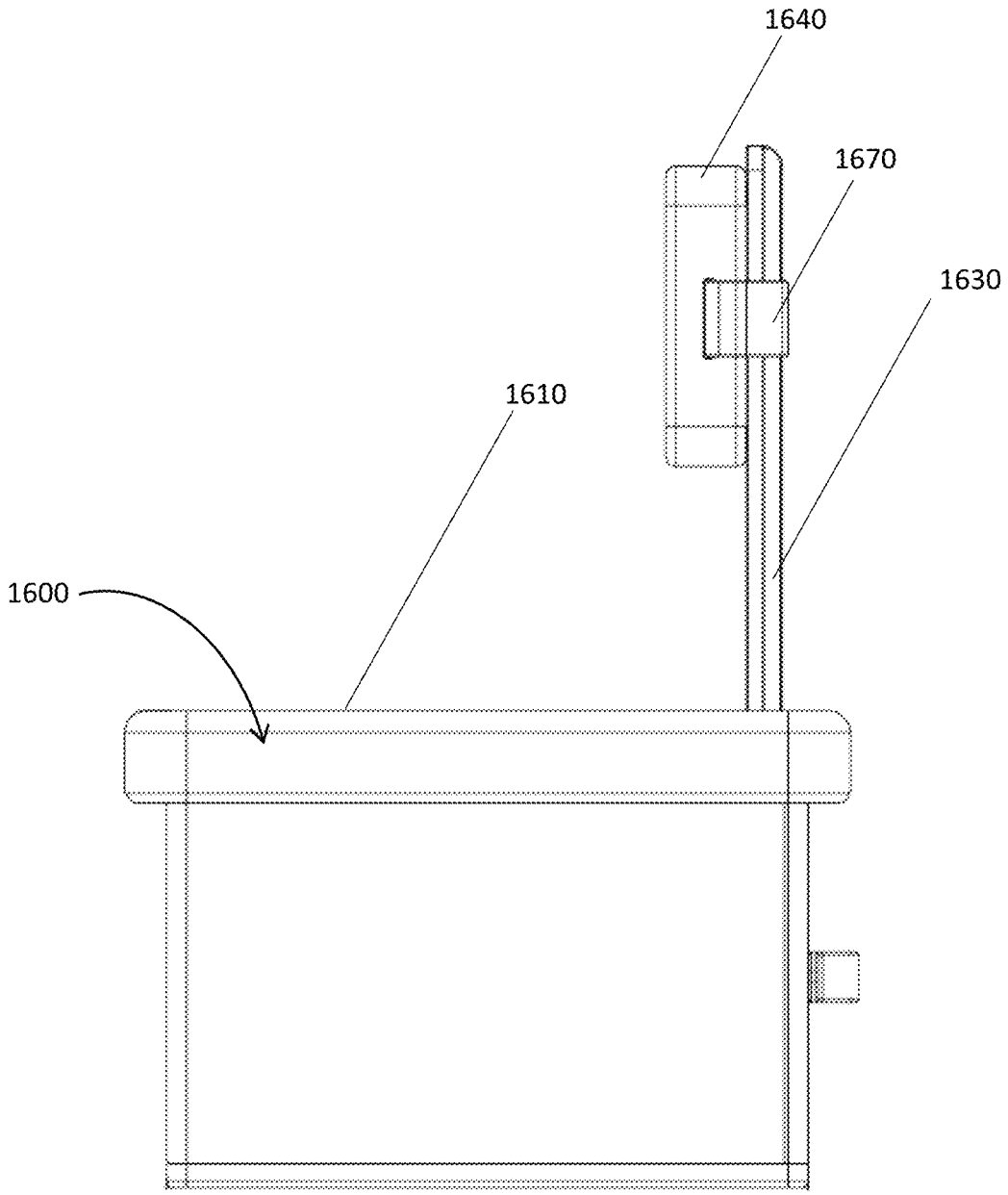
FIG. 18C illustrates a side orthogonal view of the seat system according to one embodiment of the present invention.

FIG. 18B illustrates a back orthogonal view of the seat system 1600 according to one embodiment of the present invention. The spine 1630 is inserted into the seat and the backrest 1640 is attached to the spine via the strap 1670. The spine 1630 is preferably centered along the back wall of the seat. FIG. 18C illustrates a side orthogonal view of the seat system 1600 according to one embodiment of the present invention. The spine 1630 is inserted into the seat 1600 such that the spine 1630 and the cushion 1610 are approximately perpendicular to each other. Advantageously, this position provides support for the user to sit straight without arching their back.

Figure 19A:
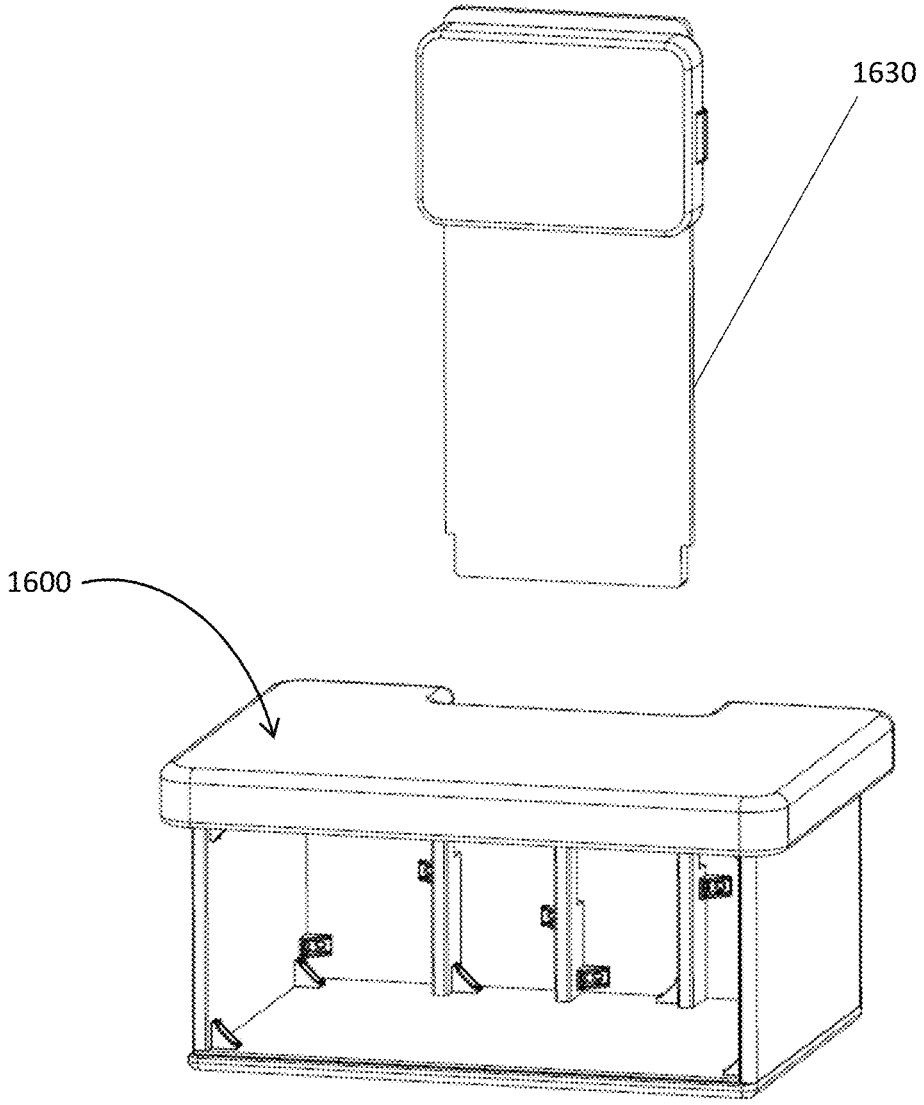
FIG. 19A illustrates a front perspective view of the seat system according to one embodiment of the present invention.
Figure 19B:
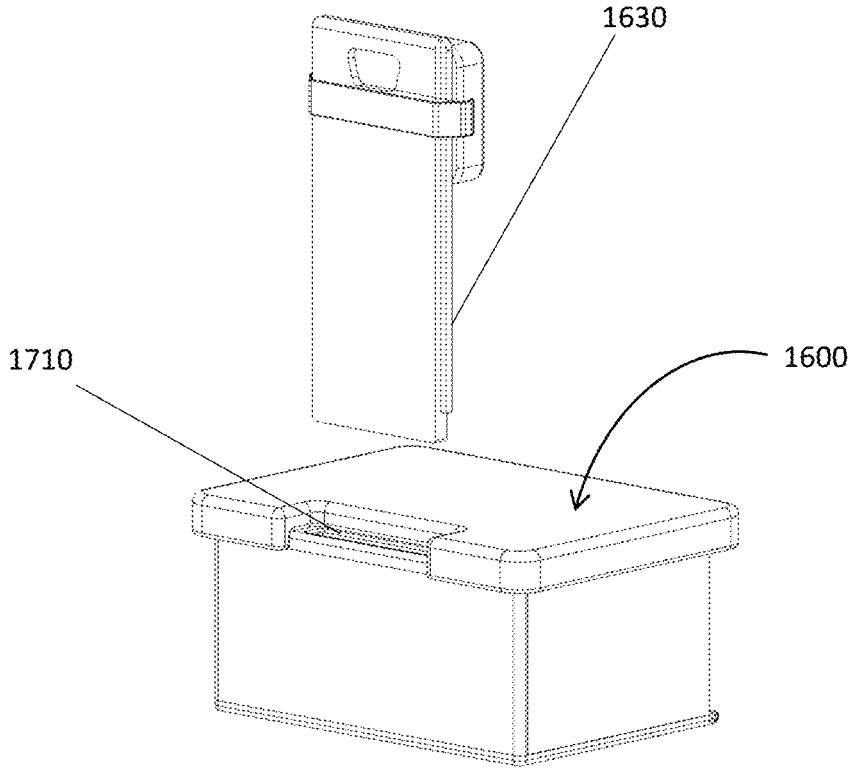
FIG. 19B illustrates a back perspective view of the seat system according to one embodiment of the present invention.
Figure 19C:
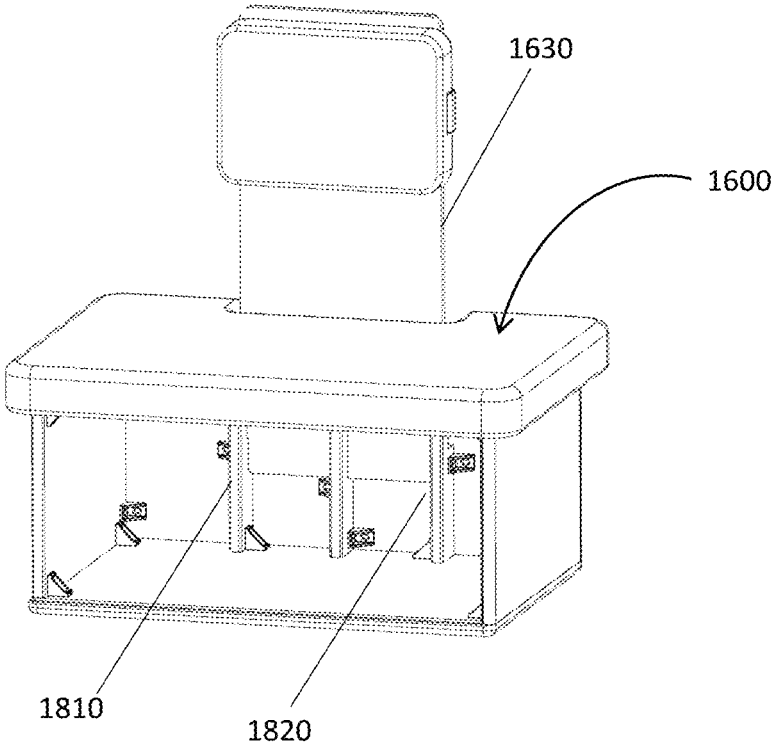
FIG. 19C illustrates a front perspective view of the seat system according to one embodiment of the present invention.

FIG. 19A illustrates a front perspective view of the seat system according to one embodiment of the present invention wherein the spine 1630 is being inserted into the seat 1600. The spine 1630 stands straight when inserted into the seat. FIG. 19B illustrates a back perspective view of the seat system according to one embodiment of the present invention wherein the spine 1630 being inserted into the seat 1600. The opening 1710 is approximately the same width as the spine 1630 such that the spine 1630 fits securely into the opening 1710. FIG. 19C illustrates a front perspective view of the seat system according to one embodiment of the present invention wherein the spine 1630 is inserted into the seat 1600. The spine 1630 is inserted between the first rail 1810 and the second rail 1820.

Figure 20:
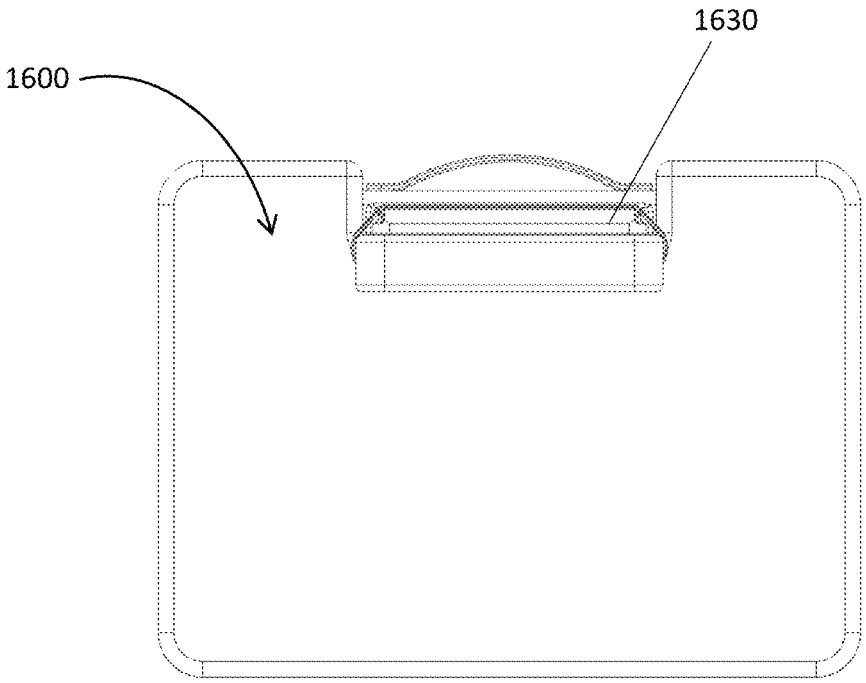
FIG. 20 illustrates a top orthogonal view of the seat system according to one embodiment of the present invention.

FIG. 20 illustrates a top orthogonal view of the spine 1630 inserted into the seat 1600 according to one embodiment of the present invention. The spine 1630 stands straight when inserted into the seat, and is perpendicular to the seat when inserted into the seat.

Figure 21A:
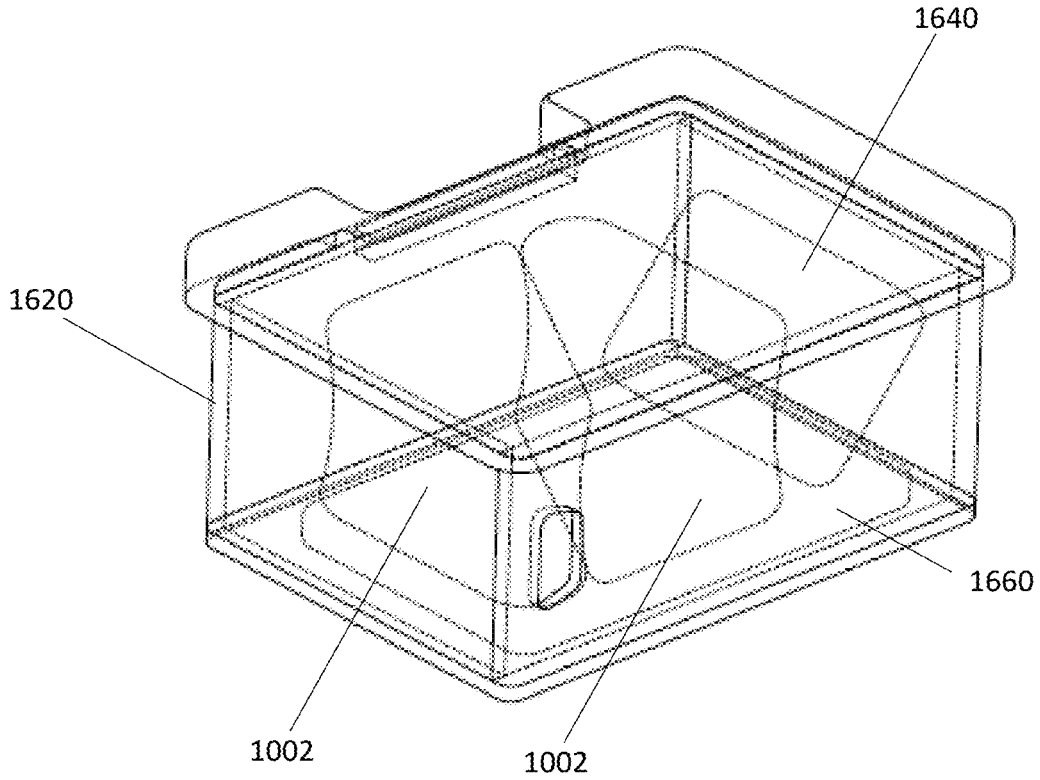
FIG. 21A illustrates a front perspective transparent view of a collapsed state of the seat system according to one embodiment of the present invention.
Figure 21B:
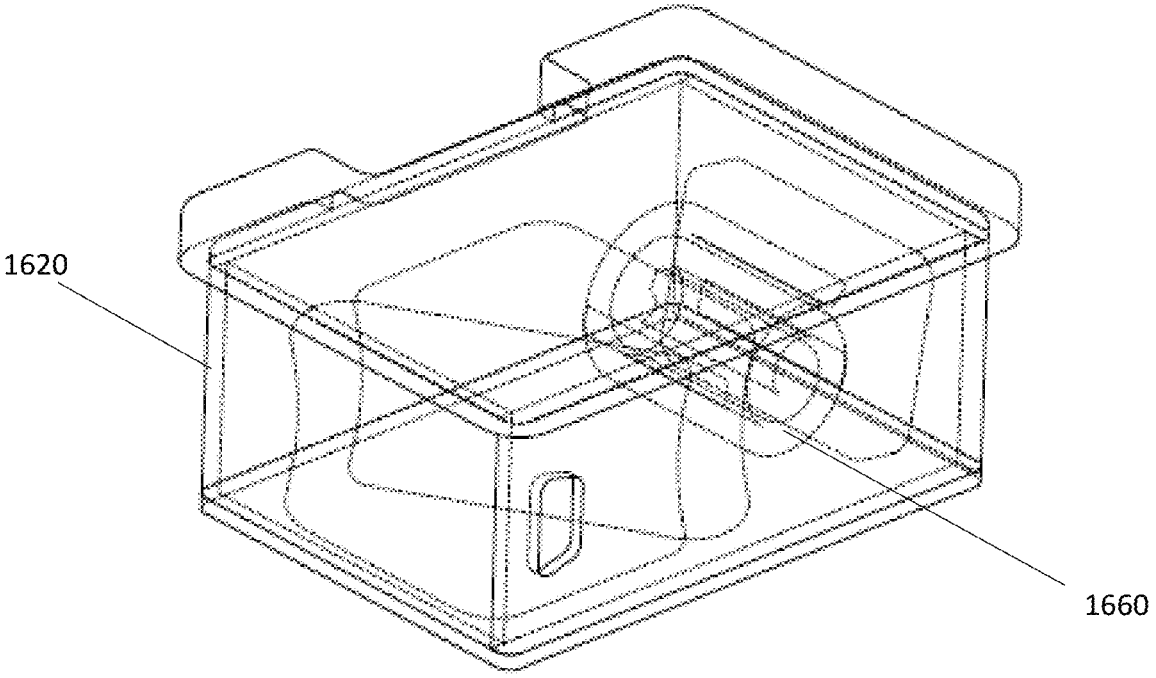
FIG. 21B illustrates a front perspective transparent view of a collapsed state of the seat system according to an alternative embodiment of the present invention.

FIG. 21A illustrates a front perspective transparent view of a collapsed state of the seat system according to one embodiment of the present invention. The hollow base 1620 of the seat system is operable to contain the backrest 1640, the knee blocks 1002, and the mat 1660 of the seat system. The mat 1660 lies flat inside the base 1620. In one embodiment, the knee blocks 1002 are stacked to fit inside the base 1620, either on top of the mat 1660 or directly on top of the bottom inner surface of the base 1620. Because the knee blocks 1002 are approximately triangles, they are operable to be stacked to form a rectangle. FIG. 21B illustrates a front perspective transparent view of a collapsed state of the seat system according to an alternative embodiment of the present invention wherein the mat 1660 is rolled to fit inside the base 1620. The dimensions of the base 1620 minimize empty space when the backrest 1640, the knee blocks 1002, and the mat 1660 are placed inside the base 1620 while still providing enough surface area for a user to sit comfortably on the cushion.

Figure 22A:
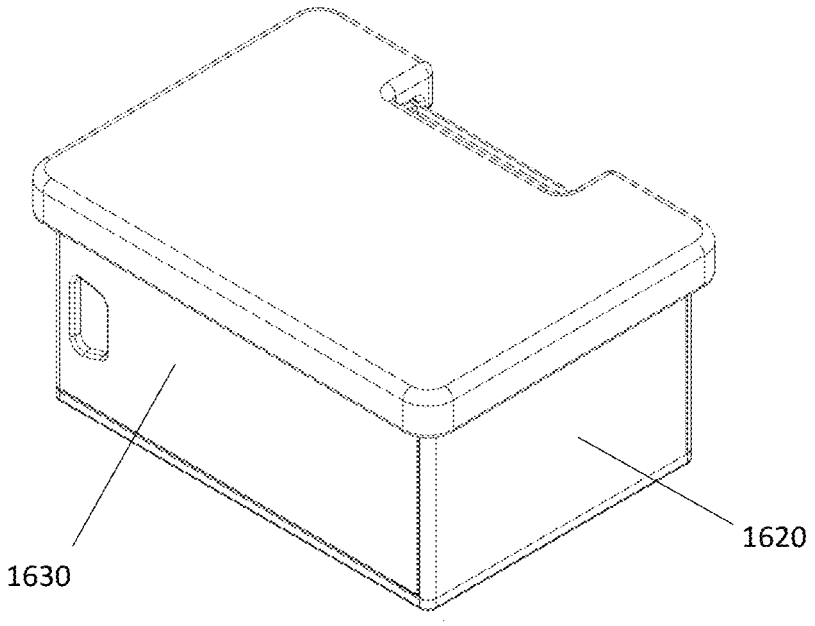
FIG. 22A illustrates a front perspective view of a collapsed state of the seat system according to one embodiment of the present invention.
Figure 22B:
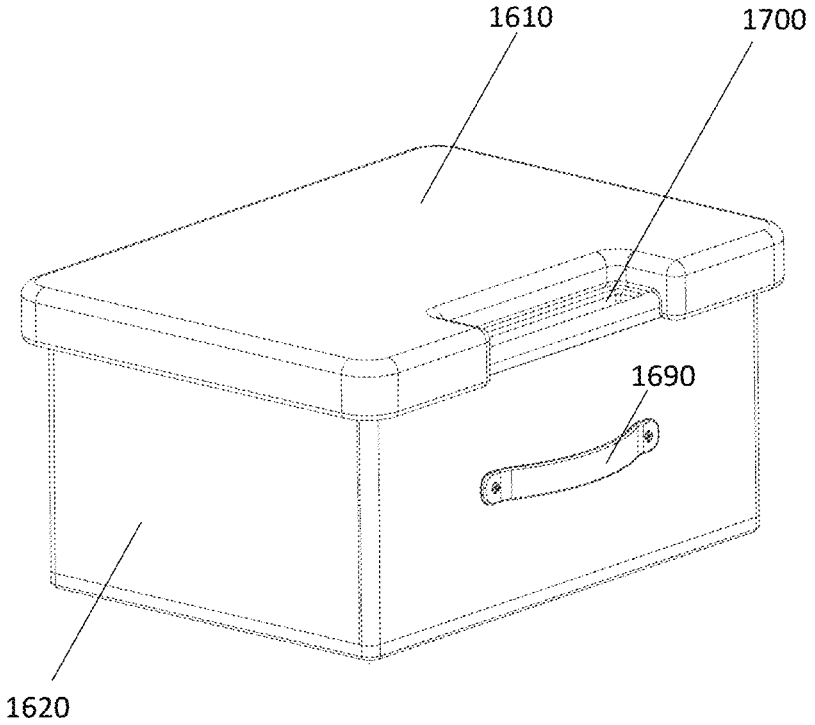
FIG. 22B illustrates a back perspective view of a collapsed state of the seat system according to one embodiment of the present invention.

FIG. 22A illustrates a front perspective view of a collapsed state of the seat system according to one embodiment of the present invention. In this embodiment, the spine 1630 is the front wall of the base 1620. The top wall, or the lid, of the base includes a top groove. The bottom wall of the base includes a bottom groove. The spine 1630 is operable to slide between the top groove and the bottom groove such that the spine 1630 is held in place as the front wall of the base 1620. FIG. 22B illustrates a back perspective view of a collapsed state of the seat system according to one embodiment of the present invention. When the seat system is held by the handle 1690, the spine is still held in place as the front wall of the base 1620. The seat system is easily transportable in the collapsed state. The opening 1710 in the back wall is left open when the seat system is in the collapsed state. However, the opening 1710 is small enough that none of the components of the seat system fall through the opening when the seat system is transported.

Figure 23A:
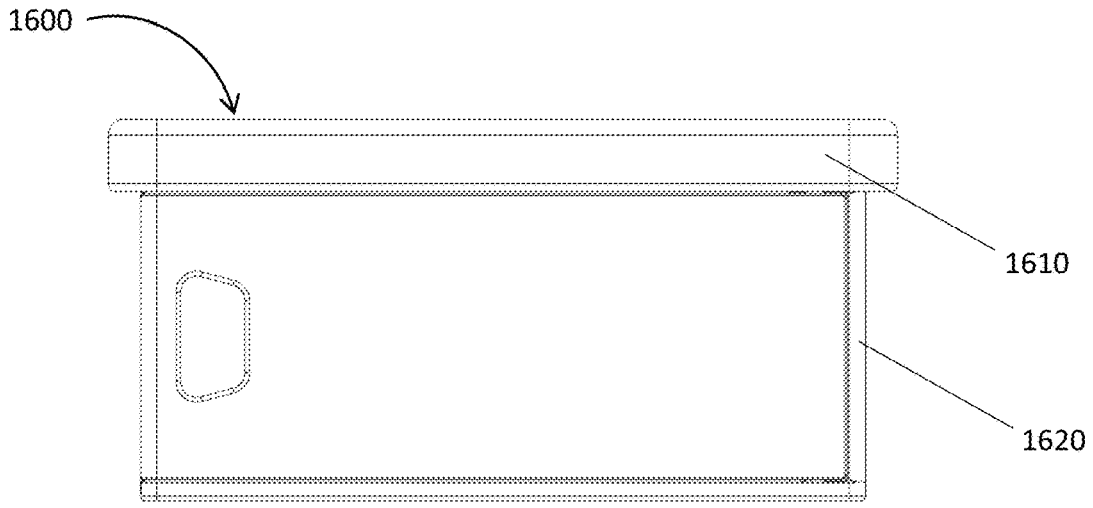
FIG. 23A illustrates a front orthogonal view of a collapsed state of the seat system according to one embodiment of the present invention.
Figure 23B:
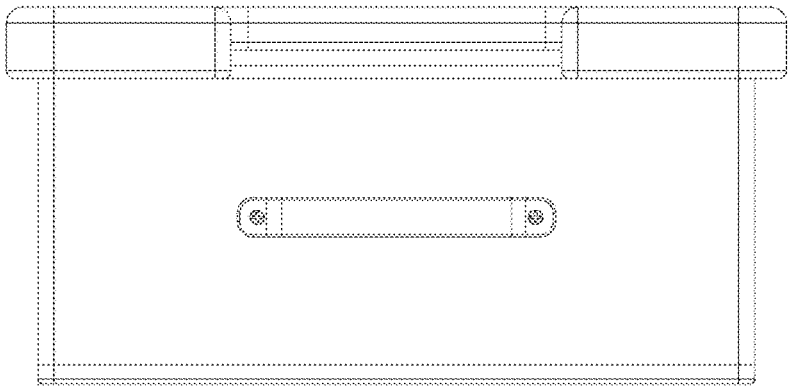
FIG. 23B illustrates a back orthogonal view of a collapsed state of the seat system according to one embodiment of the present invention.
Figure 23C:
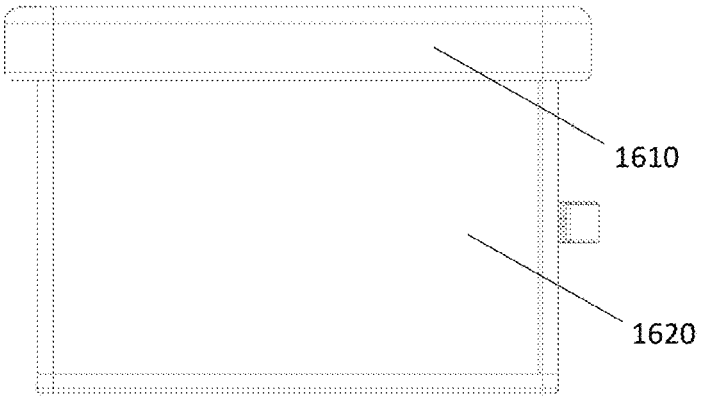
FIG. 23C illustrates a side orthogonal view of a collapsed state of the seat system according to one embodiment of the present invention.

FIG. 23A illustrates a front orthogonal view of a collapsed state of the seat system according to one embodiment of the present invention. The cushion measures approximately 490 mm by 360 mm. The cushion 1610 is wider than the base 1620 of the seat. The front wall and the back wall of the base 1620 are each approximately 450 mm in width. The height of the seat 1600 including the cushion 1610 is approximately 234 mm. FIG. 23B illustrates a back orthogonal view of a collapsed state of the seat system according to one embodiment of the present invention. FIG. 23C illustrates a side orthogonal view of a collapsed state of the seat system according to one embodiment of the present invention. The width of the side wall of the base 1620 is approximately 320 mm.

Figure 24A:
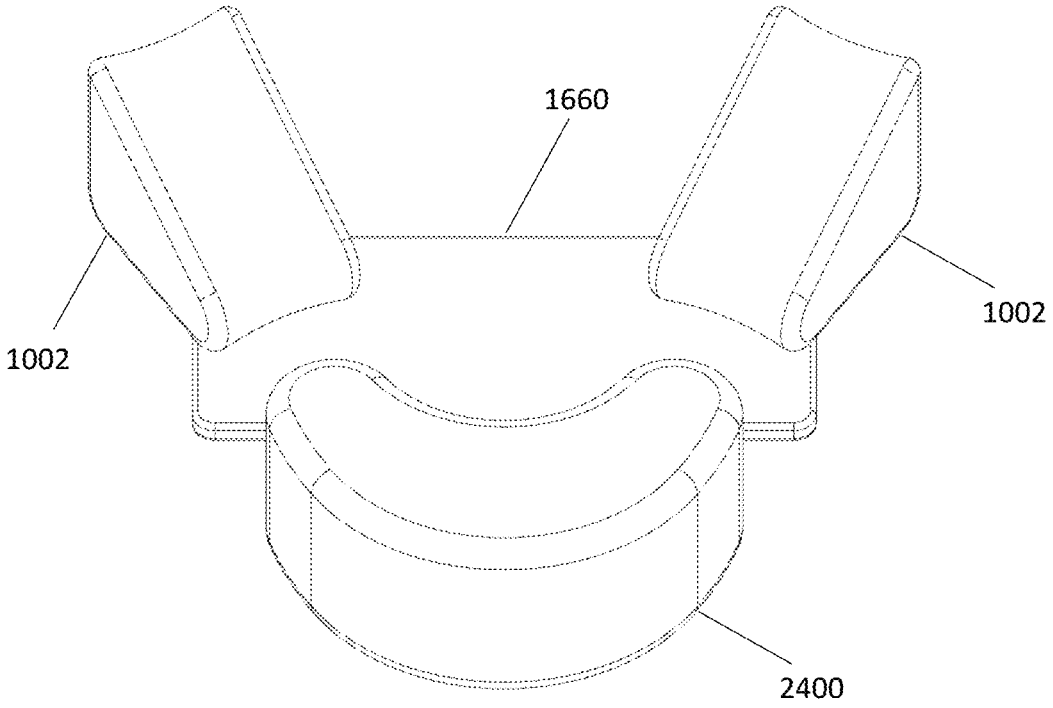
FIG. 24A illustrates a top perspective view of an alternative embodiment of the meditation system of the present invention.
Figure 24B:
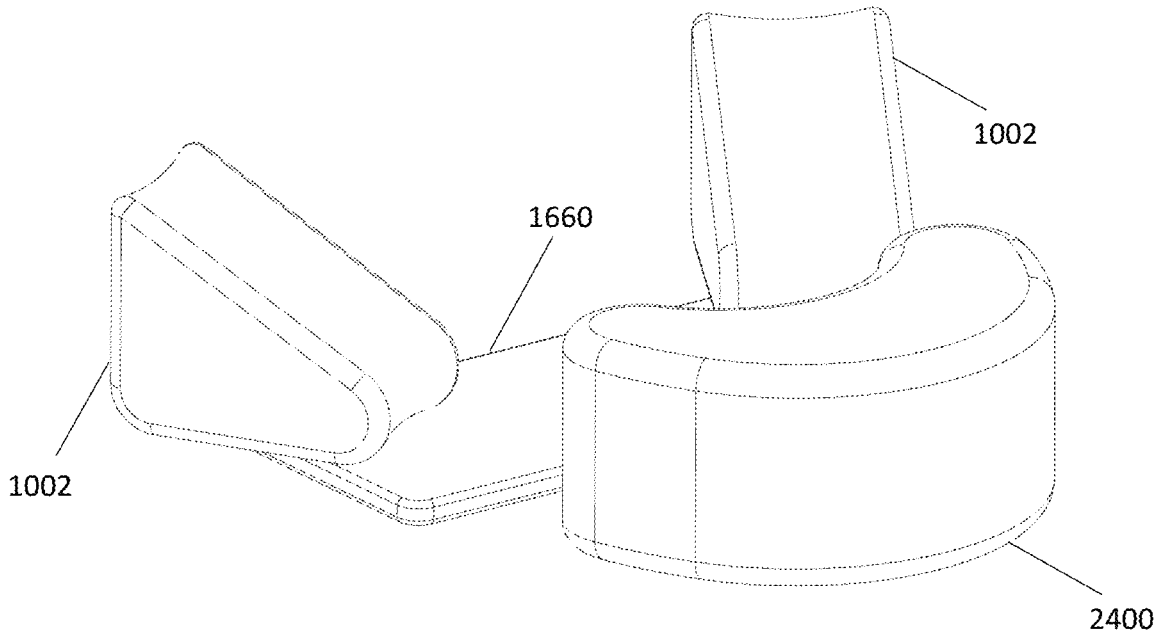
FIG. 24B illustrates a side perspective view of an alternative embodiment of the meditation system of the present invention.
Figure 24C:
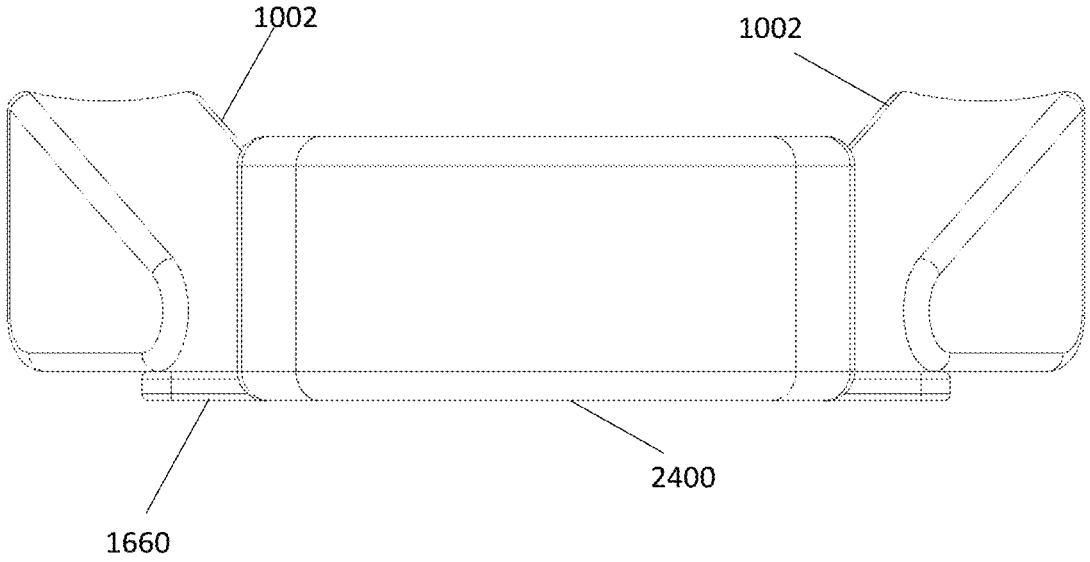
FIG. 24C illustrates a back orthogonal view of an alternative embodiment of the meditation system of the present invention.

FIG. 24A illustrates a top perspective view of an alternative embodiment of the meditation system of the present invention including knee blocks 1002, a mat 1660, and a seat 2400. In one embodiment, the seat 2400 is in the shape of a wide crescent. In another embodiment, the seat 2400 is a semi-circle. The knee blocks 1002 are operable to support a part of a user's body that is not supported by the seat 2400. In one embodiment, at least one of the knee blocks 1002 is a multi-angle knee block. In another embodiment, at least one of the knee blocks 1002 is a single knee block. FIG. 24B illustrates a side perspective view of an alternative embodiment of the meditation system of the present invention including knee blocks 1002, a mat 1660, and a seat 2400. The knee blocks 1002 are operable to be placed on the mat 1660 approximately equidistant from the seat 2400. The mat 1660 is operable to prevent the knee blocks 1002 from moving when pressure is applied to the knee blocks 1002. FIG. 24C illustrates a back orthogonal view of an alternative embodiment of the meditation system of the present invention. The knee blocks 1002 are taller than the seat 2400. In this embodiment, the knee blocks 1002 are positioned wider than the width of the seat 2400.

Figure 25A:
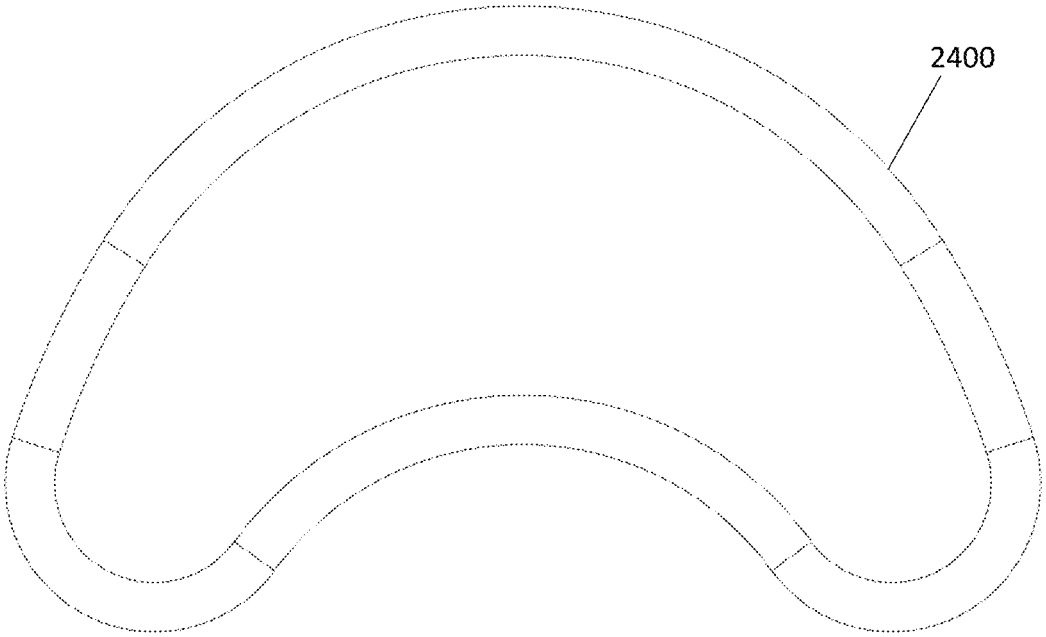
FIG. 25A illustrates a top orthogonal view of the seat according to one embodiment of the present invention.
Figure 25B:
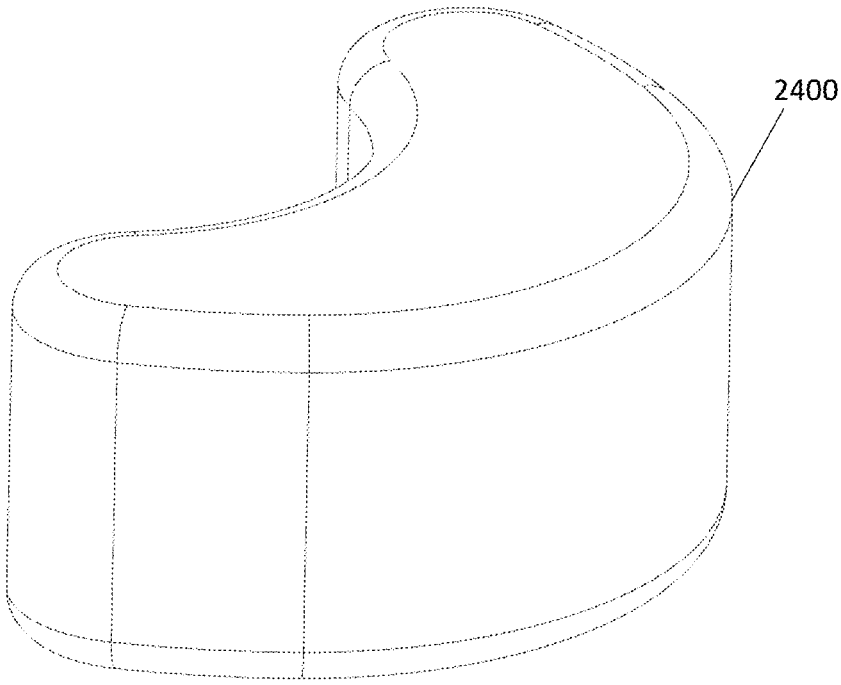
FIG. 25B illustrates a side perspective view of the seat according to one embodiment of the present invention.

FIG. 25A illustrates a top orthogonal view of the seat 2400 according to one embodiment of the present invention. The seat 2400 is advantageously compact and can be easily positioned and moved for better comfort. The seat 2400 is operable to support the weight of a person, up to 250 pounds, or alternatively, up to 400 pounds. In one embodiment, the seat 2400 is large enough that a person can sit cross-legged on the seat 2400. In one embodiment, the size of the seat 2400 is such that part of the person's legs hang off the front of the seat 2400 when the person is seated cross-legged on the seat 2400. In one embodiment, the seat 2400 is approximately 180 mm tall and approximately 420 mm wide. In an embodiment wherein the seat 2400 is a crescent shape, the length of each crescent arm is approximately 254 mm. FIG. 25B illustrates a side perspective view of the seat 2400 according to one embodiment of the present invention. In one embodiment, the seat 2400 has rounded edges. Alternatively, the seat 2400 has non-rounded edges. In an alternative embodiment, the seat 2400 is operable to be used as a backrest. For example, the seat 2400 is operable to support a user's back when the user is seated in front of the seat 2400. In another embodiment, the seat 2400 is operable to be used as a backrest when the user is kneeling.

Figure 26A:
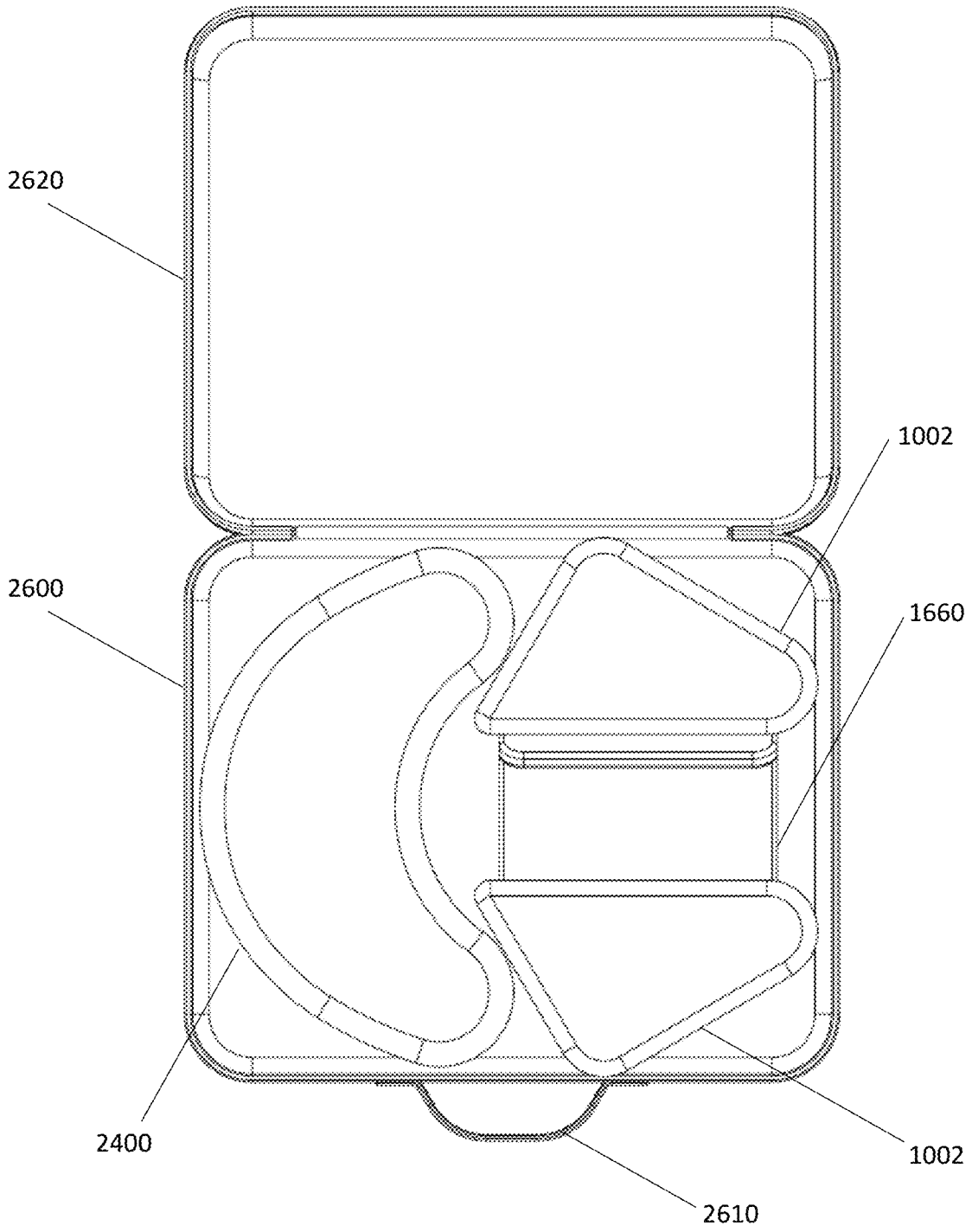
FIG. 26A illustrates a top orthogonal view of an embodiment of the meditation system of the present invention in a collapsed state.
Figure 26B:
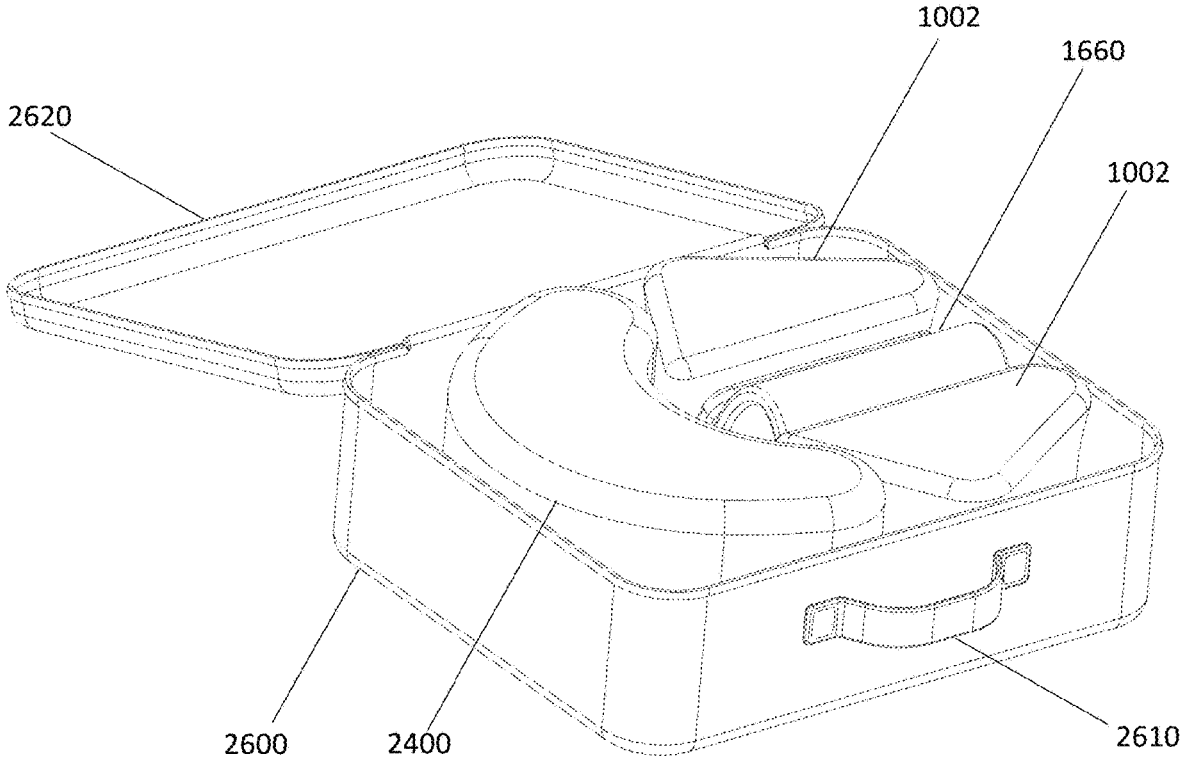
FIG. 26B illustrates a top perspective view of an embodiment of the meditation system of the present invention in a collapsed state.

FIG. 26A illustrates a top orthogonal view of an embodiment of the meditation system of the present invention in a collapsed state. The meditation system includes at least one knee block 1002, a mat 1660, and a seat 2400. The knee block 1002, the mat 1660, and the seat 2400 are operable to fit inside a carrying case 2600. In one embodiment, the carrying case 2600 includes a handle 2610. In another embodiment, the carrying case 2600 includes at least one strap and is operable to be carried on a user's back. In one embodiment, the carrying case 2600 is approximately a rectangle. The carrying case 2600 includes a cover 2620, wherein the cover 2620 is attached to the carrying case via a zipper that runs along at least three sides of the cover. In one embodiment, the carrying case 2600 further includes hook and loop tape (e.g. VELCRO) and/or a fastener to secure the cover 2620. FIG. 26B illustrates a top perspective view of an embodiment of the meditation system of the present invention in a collapsed state. In one embodiment, the mat 1660 is rolled up to fit inside the carrying case 2600 with the knee blocks 1002 and the seat 2400. In another embodiment, the mat 1660 is operable to be placed flat inside the carrying case 2600.

Figure 27A:
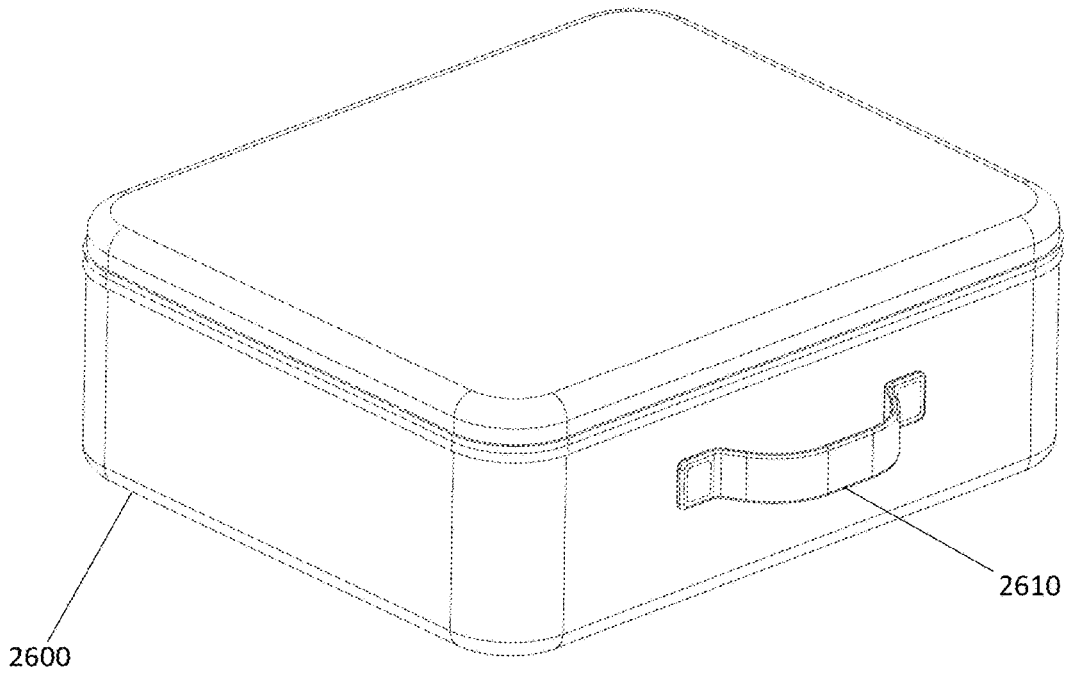
FIG. 27A illustrates a top perspective view of an embodiment of the meditation system of the present invention in a collapsed state.
Figure 27B:
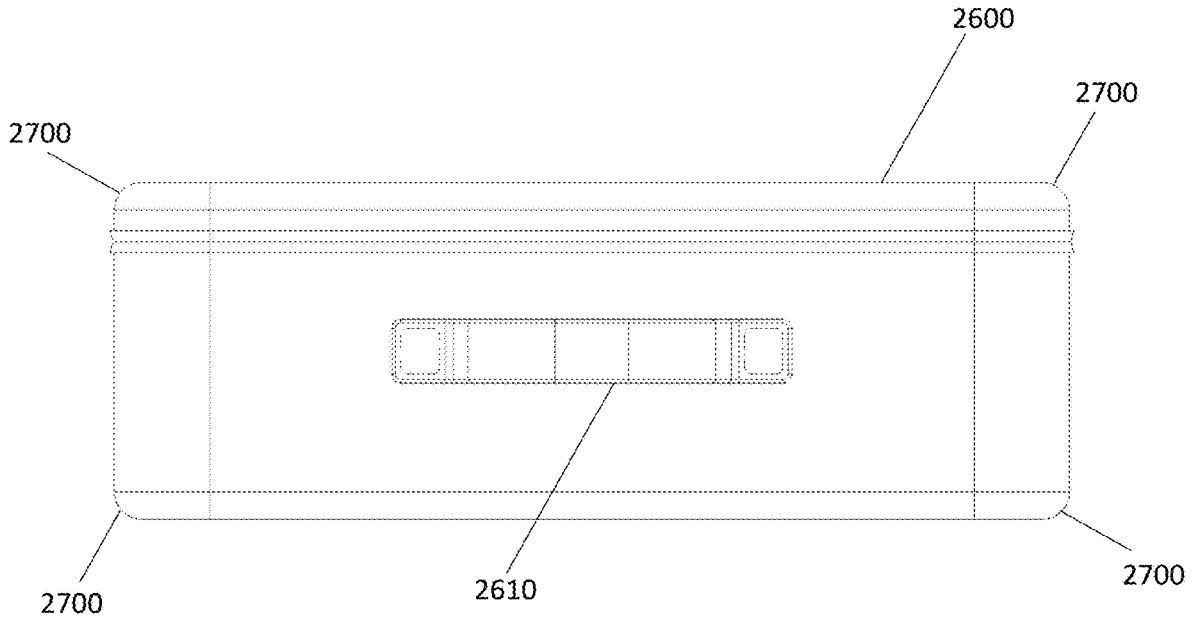
FIG. 27B illustrates a front orthogonal view of an embodiment of the meditation system of the present invention in a collapsed state.

FIG. 27A illustrates a top perspective view of an embodiment of the meditation system of the present invention in a collapsed state. The cover 2620 of the carrying case 2600 is closed. In one embodiment, the carrying case measures approximately 507 mm by approximately 435 mm by approximately 190 mm wherein the height is approximately 190 mm. In one embodiment, the handle is approximately 200 mm long and approximately 18 mm from the top of the carrying case. FIG. 27B illustrates a front orthogonal view of an embodiment of the meditation system of the present invention in a collapsed state. In one embodiment, the handle 2610 is a fabric handle. In another embodiment, the handle 2610 is a plastic handle. Alternatively, the handle 2610 is a metal handle. In one embodiment, the handle 2610 includes a grip. In one embodiment, the handle 2610 is detachable from the carrying case 2600. In one embodiment, the carrying case 2600 is a firm-walled case. In one embodiment, the carrying case 2600 is made of a plastic polymer, e.g. polycarbonate, polypropylene, polyvinyl chloride (PVC), and/or acrylonitrile butadiene styrene (ABS). In another embodiment, the carrying case 2600 is made of metal, e.g. aluminum. In one embodiment, the carrying case 2600 includes inserts, wherein the inserts are operable to make the walls of the carrying case 2600 stiff. In one embodiment, the inserts include cardboard. Alternatively, the inserts are fabric inserts. In another embodiment, the inserts include plastic. In yet another embodiment, the inserts include foam. In one embodiment, the corners 2700 of the carrying case 2600 are rounded. The carrying case 2600 is operable to stand upright (e.g. on its smallest face) when closed.

Figure 28A:
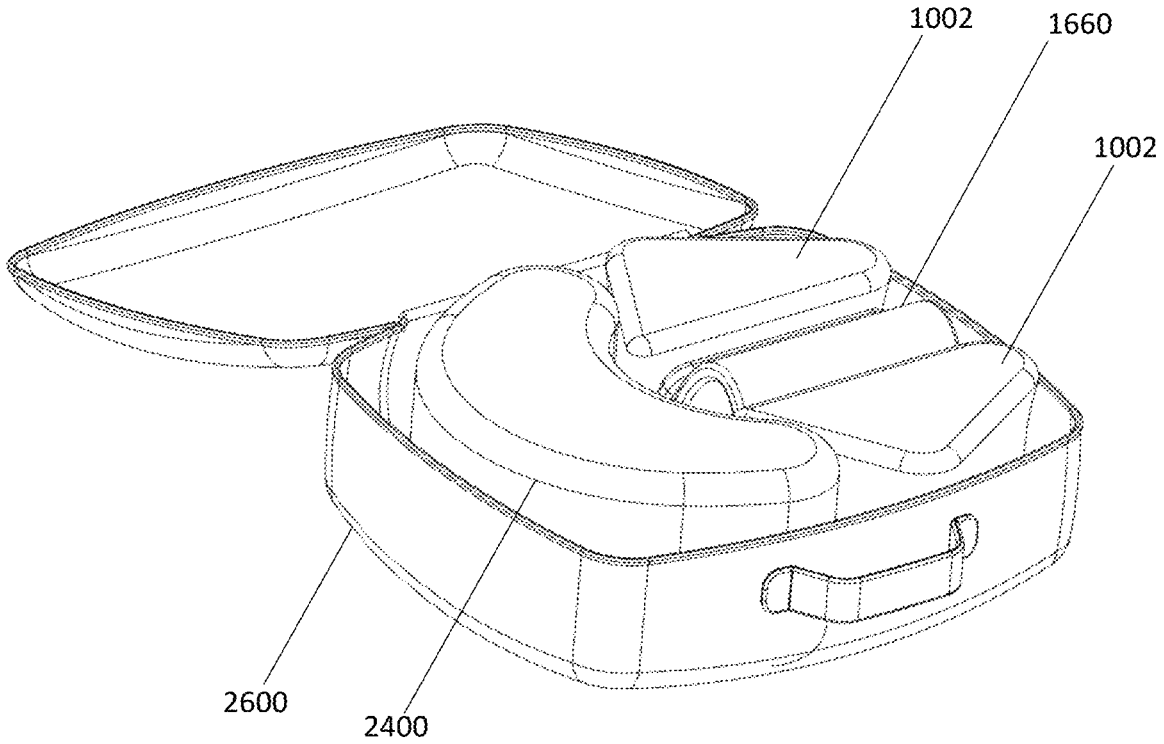
FIG. 28A illustrates a top perspective view of an alternative embodiment of the meditation system of the present invention in a collapsed state.
Figure 28B:
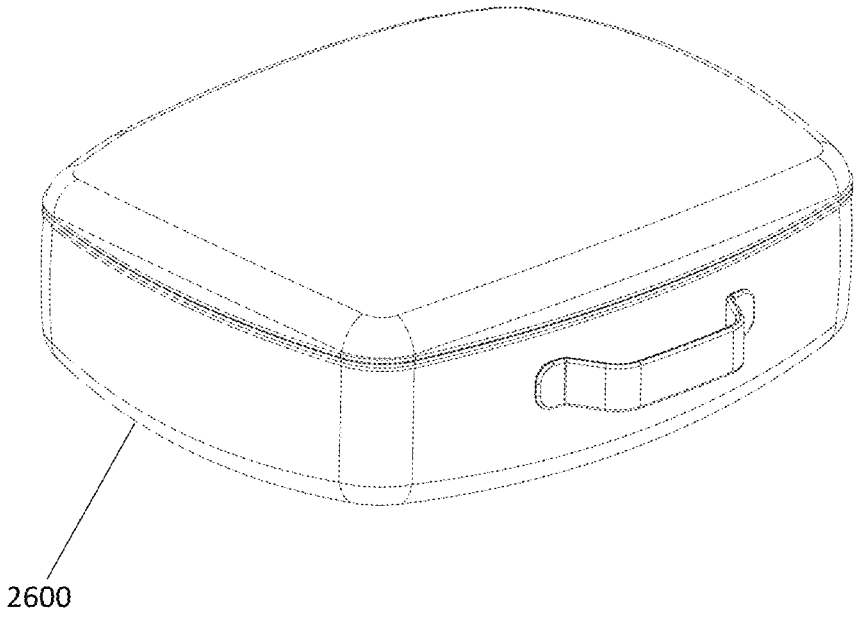
FIG. 28B illustrates a top perspective view of an embodiment of the meditation system of the present invention in a collapsed state.
Figure 28C:
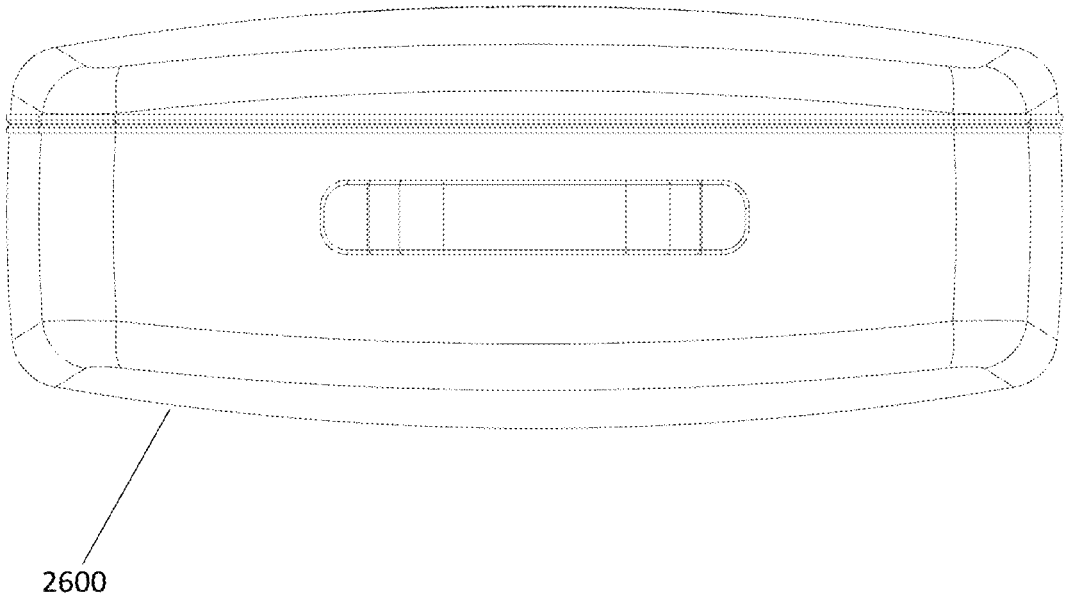
FIG. 28C illustrates a front orthogonal view of an embodiment of the meditation system of the present invention in a collapsed state.

FIG. 28A illustrates a top perspective view of an alternative embodiment of the meditation system of the present invention in a collapsed state wherein the carrying case 2600 is a soft-walled carrying case. The carrying case 2600 is operable to contain the knee blocks 1002, the mat 1660, and the seat 2400. In one embodiment, the carrying case 2600 is made of fabric, e.g. nylon, polyester, canvas, leather, cotton, jute, and/or vinyl. In one embodiment, the carrying case 2600 is made of a stretchable fabric. In one embodiment, the carrying case 2600 is water-resistant. Alternatively, the carrying case 2600 is waterproof. FIG. 28B illustrates a top perspective view of an embodiment of the meditation system of the present invention in a collapsed state wherein the carrying case 2600 is closed. FIG. 28C illustrates a front orthogonal view of an embodiment of the meditation system of the present invention in a collapsed state wherein the carrying case 2600 is closed. The material of the carrying case 2600 is flexible to allow the walls of the carrying case 2600 to conform to the shape of the contents.

The above-mentioned examples are provided to serve the purpose of clarifying the aspects of the invention, and it will be apparent to one skilled in the art that they do not serve to limit the scope of the invention. By nature, this invention is highly adjustable, customizable and adaptable. For example, other attachment mechanisms are utilized instead of magnets for removably attaching components such as the discs and the disc indentations including friction-based locking, hook and loop tape (e.g. VELCRO), etc. These attachment mechanisms are also operable to be utilized in the knee blocks instead of magnets and magnetic discs. Similarly, one or more components described in the present application are operable to be utilized separately from other components of the present invention. As one example, the knee blocks of the present invention are also operable to be utilized separately to provide hip support for users sitting in a cross-legged position. By way of example, use of the knee blocks on the ground or on the floor would cause the angles of the sides of the knee blocks described above in relation to the base of the seat assembly system to be in relation to the ground or the floor instead of the base of the seat system. In another non-limiting example, the knee blocks are operable to be used to provide back support for users to sit with their backs against the knee blocks. The above-mentioned examples are just some of the many configurations that the mentioned components can take on. All modifications and improvements have been deleted herein for the sake of conciseness and readability but are properly within the scope of the present invention.

What is claimed is:

1. A portable meditation system, comprising:
at least two knee blocks;
a seat; and
wherein the entirety of the seat is crescent-shaped;
wherein two parallel faces of each of the at least two knee blocks are flat and include at least two rounded interior corners;
wherein each of the at least two rounded interior corners includes a different interior angle; and
wherein the at least two knee blocks provide support for knees and hips of a user in a cross-legged position.

2. The portable meditation system of claim 1, wherein at least two edges joining the two parallel faces of each of the at least two knee blocks are concave relative to a perpendicular plane between the two parallel faces of each of the at least two knee blocks.

3. The portable meditation system of claim 1, wherein an angle between a first side of each of the at least two knee blocks and a surface on which a second side of each of the at least two knee blocks is resting is approximately sixty degrees.

4. The portable meditation system of claim 1, wherein an angle between a first side of each of the at least two knee blocks and a surface on which a second side of each of the at least two knee blocks is resting is approximately thirty degrees.

5. The portable meditation system of claim 1, further comprising a mat.

6. The portable meditation system of claim 1, wherein the at least two knee blocks are constructed of foam.

7. A portable meditation system, comprising:
at least two knee blocks; and
a seat;
wherein the entirety of the seat is crescent-shaped;
wherein two parallel faces of each of the at least two knee blocks include at least two rounded interior corners and at least two corresponding rounded exterior corners;
wherein each of the at least two rounded interior corners includes a different interior angle;
wherein an angle of a third interior corner is different from the interior angles of the at least two rounded interior corners; and
wherein the at least two knee blocks provide support for knees and hips of a user in a cross-legged position.

8. The portable meditation system of claim 1, wherein the seat consists of the crescent- shaped seat.

9. The portable meditation system of claim 7, wherein at least two edges joining the two parallel faces of each of the at least two knee blocks are concave relative to a perpendicular plane between the two parallel faces of each of the at least two knee blocks.

10. The portable meditation system of claim 7, wherein an angle between a first side of each of the at least two knee blocks and a surface on which a second side of each of the at least two knee blocks is resting is approximately sixty degrees.

11. The portable meditation system of claim 10, wherein an angle between the first side of each of the at least two knee blocks and a surface on which a third side of each of the at least two knee blocks is resting is approximately thirty degrees.

12. The portable meditation system of claim 7, wherein an angle between a first side of each of the at least two knee blocks and a surface on which a second side of each of the at least two knee blocks is resting is approximately thirty degrees.

13. A portable meditation system, comprising:
at least two knee blocks; and
a seat;
wherein the entirety of the seat is crescent-shaped;
wherein two faces of each of the at least two knee blocks include at least three rounded interior corners;
wherein each of the at least three rounded interior corners includes a different interior angle; and wherein at least two edges joining the two parallel faces of each of the at least two knee blocks are concave relative to a perpendicular plane between the two parallel faces of each of the at least two knee blocks.

14. The portable meditation system of claim 13, wherein an angle between a first side of each of the at least two knee blocks and a surface on which a second side of each of the at least two knee blocks is resting is approximately sixty degrees.

15. The portable meditation system of claim 14, wherein an angle between the first side of each of the at least two knee blocks and a surface on which a third side of each of the at least two knee blocks is resting is approximately thirty degrees.

16. The portable meditation system of claim 13, wherein an angle between a first side of each of the at least two knee blocks and a surface on which a second side of each of the at least two knee blocks is resting is approximately thirty degrees.

17. The portable meditation system of claim 13, further comprising a mat.

18. The portable meditation system of claim 13, wherein the at least two knee blocks are constructed of foam.

* * * * *